US005320938A

United States Patent [19]

House et al.

[11] Patent Number: 5,320,938

[45] Date of Patent: Jun. 14, 1994

[54] HIGH CHLORIDE TABULAR GRAIN EMULSIONS AND PROCESSES FOR THEIR PREPARATION

[75] Inventors: Gary L. House, Victor; Thomas B. Brust; Debra L. Hartsell, both of Rochester; Donald L. Black, Webster; Michael G. Antoniades, Rochester; Jerzy A. Budz, Fairport; Yun C. Chang, Rochester; Roger Lok, Rochester; Sherrill A. Puckett, Rochester; Allen K. Tsaur, Fairport, all of N.Y.

[73] Assignee: Eastman Kodak Company, Rochester, N.Y.

[21] Appl. No.: 112,489

[22] Filed: Aug. 25, 1993

Related U.S. Application Data

[63] Continuation-in-part of Ser. No. 34,060, Mar. 22, 1993, abandoned, Ser. No. 35,009, Mar. 22, 1993, abandoned, Ser. No. 33,738, Mar. 22, 1993, abandoned, Ser. No. 33,739, Mar. 22, 1993, abandoned, Ser. No. 34,982, Mar. 22, 1993, abandoned, and Ser. No. 34,317, Mar. 22, 1993, abandoned, said Ser. No. 34,060, is a continuation-in-part of Ser. No. 940,404, Sep. 3, 1992, abandoned, which is a continuation-in-part of Ser. No. 826,338, Jan. 27, 1992, abandoned, said Ser. No. 33,738, is a continuation-in-part of Ser. No. 940,404, Jan. 27, 1992, said Ser. No. 34,982, is a continuation-in-part of Ser. No. 940,404, Jan. 27, 1992.

[51] Int. Cl.[5] ..... G03C 1/005; G03C 1/015; G03C 1/09; G03C 1/34

[52] U.S. Cl. ..... 430/567; 430/569; 430/608; 430/611; 430/614; 430/615; 430/604; 430/605

[58] Field of Search ..... 430/567, 569, 608, 611, 430/614, 615, 604, 605

[56] References Cited

U.S. PATENT DOCUMENTS 2,728,663 12/1955 Allen et al. .
3,790,390 2/1974 Shiba et al. .
3,890,154 6/1975 Ohkubo et al. .
3,901,711 8/1975 Iwaosa et al. .
4,063,951 12/1977 Bogg .

(List continued on next page.)

FOREIGN PATENT DOCUMENTS 0326852 8/1989 European Pat. Off. .
0326853 8/1989 European Pat. Off. .
0355535 2/1990 European Pat. Off. .
0368275 5/1990 European Pat. Off. .
0370116 5/1990 European Pat. Off. .
0374954 6/1990 European Pat. Off. .
02024643 1/1990 Japan .
3-208041 9/1991 Japan .

OTHER PUBLICATIONS

Endo and Okaji, "An Empirical Rule to Modify the Crystal Habit of Silver Chloride to form Tabular Grains in an Emulsion", *The Journal of Photographic Science*, vol. 36, pp. 182–188, 1988.

(List continued on next page.)

*Primary Examiner*—Charles L. Bowers, Jr.
*Assistant Examiner*—Mark F. Huff
*Attorney, Agent, or Firm*—Carl O. Thomas

[57] ABSTRACT

Silver halide emulsions are disclosed in which at least 50 percent of total grain projected area is accounted for by tabular grains (1) bounded by {100} major faces having adjacent edge ratios of less than 10, (2) each having an aspect ratio of at least 2, and (3) internally at their nucleation site containing iodide and at least 50 mole percent chloride. The emulsions are prepared by a process comprised of the steps of (a) introducing silver and halide salts into a dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5 and (b) following nucleation completing grain growth under conditions that maintain the {100} major faces of the tabular grains.

85 Claims, 3 Drawing Sheets

U.S. PATENT DOCUMENTS

| | | | |
|---|---|---|---|
| 4,173,483 | 11/1979 | Habu et al. | 430/575 |
| 4,334,012 | 6/1982 | Mignot | 430/567 |
| 4,386,156 | 5/1983 | Mignot | 430/567 |
| 4,399,215 | 8/1983 | Wey | 430/567 |
| 4,400,463 | 8/1983 | Maskasky | 430/434 |
| 4,414,306 | 11/1983 | Wey et al. | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,835,093 | 5/1989 | Janusonis et al. | 430/567 |
| 4,879,208 | 11/1989 | Urabe | 430/569 |
| 4,892,807 | 1/1990 | Hirabayashi et al. | 430/611 |
| 4,933,272 | 6/1990 | McDugle et al. | 430/567 |
| 4,942,120 | 7/1990 | King et al. | 430/567 |
| 4,945,035 | 7/1990 | Keevert, Jr. et al. | 430/567 |
| 4,952,491 | 8/1990 | Nishikawa et al. | 430/570 |
| 4,960,689 | 10/1990 | Nishikawa et al. | 430/603 |
| 4,981,781 | 1/1991 | McDugle et al. | 430/605 |
| 4,983,508 | 1/1991 | Ishiguro et al. | 430/569 |
| 5,024,931 | 1/1991 | Evans et al. | 430/567 |
| 5,037,732 | 8/1991 | McDugle et al. | 430/567 |

OTHER PUBLICATIONS

Mumaw and Haugh "Silver Halide Precipitation Coalescence Processes" *Journal of Imaging Science,* vol. 30, No. 5, Sep./Oct. 1986, pp. 198–199.

Symposium: Torino 1963, *Photographic Science,* Edited by C. Semerano and U. Mazzucato, Focal Press, pp. 52–55.

G. F. Duffin, Photographic Emulsion Chemistry, Chapter 7, *The Focal Press,* London and New York (1966).

*Research Disclosure,* Aug. 1976, Item 14851.

*Research Disclosure,* vol. 308, Dec. 1989, Item 308119, Section VI.

2 μm

2 μm

HIGH CHLORIDE TABULAR GRAIN EMULSIONS AND PROCESSES FOR THEIR PREPARATION

This is a continuation-in-part of the following commonly assigned patent applications:

(1) House et al HIGH ASPECT RATIO TABULAR GRAIN EMULSIONS, U.S. Ser. No. 08/034,060, filed Mar. 22, 1993, now abandoned as a continuation-in-part of U.S. Ser. No. 940,404, filed Sep. 3, 1992, now abandoned, which is in turn a continuation-in-part of U.S. Ser. No. 826,338, filed Jan. 27, 1992, which was allowed, but forfeited in favor U.S. Ser. No. 940,404;

(2) House et al MODERATE ASPECT RATIO TABULAR GRAIN EMULSIONS AND PROCESSES FOR THEIR PREPARATION, U.S. Ser. No. 08/035,009, filed Mar. 22, 1993 now abandoned;

(3) House et al PROCESSES OF PREPARING TABULAR GRAIN EMULSIONS U.S. Ser. No. 08/33,738, filed Mar. 22, 1993, now abandoned as a continuation-in-part of U.S. Ser. No. 940,404, filed Sep. 3, 1992, now abandoned, which is in turn a continuation-in-part of U.S. Ser. No. 826,338, filed Jan. 27, 1992, which was allowed, but forfeited in favor U.S. Ser. No. 940,404;

(4) Puckett OLIGOMER MODIFIED TABULAR GRAIN EMULSIONS, U.S. Ser. No. 08/033,739, filed Mar. 22, 1993 now abandoned;

(5) Brust et al COORDINATION COMPLEX LIGAND MODIFIED TABULAR GRAIN EMULSIONS, U.S. Ser. No. 08/034,982, filed Mar. 22, 1993 now abandoned, as a continuation-in-part of U.S. Ser. No. 940,404, filed Sep. 3, 1992, now abandoned, which is in turn a continuation-in-part of U.S. Ser. No. 826,338, filed Jan. 27, 1992, which was allowed, but forfeited in favor U.S. Ser. No. 940,404; and (6) Lok et al TABULAR GRAIN EMULSIONS CONTAINING ANTIFOGGANTS AND STABILIZERS, U.S. Ser. No. 08/034,317, filed Mar. 22, 1993 now abandoned.

FIELD OF THE INVENTION

The invention relates to radiation sensitive silver halide emulsions and processes for their preparation.

BACKGROUND

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be achieved by employing high and intermediate aspect ratio tabular grain emulsions.

An emulsion is generally understood to be a "tabular grain emulsion" when tabular grains having an aspect ratio of at least 2 account for at least 50 percent of total grain projected area. The aspect ratio of a tabular grain is the ratio of its equivalent circular diameter (ECD) to its thickness (t). The equivalent circular diameter of a grain is the diameter of a circle having an area equal to the projected area of the grain. An emulsion is understood to be a "high aspect ratio tabular grain emulsion" when tabular grains having a thickness of less than 0.3 μm have an average aspect ratio of greater than 8. The term "intermediate aspect ratio emulsion" is employed when, through tabular grain thickening above 0.3 μm and/or low grain mean ECD, an average aspect ratio in the range of from 5–8 is exhibited. Generally, tabular grain emulsions exhibit average tabular grain aspect ratios of at least 2. The term "thin tabular grain" is generally understood to be a tabular grain having a thickness of less than 0.2 μm. The term "ultrathin tabular grain" is generally understood to be a tabular grain having a thickness of 0.06 μm or less. The term "high chloride" refers to grains that contain at least 50 mole percent chloride based on silver. In referring to grains of mixed halide content, the halides are named in order of increasing molar concentrations—e.g., silver iodochloride contains a higher molar concentration of chloride than iodide.

The overwhelming majority of high and intermediate aspect ratio tabular grain emulsions contain tabular grains that are irregular octahedral grains. Regular octahedral grains contain eight identical crystal faces, each lying in a different {111} crystallographic plane. Tabular irregular octahedra contain two or more parallel twin planes that separate two major grain faces lying in {111} crystallographic planes. The {111} major faces of the tabular grains exhibit a threefold symmetry, appearing triangular or hexagonal. It is generally accepted that the tabular shape of the grains is the result of the twin planes producing favored edge sites for silver halide deposition, with the result that the grains grow laterally while increasing little, if any, in thickness after parallel twin plane incorporation.

While high aspect ratio tabular grain emulsions have been advantageously employed in a wide variety of photographic and radiographic applications, the requirement of parallel twin plane formation and {111} crystal faces pose limitations both in emulsion preparation and use. These disadvantages are most in evidence in considering tabular grains containing high chloride concentrations. It is generally recognized that silver chloride grains prefer to form regular cubic grains—that is, grains bounded by six identical {100} crystal faces. Tabular grains bounded by {111} faces in silver chloride emulsions often revert to nontabular forms unless morphologically stabilized.

While high and intermediate aspect ratio tabular grain silver bromide emulsions were known to the art long before the 1980's, Wey U.S. Pat. No. 4,399,215 produced the first tabular grain silver chloride emulsion. The tabular grains were of the twinned type, exhibiting major faces of threefold symmetry lying in {111} crystallographic planes. An ammoniacal double-jet precipitation technique was employed. The thicknesses of the tabular grains were high compared to contemporaneous silver bromide and bromoiodide tabular grain emulsions because the ammonia ripening agent thickened the tabular grains. To achieve ammonia ripening it was also necessary to precipitate the emulsions at a relatively high pH, which is known to produce elevated minimum densities (fog) in high chloride emulsions. Further, to avoid degrading the tabular grain geometries sought both bromide and iodide ions were excluded from the tabular grains early in their formation.

Wey et al U.S. Pat. No. 4,414,306 developed a twinning process for preparing silver chlorobromide emulsions containing up to 40 mole percent chloride based on total silver. This process of preparation has not been successfully extended to high chloride emulsions. The highest average aspect ratio reported in the Examples was 11.

Maskasky U.S. Pat. No. 4,400,463 (hereinafter designated Maskasky I) developed a strategy for preparing a high chloride emulsion containing tabular grains with parallel twin planes and {111} major crystal faces with the significant advantage of tolerating significant internal inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers. Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. Tufano et al U.S. Pat. No. 4,804,621 employed di(hydroamino)azines as grain growth modifiers; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

Bogg U.S. Pat. No. 4,063,951 reported the first tabular grain emulsions in which the tabular grains had parallel {100} major crystal faces. The tabular grains of Bogg exhibited square or rectangular major faces, thus lacking the threefold symmetry of conventional tabular grain {111} major crystal faces. In the sole example Bogg employed an ammoniacal ripening process for preparing silver bromoiodide tabular grains having aspect ratios ranging from 4:1 to 1:1. The average aspect ratio of the emulsion was reported to be 2, with the highest aspect ratio grain (grain A in FIG. 3) being only 4. Bogg states that the emulsions can contain no more than 1 percent iodide and demonstrates only a 99.5% bromide 0.5% iodide emulsion. Attempts to prepare tabular grain emulsions by the procedures of Bogg have been unsuccessful.

Mignot U.S. Pat. No. 4,386,156 represents an improvement over Bogg in that the disadvantages of ammoniacal ripening were avoided in preparing a silver bromide emulsion containing tabular grains with square and rectangular major faces. Mignot specifically requires ripening in the absence of silver halide ripening agents other than bromide ion (e.g., thiocyanate, thioether or ammonia).

Endo and Okaji, "An Empirical Rule to Modify the Habit of Silver Chloride to form Tabular Grains in an Emulsion", *The Journal of Photographic Science*, Vol. 36, pp. 182–188, 1988, discloses silver chloride emulsions prepared in the presence of a thiocyanate ripening agent. Emulsion preparations by the procedures disclosed has produced emulsions containing a few tabular grains within a general grain population exhibiting mixed {111} and {100} faces.

Mumaw and Haugh, "Silver Halide Precipitation Coalescence Processes", *Journal of Imaging Science*, Vol. 30, No. 5, Sept./Oct. 1986, pp. 198–299, is essentially cumulative with Endo and Okaji, with section IV-B being particularly pertinent.

Symposium: Torino 1963, *Photographic Science*, Edited by C. Semerano and U. Mazzucato, Focal Press, pp. 52–55, discloses the ripening of a cubic grain silver chloride emulsion for several hours at 77° C. During ripening tabular grains emerged and the original cubic grains were depleted by Ostwald ripening. As demonstrated by the comparative Example below, after 3 hours of ripening tabular grains account for only a small fraction of the total grain projected area, and only a small fraction of the tabular grains were less than 0.3 μm in thickness. In further investigations going beyond the actual teachings provided, extended ripening eliminated many of the smaller cubic grains, but also degraded many of the tabular grains to thicker forms.

Japanese published patent application (Kokai) 02/024,643, laid open Jan. 26, 1990, was cited in a Patent Cooperation Treaty search report as being pertinent to the subject matter claimed, but is in Applicants' view unrelated. The claim is directed to a negative working emulsion containing a hydrazide derivative and tabular grains with an equivalent circular diameter of 0.6 to 0.2 μm. Only conventional tabular grain preparations are disclosed and only silver bromide and bromoiodide emulsions are exemplified.

In the precipitation of silver halide emulsions it is the most common practice to perform the entire precipitation reaction in a single reaction vessel. Nevertheless, so-called "dual-zone" precipitations have also been reported. In dual-zone arrangements silver and halide ions are brought together to form grain nuclei in a first area and then transported to a second area for grain growth. For many years emulsion was recirculated from the second (growth) area to the first (nucleation) area, but more recently arrangements have been reported that do not recirculate any portion of the emulsion from the second (growth) area to the first (nucleation) area, thereby completely isolating grain nucleation from grain growth. Specific illustrations of dual-zone precipitation are provided by Mignot U.S. Pat. No. 4,334,012, Urabe U.S. Pat. No. 4,879,208, and European published patent applications 326,852, 326,853, 355,535, 370,116, 368,275 and 374,954.

Although it was known for many years that the performance of silver halide emulsions can be modified by the introduction of transition metal ions during grain precipitation, it was generally assumed that the counterion of the transition metal ion, except when it happened to be halide ion, did not enter the grain structure and that the counterion selection was unrelated to photographic performance. Janusonis et al U.S. Pat. No. 4,933,272; McDugle et al U.S. Pat. Nos. 4,933,272, 4,981,781, and 5,037,732; and Keevert et al U.S. Pat. No. 4,945,035 were the first to demonstrate that ligands capable of forming coordination complexes with transition metal ions are capable of entering the grain crystal lattice structure and producing modifications of photographic performance that are not realized by incorporation of the transition metal ion alone. Thereafter, by hindsight, it was realized that earlier disclosures of adding transition metal ion dopants, either as simple salts or as coordination complexes, had inadvertently disclosed useful ligand incorporations. Of these inadvertent teachings, the incorporation of iron hexacyanide during grain precipitation is the most notable and is illustrated by Shiba et al U.S. Pat. No. 3,790,390; Ohkubo et al U.S. Pat. No. 3.890.154; Iwaosa et al U.S. Pat. No. 3,901,711 and Habu et al U.S. Pat. No. 4,173,483, Evans et al U.S. Pat. No. 5,024,931 discloses a photographic silver halide emulsion comprised of radiation sensitive silver halide grains exhibiting a face centered cubic crystal lattice structure containing on average, at least one pair of metal ions chosen from group VIII, periods 5 and 6, at adjacent cation sites of the crystal lattice. Increased speed and reduced low intensity reciprocity failure are demonstrated in silver bromide emulsions.

Silver halide emulsions having high chloride contents, e.g., greater than 50 mole percent chloride based on silver, are known to be very desirable in image-forming systems due to the high solubility of silver chloride, which permits short processing times and provides less environmentally polluting effluents. Nevertheless, the higher the chloride content of a silver halide emulsion, the more difficult it is to achieve high and stable radiation sensitivity (sometimes referred to in the photographic art as "speed"). One reason for this is that conventional emulsions having high chloride contents exhibit a severe propensity to deterioration upon aging or storage. As a consequence, such an aged or stored emulsion when processed, produces a higher minimum density than the "fresh" emulsion. This increase in minimum density, commonly referred to as "fog", is attributable to the formation of a low level of reduced silver formation that occurs independently of imagewise exposure. In color photography, fog is typically observed as image dye density, rather than directly as silver density. Changes in fog and sensitivity are particularly troublesome in color photographic elements that comprise multiple color layers since such changes can vary from layer to layer which results in a color imbalance and reduction in quality.

Materials known in the photographic art as photographic "stabilizers", as distinguished from the general class of "antifoggants", have been used in the past to protect radiation sensitive silver halide emulsions against changes in sensitivity and fog upon aging and storage. One skilled in the art readily recognizes the distinction between the use of photographic stabilizers, which combat fog and sensitivity changes that occur upon storage, and those materials, categorized as antifoggants, which combat fog caused by such things as the inherent nature of the radiation sensitive silver halide emulsion (which may produce chemical fog) or the conditions of development of the emulsion, for example, development for protracted periods of time or at temperatures above normal. A more detailed discussion of this distinction between antifoggants and stabilizers can be found in G. F. Duffin, *Photographic Emulsion Chemistry,* Chapter 7, The Focal Press, London and New York (1966), *Research Disclosure,* August 1976, Item 14851 and U.S. Pat. No. No. 2,728,663. Research Disclosure is published by Kenneth Mason Publication, Ltd., the Old Harbourmaster's, 8 North Street, Emsworth, Hampshire P010 7DD, England.

An extensive description of photographic stabilizers and antifoggants which are indicated to be useful for avoiding instability that increases minimum density in negative-type emulsion coatings (i.e., fog) or that increases minimum density or decreases maximum density in direct-positive emulsion coatings is set forth in *Research Disclosure,* Vol. 308, December 1989, Item 308119, Section VI. In addition, Nishikawa et al , U.S. Pat. No. No. 4,960,689, describes a color photographic material that comprises a silver halide emulsion containing at least 50 mole percent chloride and a compound that is referred to as an antifoggant. The antifoggant described contains a thiosulfonate group. The patent alleges that the color photographic material has high sensitivity and small reciprocity failure and storage fog. Also, Japanese published Patent Application (Kokai) 03/208,041, laid open Sep. 11, 1991, describes a silver halide color photographic material having a silver halide emulsion layer in which the emulsion is prepared in the presence of a thiosulfonate compound. The application alleges that the color material undergoes less fogging during emulsion coating, storage of the emulsion and high speed development.

RELATED PATENT APPLICATIONS

Maskasky U.S. Ser. No. 08/035,349, filed Mar. 22, 1993 now allowed, as a continuation-in-part of U.S. Ser. No. 955,010, filed Oct. 1, 1992, now abandoned, which is in turn a continuation-in-part of U.S. Ser. No. 764,868, filed Sep. 24, 1991, now abandoned, titled HIGH TABULARITY HIGH CHLORIDE EMULSIONS WITH INHERENTLY STABLE GRAIN FACES, commonly assigned, discloses high aspect ratio tabular grain high chloride emulsions containing tabular grains that are internally free of iodide and that have {100} major faces. In a preferred form, an organic compound containing a nitrogen atom with a resonance stabilized $\pi$ electron pair is employed to favor formation of {100} faces.

Budz et al U.S. Ser. No. 08/034,962, filed Mar. 22, 1993, commonly assigned, titled DIGITAL IMAGING WITH TABULAR GRAIN EMULSIONS, discloses digitally imaging photographic elements containing tabular grain emulsions comprised of a dispersing medium and silver halide grains. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Szajewski U.S. Ser. No. 08/034,061, filed Mar. 22, 1993 now allowed, commonly assigned, titled FILM AND CAMERA, discloses roll films and roll film containing cameras in which at least one emulsion layer is present containing tabular grain emulsions comprised of a dispersing medium and silver halide grains. At least percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Szajewski, House, Brust, Hartsell, Black, Bohan and Merrill U.S. Ser. No. 08/069,236, filed Jun. 1, 1993, as a continuation-in-part of U.S. Ser. No. 940,404, filed Sep. 3, 1992, now abandoned, which is in turn a continuation-in-part of U.S. Ser. No. 826,338, filed Jan. 27, 1992, now abandoned, each commonly assigned, titled DYE IMAGE FORMING PHOTOGRAPHIC ELEMENTS, discloses dye image forming photographic elements containing at least one tabular grain emulsion comprised of a dispersing medium and silver halide grains. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Maskasky U.S. Ser. No. 08/034,998, filed Mar. 22, 1993 now U.S. Pat. No. 5,264,337, commonly assigned, titled MODERATE ASPECT RATIO TABULAR GRAIN HIGH CHLORIDE EMULSIONS WITH INHERENTLY STABLE GRAIN FACES, discloses an emulsion containing a grain population internally free of iodide at the grain nucleation site and comprised of at least mole percent chloride. At least 50 percent of the grain population projected area is accounted for by {100} tabular grains each having an aspect ratio of at least 2 and together having an average aspect ratio of up to 7.5.

Szajewski and Buchanan U.S. Ser. No. 08/035,347, filed Mar. 22, 1993, commonly assigned, titled METHOD OF PROCESSING PHOTOGRAPHIC ELEMENTS CONTAINING TABULAR GRAIN EMULSIONS, discloses a process of developing and desilvering a dye image forming photographic element containing an emulsion of the type herein disclosed.

SUMMARY OF THE INVENTION

In one aspect the invention is directed to a radiation sensitive emulsion comprised of a dispersing medium and silver halide grains, wherein at least 50 percent of total grain projected area is accounted for by tabular grains (1) bounded by {100}major faces having adjacent edge ratios of less than 10, (2) each having an aspect ratio of at least 2, and (3) internally at their nucleation site contain iodide and at least 50 mole percent chloride.

In another aspect this invention is directed to a process of preparing silver halide emulsions in which at least 50 percent of total grain projected area is accounted for by tabular grains (1) bounded by (100) major faces having adjacent edge ratios of less than 10, (2) each having an aspect ratio of at least 2, and (3) internally at their nucleation site containing iodide and at least 50 mole percent chloride, comprised of the steps of (a) introducing silver and halide salts into a dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5 and (b) following nucleation completing grain growth under conditions that maintain the (100) major faces of the tabular grains.

The present invention has been made possible by the discovery of a novel approach to forming tabular grains. Instead of introducing parallel twin planes in grains as they are being formed to induce tabularity and thereby produce tabular grains with {111} major faces, it has been discovered that the presence of iodide in the dispersing medium during a high chloride nucleation step coupled with maintaining the chloride ion in solution within a selected pCl range results in the formation of a tabular grain emulsion in which the tabular grains are bounded by {100} crystal faces.

The emulsions that are produced by the process are novel. The invention places within the reach of the art tabular grains bounded by (100) crystal faces with halide contents, halide distributions and grain thicknesses that have not been heretofore realized. The present invention provides the first ultrathin tabular grain emulsion in which the grains are bounded by {100} crystal faces. The invention in a preferred form provides high aspect ratio tabular grain high chloride emulsions exhibiting high levels of grain stability. Unlike high chloride tabular grain emulsions in which the tabular grains have {111} major faces, the emulsions of the invention do not require a morphological stabilizer adsorbed to the major faces of the grains to maintain their tabular form. Finally, while clearly applicable to high chloride emulsions, the present invention extends beyond high chloride emulsions to those containing a wide range of bromide, iodide and chloride concentrations.

DESCRIPTION OF PREFERRED EMBODIMENTS

Figure 1:
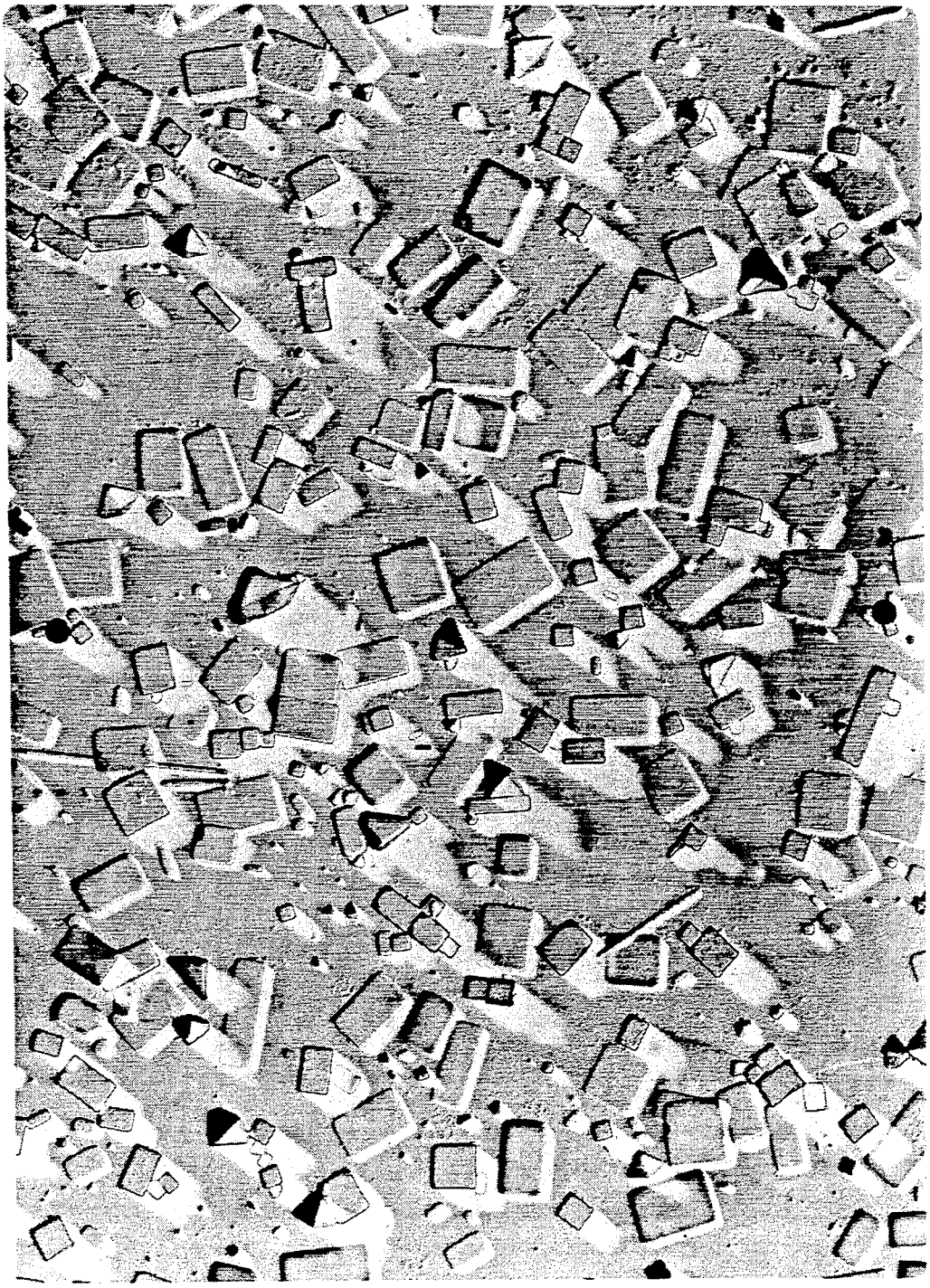
FIG. 1 is a shadowed photomicrograph of carbon grain replicas of an emulsion of the invention.

The photographically useful, radiation sensitive emulsions of the invention are comprised of a dispersing medium and silver halide grains, wherein at least 50 percent of total grain projected area is accounted for by tabular grains (1) bounded by {100} major faces having adjacent edge ratios of less than 10, (2) each having an aspect ratio of at least 2, and (3) internally at their nucleation site contain iodide and at least 50 mole percent chloride.

In one preferred form the emulsions of the invention are high aspect ratio tabular grain emulsions comprised of a dispersing medium and silver halide grains which are at least in part tabular grains bounded by {100} major faces. Of the bounded by {100} major faces those accounting for 50 percent of the total grain projected area, selected on the criteria of (1) adjacent major face edge ratios of less than 10, (2) thicknesses of less than 0.3 μm and (3) higher aspect ratios than any remaining tabular grains satisfying criteria (1) and (2), have an average aspect ratio of greater than 8.

In another preferred form the emulsions of the invention are intermediate aspect ratio tabular grain emulsions comprised of a dispersing medium and silver halide grains, wherein at least 50 percent of total grain projected area is accounted for by tabular grains (1) bounded by {100} major faces having adjacent edge ratios of less than 10, (2) each having an average aspect ratio of up to 8, and (3) internally at their nucleation site contain iodide and at least 50 mole percent chloride.

The identification of emulsions satisfying the {100} tabular grain projected area and aspect ratio requirements of the invention can be undertaken by analytical procedures that are well known in the art.

For example, the identification of preferred high aspect ratio tabular grain emulsions satisfying the requirements of the invention and the significance of the selection parameters can be better appreciated by considering a typical emulsion. FIG. 1 is a shadowed photomicrograph of carbon grain replicas of a representative emulsion of the invention, described in detail in Example 1 below. It is immediately apparent that most of the grains have orthogonal tetragonal (square or rectangular) faces. The orthogonal tetragonal shape of the grain faces indicates that they are {100} crystal faces.

The projected areas of the few grains in the sample that do not have square or rectangular faces are noted for inclusion in the calculation of the total grain projected area, but these grains clearly are not part of the tabular grain population having {100} major faces.

A few grains may be observed that are acicular or rod-like grains (hereinafter referred as rods). These grains are more than 10 times longer in one dimension than in any other dimension and can be excluded from the desired tabular grain population based on their high ratio of edge lengths. The projected area accounted for by the rods is low, but, when rods are present, their projected area is noted for determining total grain projected area.

The grains remaining all have square or rectangular major faces, indicative of {100} crystal faces. Some of these grains are regular cubic grains. That is, they are grains that have three mutually perpendicular edges of equal length. To distinguish cubic grains from tabular grains it is necessary to measure the grain shadow lengths. From a knowledge of the shadow angle it is possible to calculate the thickness of a grain from a measurement of its shadow length. The projected areas of the cubic grains are included in determining total grain projected area.

To quantify the characteristics of the tabular grains, a grain-by-grain examination of each of the remaining grains presenting square or rectangular faces is required. The projected area of each grain is noted for determination of total grain projected area.

Each of the grains having a square or rectangular face and a thickness of less than 0.3 μm is examined. The projected area (the product of edge lengths) of the upper surface of each grain is noted. From the grain projected area the ECD of the grain is calculated. The thickness (t) of the grain and its aspect ratio (ECD/t) of the grain are next calculated.

After all of the grains having a square or rectangular face and a thickness of less than 0.3 μm have been measured, these grains are rank ordered according to aspect ratio. The grain with the highest aspect ratio is rank ordered first and the grain with the lowest aspect ratio is rank ordered last.

Proceeding from the top of the aspect ratio rank ordering, sufficient tabular grains are selected to account for 50 percent of total grain projected area. The aspect ratios of the selected tabular grain population are then averaged. In the emulsion of FIG. 1 and in the emulsions of the invention the average aspect ratio of the selected tabular grain population is greater than 8.

In specifically preferred emulsions according to the invention average aspect ratios of the selected tabular grain population are greater than 12 and optimally at least 20. Typically the average aspect ratio of the selected tabular grain population ranges up to 50, but higher aspect ratios of 100, 200 or more can be realized.

The selected tabular grain population accounting for 50 percent of total grain projected area preferably exhibits major face edge length ratios of less than 5 and optimally less than 2. The nearer the major face edge length ratios approach 1 i.e., equal edge lengths) the lower is the probability of a significant rod population being present in the emulsion. Further, it is believed that tabular grains with lower edge ratios are less susceptible to pressure desensitization.

Instead of rank ordering tabular grains accounting for 50 percent of total grain projected area as described above to arrive at an average aspect ratio a simpler approach can be employed in characterizing many of the emulsions satisfying the requirements of the invention in which tabular grains are the primary grain population present. Following this approach an average grain ECD and an average grain thickness (t) are obtained, excluding only rods and grains lacking {100} major faces. When average grain thickness is less than 0.3 μm and average grain aspect ratio (ECD/t) is greater than 8, the emulsion in every instance is one which satisfies the parameter requirements noted above by the more laborious rank ordering procedure.

A simplified approach applicable to all the tabular grain emulsions of the invention, involves excluding all grains lacking orthogonal tetragonal (i.e., {100} faces) and excluding grains with adjacent major face edge ratios of more than 10. Of the remaining grains, those having individual aspect ratios of at least 2 determined by shadow angle measurement (i.e., the selected tabular grains) account for greater than 50 percent of total grain projected area.

In one specifically contemplated form the emulsions of the invention are intermediate aspect ratio tabular grain emulsions having an average aspect ratio in the range of from 5 to 8.

In one specifically preferred form of the invention the tabular grain population is selected on the basis of tabular grain thicknesses of less than 0.2 μm instead of 0.3 μm. In other words, the emulsions are in this instance thin tabular grain emulsions.

Surprisingly, ultrathin tabular grain emulsions have been prepared satisfying the requirements of the invention. Ultrathin tabular grain emulsions are those in which the selected tabular grain population is made up of tabular grains having thicknesses of less than 0.06 μm. Prior to the present invention the only ultrathin tabular grain emulsions of a halide content exhibiting a cubic crystal lattice structure known in the art contained tabular grains bounded by {111} major faces. In other words, it was thought essential to form tabular grains by the mechanism of parallel twin plane incorporation to achieve ultrathin dimensions. Emulsions according to the invention can be prepared in which the selected tabular grain population has a mean thickness down to 0.02 μm and even 0.01 μm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, ultrathin tabular grain emulsions according to the invention can have entirely negligible levels of blue sensitivity, and are therefore capable of providing a green or red record in a photographic product that exhibits minimal blue contamination even when located to receive blue light.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T = ECD/t^2 = AR/t$$

where

T is tabularity;

AR is aspect ratio;

ECD is equivalent circular diameter in micrometers (μm); and t is grain thickness in micrometers.

The selected tabular grain population accounting for 50 percent of total grain projected area preferably exhibits a tabularity of greater than 25 and most preferably greater than 100. Since the selected tabular grain population can be ultrathin, it is apparent that extremely high tabularities, ranging to 1000 and above are within the contemplation of the invention.

The selected tabular grain population can exhibit an average ECD of any photographically useful magnitude. For photographic utility average ECD's of less than 10 μm are contemplated, although average ECD's in most photographic applications rarely exceed 6 μm. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

So long as the selected population of tabular grains satisfying the parameters noted above accounts for at least 50 percent of total grain projected area a photographically desirable grain population is available. It is recognized that the advantageous properties of the emulsions of the invention are increased as the proportion of tabular grains having thicknesses of less than 0.3 μm and {100} major faces is increased. The preferred emulsions according to the invention are those in which at least 70 percent and optimally at least 90 percent of total grain projected area is accounted for by tabular grains having {100} major faces. It is specifically contemplated to provide emulsions satisfying the grain descriptions above in which the selection of the rank ordered tabular grains extends to sufficient tabular grains to account for 70 percent or even 90 percent of total grain projected area.

So long as tabular grains having the desired characteristics described above account for the requisite proportion of the total grain projected area, the remainder of the total grain projected area can be accounted for by any combination of coprecipitated grains. It is, of course, common practice in the art to blend emulsions to achieve specific photographic objectives. Blended emulsions that satisfy the selected tabular grain descriptions above are specifically contemplated.

If tabular grains having a thickness of less than 0.3 μm do not account for 50 percent of the total grain projected area, the emulsion does not satisfy the requirements of the invention and is, in general, a photographically inferior emulsion. For most applications (particularly applications that require spectral sensitization, require rapid processing and/or seek to minimize silver coverages) emulsions are photographically inferior in which many or all of the tabular grains are relatively thick—e.g., emulsions containing high proportions of tabular grains with thicknesses in excess of 0.3 μm. Emulsions containing thicker (up to 0.5 μm) tabular grains with {111} major faces, though generally inferior, have been suggested for use in the art to maximize capture of light in the spectral region to which silver halide exhibits native sensitivity (e.g., blue light). Emulsions containing thicker tabular grains having {100} major faces can be applied, if desired, to similar applications.

Figure 2:
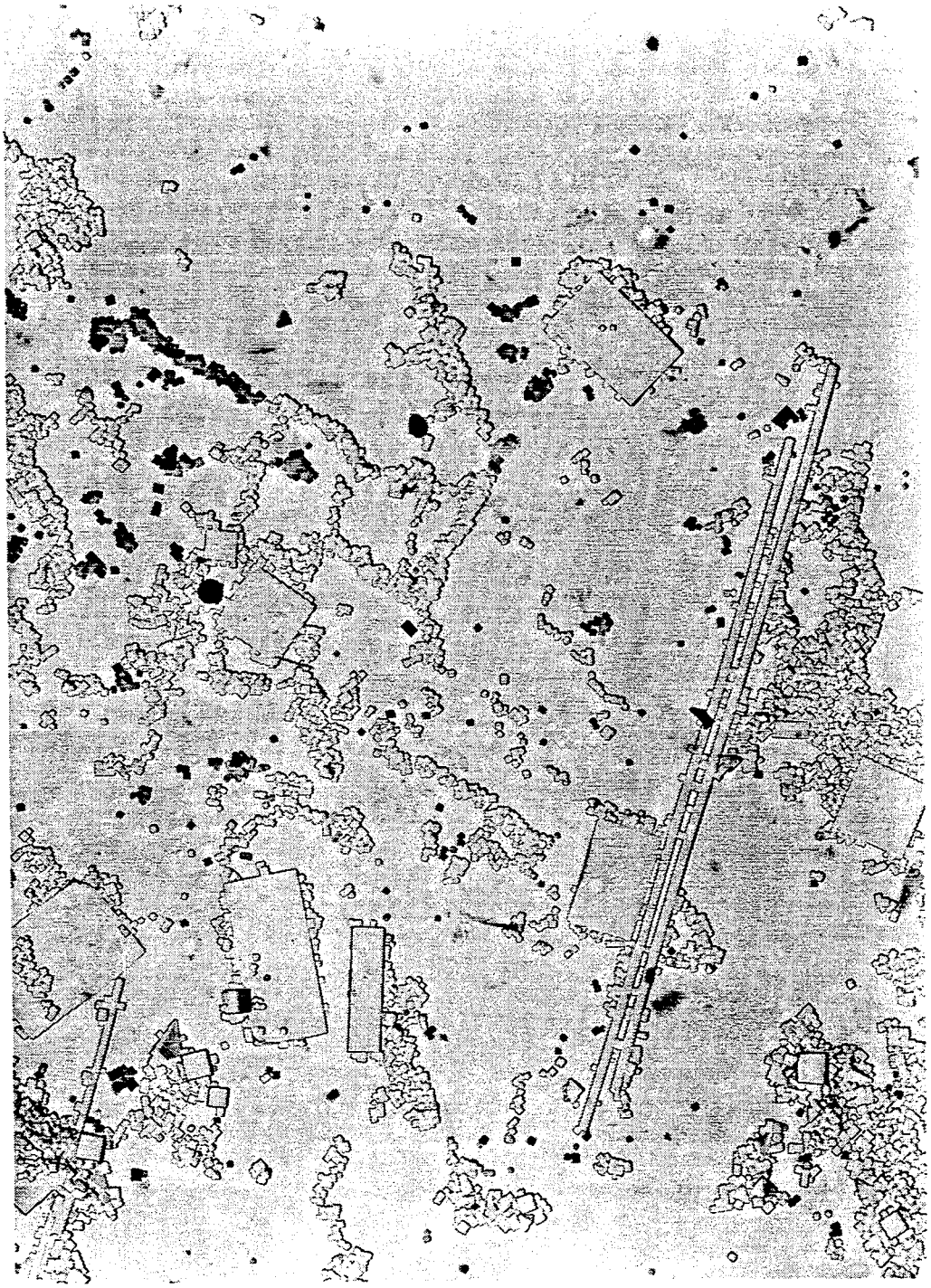
FIG. 2 is a shadowed photomicrograph of carbon grain replicas of a control emulsion.

More commonly, inferior emulsions failing to satisfy the requirements of the invention have an excessive proportion of total grain projected area accounted for by cubes, twinned nontabular grains, and rods. Such an emulsion is shown in FIG. 2. Most of the grain projected area is accounted for by cubic grains. Also the rod population is much more pronounced than in FIG. 1. A few tabular grains are present, but they account for only a minor portion of total grain projected area.

The tabular grain emulsion of FIG. 1 satisfying the requirements of the invention and the predominantly cubic grain emulsion of FIG. 2 were prepared under conditions that were identical, except for iodide management during nucleation. The FIG. 2 emulsion is a silver chloride emulsion while the emulsion of FIG. 1 additionally includes a small amount of iodide introduced during grain nucleation.

Obtaining emulsions satisfying the requirements of the invention has been achieved by the discovery of a novel precipitation process. In this process grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion. The incorporated iodide ions introduce crystal irregularities that in the course of further grain growth result in tabular grains rather than regular (cubic) grains.

Figure 3:
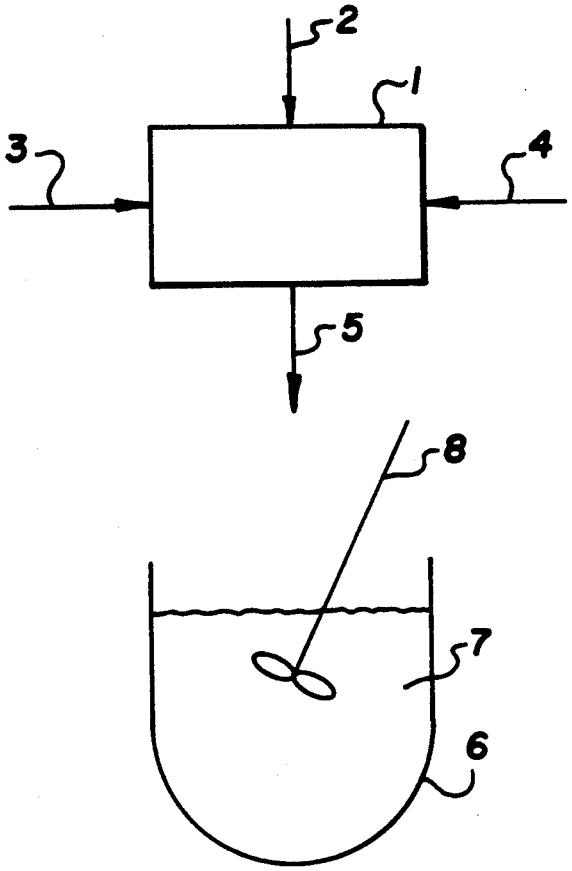
FIG. 3 is a schematic diagram of a dual zone reactor.

A preferred procedure for obtaining high chloride {100} tabular grain emulsions of the type described above has been realized by the discovery of a novel dual-zone precipitation process. A preferred dual-zone precipitation apparatus is shown in FIG. 3, wherein a continuous double-jet nucleation reactor 1 is provided to receive a dispersing medium through jet 2, a silver salt solution through jet 3 and a halide salt solution through jet 4. Within the reactor the silver and halide salts react to form grain nuclei. The reaction mixture containing the grain nuclei is then transported, as indicated by arrow 5, to a growth reaction vessel 6 containing a liquid medium 7 comprised of an initially present dispersing medium and/or an earlier transported portion of the emulsion formed in the nucleation reactor. The growth reaction vessel is shown equipped with a stirring device 8. If desired additional silver and halide ions can be supplied to the growth reaction vessel.

In the dual-zone precipitation process of the invention grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion. The incorporated iodide ions introduce crystal irregularities that in the course of further grain growth result in tabular grains rather than regular (cubic) grains.

It is believed that at the outset of nucleation the incorporation of iodide ion into the crystal structure results in cubic grain nuclei being formed having one or more irregularities in one or more of the cubic crystal faces. The cubic crystal faces that contain at least one irregularity thereafter accept silver halide at an accelerated rate as compared to the regular cubic crystal faces (i.e., those lacking an irregularity). When only one of the cubic crystal faces contains an irregularity, grain growth on only one face is accelerated, and the resulting grain structure on continued growth is a rod. The same result occurs when only two opposite parallel faces of the cubic crystal structure contain the growth accelerating irregularities. However, when any two contiguous cubic crystal faces contain the irregularity, continued growth accelerates growth on both faces and produces a tabular grain structure. It is believed that the tabular grains of the emulsions of this invention are produced by those grain nuclei having two, three or four faces containing the growth accelerating irregularities.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is preferably introduced into the dispersing medium concurrently with or, optimally, before opening the silver jet. Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962). pp. 129–134, to be 13 mole percent. In silver halide grains in which equal molar proportions of chloride and bromide ion are present up to 27 mole percent iodide, based on silver, can be incorporated in the grains. It is preferred to undertake grain nucleation and growth below the iodide saturation limit to avoid the precipitation of a separate silver iodide phase and thereby avoid creating an additional category of unwanted grains. It is generally preferred to maintain the iodide ion concentration in the dispersing medium at the outset of nucleation at less than 10 mole percent. In fact, only minute amounts of iodide at nucleation are required to achieve the desired tabular grain population. Initial iodide ion concentrations of down to 0.001 mole percent are contemplated. However, for convenience in replication of results, it is preferred to maintain initial iodide concentrations of at least 0.01 mole percent and, optimally, at least 0.05 mole percent.

In the preferred form of the invention silver iodochloride grain nuclei are formed during the nucleation step. Minor amounts of bromide ion can be present in the dispersing medium during nucleation. Any amount of bromide ion can be present in the dispersing medium during nucleation that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. For manipulative convenience and reproducibility, silver ion introduction during the nucleation step is preferably extended for a convenient period, typically from 5 seconds to less than a minute. So long as the pCl remains within the ranges set forth above no additional chloride ion need be added to the dispersing medium during the nucleation step. It is, however, preferred to introduce both silver and halide salts concurrently during the nucleation step. The advantage of adding halide salts concurrently with silver salt throughout the nucleation step is that this permits assurance that any grain nuclei formed after the outset of silver ion addition are of essentially similar halide content as those grain nuclei initially formed. Iodide ion addition during the nucleation step is particularly preferred. Since the deposition rate of iodide ion far exceeds that of the other halides, iodide will be depleted from the dispersing medium unless replenished.

Any convenient conventional source of silver and halide ions can be employed during the nucleation step. Silver ion is preferably introduced as an aqueous silver salt solution, such as a silver nitrate solution. Halide ion is preferably introduced as alkali or alkaline earth halide, such as lithium, sodium and/or potassium chloride, bromide and/or iodide.

It is possible, but not preferred, to introduce silver chloride or silver iodochloride Lippmann grains into the dispersing medium during the nucleation step. In this instance grain nucleation has already occurred and what is referred to above as the nucleation step is in reality a step for introduction of grain facet irregularities. The disadvantage of delaying the introduction of grain facet irregularities is that this produces thicker tabular grains than would otherwise be obtained.

The dispersing medium contained in the reaction vessel prior to the nucleation step is comprised of water, the dissolved halide ions discussed above and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., $<7.0$). To minimize fog a preferred pH range for precipitation is from 2.0 to 5.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure,* Vol. 308, December 1989, Item 308119, Section IX. While synthetic polymeric peptizers of the type disclosed by Maskasky I, cited above and here incorporated by reference, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer, these peptizers and their preparation are described by Maskasky II and King et al, cited above, the disclosures of which are here incorporated by reference. However, it should be noted that the grain growth modifiers of the type taught for inclusion in the emulsions of Maskasky I and II (e.g., adenine) are not appropriate for inclusion in the dispersing media of this invention, since these grain growth modifiers promote twinning and the formation of tabular grains having {111} major faces. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

Since grain nuclei formation occurs almost instantaneously, only a very small proportion of the total silver need be introduced into the reaction vessel during the nucleation step. Typically from about 0.1 to 10 mole percent of total silver is introduced during the nucleation step.

A grain growth step follows the nucleation step in which the grain nuclei are grown until tabular grains having {100}major faces of a desired average ECD are obtained. Whereas the objective of the nucleation step is to form a grain population having the desired incorporated crystal structure irregularities, the objective of the growth step is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described above.

In its simplest form the process of preparing emulsions according to the invention can be performed as a single jet precipitation without interrupting silver ion introduction from start to finish. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, single jet precipitation limits halide content and profiles and generally results in more polydisperse grain populations.

It is usually preferred to prepare photographic emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

In the preparation of emulsions according to the invention it is preferred to interrupt silver and halide salt introductions at the conclusion of the nucleation step and before proceeding to the growth step that brings the emulsions to their desired final size and shape. The emulsions are held within the temperature ranges described above for nucleation for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

Once the desired population of grain nuclei have been formed, grain growth to obtain the emulsions of the invention can proceed according to any convenient conventional precipitation technique for the precipitation of silver halide grains bounded by {100} grain faces. Whereas iodide and chloride ions are required to be incorporated into the grains during nucleation and are therefore present in the completed grains at the internal nucleation site, any halide or combination of halides known to form a cubic crystal lattice structure can be employed during the growth step. Neither iodide nor chloride ions need be incorporated in the grains during the growth step, since the irregular grain nuclei faces that result in tabular grain growth, once introduced, persist during subsequent grain growth independently of the halide being precipitated, provided the halide or halide combination is one that forms a cubic crystal lattice. This excludes only iodide levels above 13 mole percent (preferably 6 mole percent) in precipitating silver iodochloride, levels of iodide above 40 mole percent (preferably 30 mole percent) in precipitating silver iodobromide, and proportionally intermediate levels of iodide in precipitating silver iodohalides containing bromide and chloride. When silver bromide or silver iodobromide is being deposited during the growth step, it is preferred to maintain a pBr within the dispersing medium in the range of from 1.0 to 4.2, preferably 1.6 to 3.4. When silver chloride, silver iodochloride, silver bromochloride or silver iodobromochloride is being deposited during the growth step, it is preferred to maintain the pCl within the dispersing medium within the ranges noted above in describing the nucleation step.

It has been discovered quite unexpectedly that up to 20 percent reductions in tabular grain thicknesses can be realized by specific halide introductions during grain growth. Surprisingly, it has been observed that bromide additions during the growth step in the range of from 0.05 to 15 mole percent, preferably from 1 to 10 mole percent , based on silver, produce relatively thinner {100} tabular grains than can be realized under the same conditions of precipitation in the absence of bromide ion. Similarly, it has been observed that iodide additions during the growth step in the range of from 0.001 to $<1$ mole percent, based on silver, produce relatively thinner (100} tabular grains than can be realized under the same conditions of precipitation in the absence of iodide ion.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, and Wey "Growth Mechanism of AgBr Crystals in Gelatin Solution", *Photographic Science and Engineering,* Vol. 21, No. 1, Jan./Feb. 1977, p. 14, et seq.

In the simplest form of the invention the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described above. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326 852, 0 326 853, 0 355 535 and 0 370 116, Ichizo published European Patent Application 0 368 275, Urabe et al published European Patent Application 0 374 954, and Onishi et al published Japanese Patent Application (Kokai) 172,817-A (1990).

The emulsions of the invention include silver iodochloride emulsions, silver iodobromochloride emulsions and silver iodochlorobromide emulsions. In addition to silver and halide ions the {100} tabular grains can internally contain dopants. The term "dopant" is employed in its art recognized usage and refers to a material other than a silver ion or a halide ion contained within the grain structure. Dopant concentratins reported in the art range up to $10^{-2}$ mole per silver mole or higher, but more typically are less than $10^{-4}$ mole per silver mole. Dopants can be added to the emulsion at any stage of grain precipitation and are preferably added during grain growth. Because of their extremely low quantities, the addition of dopants has no effect on grain size or shape.

Specifically contemplated for incorporation are transition metal ion dopants, employed as the sole dopant ions or in combination with performance modifying dopant ions capable of forming coordination complex ligands with the transition metal ion dopants. The term "transition metal" refers to any element of groups 3 to 12 inclusive of the periodic table of elements. All references to periods and groups within the periodic table of elements are based on the format of the period table adopted by the American Chemical Society and published in the *Chemical and Engineering News,* Feb. 4, 1985, p. 26. Specifically preferred transition metal dopants are those of groups 5 to 10 inclusive. Specifically preferred are transition metal dopants of groups 8, 9 and 10. Light transition metals, those of period 4, are contemplated, with iron being a specifically preferred light transition metal dopant. The term "heavy transition metal" refers to transition metals of periods 5 and 6. Preferred heavy transition metal dopant are those of the palladium triad and the platinum triad. The palladium triad consists of the period 5 elements of groups 8, 9 and 10—i.e., ruthenium, rhodium and palladium. The platinum triad consists of the period 6 elements of groups 8, 9 and 10—i.e., osmium, iridium and platinum.

Any performance modifying ion dopant can be included in the grain structure alone or in combination with the transition metal ion dopants that is capable of forming coordination complex ligands with the transition metal ion dopants. Specifically contemplated performance modifying ligands include aquo ($H_2O$), azide ($N_3$), cyano (CN), cyanate (OCN), thiocyanate (SCN), selenocyanate (SeCN), tellurocyanate (TeCN), nitrosyl (NO), thionitrosyl (NS), oxo (O) and carbonyl (CO) ligands. Both tetracoordination complexes (those that coordinate four ligands with each transition metal ion) and hexacoordination complexes (those that coordinate six ligands with each transition metal ion) are specifically preferred, since they provide metal and ligand configurations that are most easily substituted for a silver ion and four or six surrounding halide ions in the cubic crystal lattice structure of the grain. Coordination complexes contemplated for grain inclusion can contain a single performance modifying dopant ligand forming from one to all of the ligands of the coordination complex or a combination of performance modifying dopant ligands. Coordination complex ligands that are not performance modifying dopants, such as halo ligands, are specifically contemplated for use in combination with the performance modifying ligands. The halo ligands (hereinafter also designated X ligands) can be formed by halide ions that are the same or different than those otherwise found in the grain structure. The halo ligands are chosen from among fluoro, chloro, bromo and iodo ligands.

In one specifically preferred form of the invention the performance modifying dopant is a cyano ligand forming from 1 to 6 ligands of a coordination complex with a transition metal ion. Iron hexacyanide is a specific example of a preferred light transition metal hexacoordination complex employing cyano ligands as the performance modifying dopant. Coordination complexes of iron and cyano ligands can be introduced during precipitation at the locations and in the concentration levels taught by any one of Shiba et al U.S. Pat. No. 3,790,390; Ohkubo et al U.S. Pat. No. 3,890,154; Iwaosa et al U.S. Pat. No. 3,901,711 and Habu et al U.S. Pat. No. 4,173,483, the disclosures of which are here incorporated by reference. The inclusion of iron hexacyanide is demonstrated in the Examples below to reduce high intensity reciprocity failure.

Coordination complexes of heavy transition metals and cyano ligands are also contemplated. For example, complexes of rhenium, ruthenium or osmium with at least four cyano ligands are specifically contemplated. In one specifically contemplated form of the invention the grains are formed in the presence of a hexacoordination complex satisfying the formula:

$$[M(CN)_{6-y}L_y]^m \quad \text{(I)}$$

where
M is rhenium, ruthenium or osmium,
L is a bridging ligand,
y is zero, 1 or 2, and
m is −2, −3 or −4.

A bridging ligand is any single or multiple atom ion capable of occupying a halide ion lattice position in the silver halide crystal structure of the grain. The bridging ligand can be any of the ligands noted above, and is preferably a halo ligand. Since the coordination complexes normally exhibit a net negative charge, the coordination complexes are introduced into the emulsion during precipitation as a compound containing a convenient charge balancing cationic moiety, typically chosen from among alkali metal, alkaline earth metal and ammonium cationic moieties. There is no evidence that the charge balancing counterion enters the grain structure. Hence the charge balancing counterion can be removed during washing and need not form a part of the finished emulsion. Specific examples of coordination complexes satisfying formula I are provided by Keevert et al U.S. Pat. No. 4,945,035, the disclosure of which is here incorporated by reference.

It has been demonstrated that incorporation of a coordination complex satisfying formula I reduces high intensity reciprocity failure. It is preferred that the coordination complex of formula I be incorporated in the emulsion in a concentration ranging from $1\times10^{-6}$ to $5\times10^{-4}$ mole per silver mole. Photographic exposure is the product indicated by the equation:

$$E=Iti \quad \text{(II)}$$

where
E is exposure,
I is exposure intensity, and
ti is exposure time.

Reciprocity failure is the term applied to failures of equal exposures to produce the same photographic response when they are constituted by different exposure intensities and times. As employed herein, the term "high intensity reciprocity failure" refers to the speed difference observed in comparing equal exposures for $10^{-5}$ second and $10^{-1}$ second.

In another preferred form of the invention coordination complexes of transition metals and nitrosyl (NO) or thionitrosyl (NS) ligands are contemplated for incorporation in the grains. In one specifically contemplated form of the invention the grains are formed in the presence of a hexacoordination complex satisfying the formula:

$$[M'L_4(NY)L']^n \quad \text{(III)}$$

where
M' is a transition metal,
L is a bridging ligand,
L' is L or (NY),
Y is oxygen or sulfur, and
n is zero, −1, −2 or −3.

The transition metal, the bridging ligands, and any charge balancing counterion can take any of the forms described above. In a specifically preferred form M' represents chromium, rhenium, ruthenium, osmium or iridium and L and L' each represent halo or cyano ligands or together represent a combination of these ligands with up to two aquo ligands.

Coordination complexes containing one or more nitrosyl or thionitrosyl ligands are capable of reducing photographic speed. The coordination complex can also be used to increase contrast. The transition metal coordination complex is incorporated in concentrations of less than $1\times10^{-4}$ mole per silver mole. A preferred level of coordination complex incorporation is from $2\times10^{-8}$ to $3\times10^{-5}$ mole per silver mole.

In a third preferred form of the invention coordination complexes of transition metals and carbonyl (CO) ligands are contemplated for incorporation in the grains. In one specifically contemplated form of the invention the grains are formed in the presence of a hexacoordination complex satisfying the formula:

$$[M''(CO)_pL_{6-p}]^q \quad (IV)$$

where

M'' is a group 8 or 9 transition metal,

L is a bridging ligand, p is 1, 2 or 3, and q is −1, −2 or −3.

The bridging ligands and any charge balancing counterion can take any of the forms described above. In a specifically preferred form the bridging ligands L are halo ligands. Group 8 transition metals are iron, ruthenium and osmium while group 9 transition metals are cobalt, rhodium and iridium. Specific examples of coordination complexes satisfying formula IV are contained in McDugle et al U.S. Pat. No. 5,037,732, the disclosure of which is here incorporated by reference.

Coordination complexes containing one or more carbonyl ligands are capable of modifying photographic performance in concentrations of at least $1\times10^{-9}$ mole per silver mole. In concentrations ranging up to $10^{-6}$ mole per silver mole photographic speed increases and contrast increases are produced. At higher concentrations ranging from greater than $1\times10^{-6}$ to $10^{-4}$ mole per silver mole reductions in photographic speed and contrast are produced.

In a fourth preferred form of the invention coordination complexes of transition metals and oxo (O) ligands are contemplated for incorporation in the grains. In one specifically contemplated form of the invention the grains are formed in the presence of a hexacoordination complex satisfying the formula:

$$[M^4(O)_2L_4]^r \quad (V)$$

where $M^4$ is a group 6, 7 or 8 transition metal,

L is a bridging ligand, and r is −2 or −3.

The bridging ligands and any charge balancing counterion can take any of the forms described above. In a specifically preferred form the bridging ligands L are halo ligands. Specifically preferred transition metals are rhenium and osmium. Specific examples of coordination complexes satisfying formula V are contained in McDugle et al U.S. Pat. No. 4,981,781, the disclosure of which is here incorporated by reference.

Coordination complexes satisfying formula V are capable of internally trapping photogenerated electrons. The dopants therefore increase the internal photographic speed of the grains. Contemplated concentrations of the coordination complexes range from $1\times10^{-6}$ to $1\times10^{-4}$ mole per silver mole, preferably from $1\times10^{-5}$ to $5\times10^{-5}$ mole per silver mole.

In another preferred form of the invention the {100} tabular grains accounting for at least 50 percent of total grain projected area and preferably all of the gains that are formed in the same precipitation contain on average at least one pair of metal ions chosen from the platinum and palladium triads at adjacent cation sites in their crystal lattice. Subsequent references to platinum or palladium triad metal ions are more succinctly stated as PtT/PdT metal ions.

It has been observed that, when adjacent cation positions of the face centered cubic crystal structure of the grains are occupied by PtT/PdT metal ions, they exhibit a disproportionately large effect on photographic performance as compared to that demonstrated by photographic emulsions in which the same PtT/PdT metal ions have been similarly introduced, but without any mechanism to achieve adjacent cation lattice placement. While a single pair, on average, of adjacent PtT/PdT metal ions incorporated in the crystal lattice of the radiation sensitive grains of an emulsion is effective to enhance photographic performance, it is preferred to incorporate at least five pairs, on average, of adjacent PtT/PdT metal ions in the radiation sensitive grains, preferably at least ten pairs, on average. Average pair incorporations can be determined merely by dividing half the number of metal ions incorporated by the number of radiation sensitive silver halide grains present in the emulsion. The latter can be determined from a knowledge of mean grain size, grain shape, and the halide and silver content of the emulsion. The actual distribution of PtT/PdT metal ions within the grains can be expected to follow a Poisson error function distribution with the mean metal ion incorporation corresponding to the distribution mode.

The minimum PtT/PdT metal ion incorporations per grain in adjacent pair locations offering performance advantages are far below the minimum concentration levels of PtT/PdT metal ions taught to be effective by the art. For example, Smith and Trivelli U.S. Pat. No. 2,448,060 discloses a minimum concentration of PtT/PdT metal coordination complex of 0.8 mg/100 grams of silver. When 100 PtT/PdT metal ions per grain are present in the emulsions of this invention, the coordination complex concentration in mg/100 grams of silver is still less than a 1/3 the minimum level taught to be effective by Smith and Trivelli. When emulsions with adjacent pairs of PtT/PdT metal ions are compared with conventional emulsions with random crystal lattice placements of PtT/PdT metal ions at concentrations ranging from minimums of 2, 10, or 20 PtT/PdT metal ions per grain up to 100 PtT/PdT metal ions per grain and higher, superior photographic enhancement by the emulsions satisfying the requirements of the invention are realized.

Once a sufficient number of adjacent pairs of PtT/PdT metal ions are incorporated into the grains to achieve maximum photographic efficiency, no useful purpose is realized by further increasing the presence of PtT/PdT metal ions. The present invention does not, however, prevent the inclusion of PtT/PdT metal ions, incorporated entirely or only partially as adjacent lattice position pairs, up to the maximum useful concentration levels taught in the art for PtT/PdT metal ion incorporation.

When palladium triad (PdT) metal ions from are incorporated at the concentration limit of Smith and Trivelli, less than approximately 40 mg/100 grams of silver, only elementary calculations are required to observe that there are only about 4 atoms of the PdT metal per 10,000 atoms of silver. When a platinum triad (PtT) metal is chosen, this number is reduced by half to about 2 atoms per 10,000 atoms of silver. Smith and Trivelli set out as a preferred maximum less than approximately 20 mg/100 grams of silver, which amounts to only about 2 atoms of PdT metal or 1 atom of PtT metal per 10,000 atoms of silver. At the minimum level of 0.8 mg/100 grams of silver, only about 8 atoms of PdT metal or about 4 atoms of PtT metal per million silver atoms is present in the emulsions of Smith and Trivelli. Thus, adjacent cation lattice position placement of PtT/PdT metal ions can rarely, if ever, be achieved by employing hexacoordination complexes each containing a single PtT/PdT metal ion as taught by Smith and Trivelli.

It has been discovered that adjacent cation site placement of PtT/PdT metal ions in the face centered cubic lattice structure of silver halide grains can be achieved by introducing into the emulsion an oligomeric hexacoordination complex containing at least two group PtT/PdT metal atoms. Although polymeric and oligomeric hexacoordination complexes are known having a higher number of PtT/PdT metal ions, those oligomers are preferred which contain up to about 20 PtT/PdT metal atoms. Specifically preferred are oligomers that contain about 6 to 10 PtT/PdT metal atoms.

The oligomeric coordination complexes contain two or more PtT/PdT metal atoms linked by bridging ligands. For comparison, consider the following compound:

$$R_2MX_6 \quad \text{(VI)}$$

where

R represents hydrogen, alkali metal, or ammonium,

M represents a group VIII, period 5 or 6, metal (i.e., ruthenium, rhodium, palladium, osmium, iridium or platinum), and X represents a halogen atom.

When the compound of formula (VI) above is dissolved, it dissociates into an anionic hexacoordination complex satisfying the following formula:

$$MX_6 \quad \text{(VII)}$$

wherein

M is a PtT/PdT atom and

X is a halide ligand.

The six halide ligands are positioned around the PtT/PdT metal atom in the same way that the halide ions are positioned around a single silver ion in the face centered crystal lattice structure of a silver halide grain. Imagining mutually perpendicular x, y and z axes intersecting at the PtT/PdT metal atom, two ligands lie along each of these three axes equally spaced from the PtT/PdT metal atom. A corresponding anionic hexacoordination complex containing two PtT/PdT metal atoms is represented by the following formula:

$$M_2L_{10} \quad \text{(VIII)}$$

wherein

M is as previously defined and

L is a halide or other bridging ligand. The difference between this anionic dimer and two anions satisfying formula VII is that in the dimer the metal atoms share two bridging ligands, reducing the number of ligands required from 12 to 10. For oligomeric complexes containing up to five metal atoms the following general formula can be written to describe the anions:

$$M_mL_{6+4(m-1)} \quad \text{(IX)}$$

where M and L are as previously defined and m is from 2 to 5. When the number of PtT/PdT metal atoms reaches six, a ring structure becomes possible made up of six PtT/PdT metal atoms and pairs of shared bridging ligands linking adjacent metal atoms. Although rings having higher numbers of PtT/PdT atoms are possible, most higher molecular weight oligomers consist of rings containing six PtT/PdT atoms, usually with a pair of metal atoms in one ring shared with a pair of metal atoms in an adjacent ring. The following are exemplary of oligomeric anions satisfying the requirements of the invention containing 6, 8 or 10 PtT/PdT metal atoms:

$$M_6L_{24} \quad \text{(X)}$$

$$M_{10}L_{38} \quad \text{(XI)}$$

$$M_{10}L_{38} \quad \text{(XII)}$$

wherein M and L are as previously defined. Other oligomeric forms containing 6, 8 or 10 PtT/PdT metal atoms are, of course, possible.

The net negative charge of the anions above is not indicated, since this depends upon the choice of the PtT/PdT metal and the ligand, the more electronegative ligands tending to shift the PtT/PdT metal to a higher oxidation state and the differing PtT/PdT metals exhibiting differing oxidative state preferences. For anions containing iridium and halide ligands, the net negative charge of the anion in formula VII is −2, in formula VIII −4, in formula X −6, and in formulae XI and XII −8. With anionic hexacoordination complexes having negative charges ranging from −2 to −8 all having been demonstrated to be effective, it is apparent that the magnitude of net negative charge has little, if any, influence on the desired lattice placements.

The important point to observe is that all of the molecular weight and sterically varied oligomers contemplated for use in the practice of this invention exhibit a pattern of alternating PtT/PdT atoms and ligands similar to that found in the face centered cubic crystal lattice structure of a radiation sensitive silver halide grain. Thus, the oligomers are capable of presenting the PtT/PdT atoms of the oligomers to the surface of the crystal lattice structure as it is being formed so that adjacent PtT/PdT atoms are oriented to occupy adjacent cation sites of the crystal lattice structure. It is also possible to achieve adjacent incorporations of PtT/PdT metal atoms employing oligomeric tetracoordination complexes in place of hexacoordination complexes.

The bridging ligands are capable of forming covalent bonds with two adjacent PtT/PdT metal atoms. In their simplest form the ligands can be halides, such as fluoride, chloride, bromide, or iodide atoms. For size compatibility with the face centered cubic crystal lattice structure of silver halide grains the ligands are preferably chloride or bromide ligands. Other bridging ligand choices in addition to halide ions are possible. For example, to a limited extent any of the bridging ligands (L) previously described can be substituted for the halo ligands. In choosing ligands other than halide and aquo ligands it must be borne in mind that the ligands can themselves affect photographic performance. When the ligands are the same halide as that of the grain structure, modifying effects are entirely attributable to the PtT/PdT metal ions incorporated. Similarly, aquo ligands have not been reported to produce modifying effects.

The anionic hexacoordination complexes paired with one or more charge satisfying cations, such as any of those indicated above satisfying R in formula VI, can be introduced as a particulate solid or in solution at any stage of emulsion preparation employing any convenient conventional technique for hexacoordination complex addition—e.g., as taught by Smith and Trivelli, cited above and here incorporated by reference. To insure incorporation of the PtT/PdT metal in the crystal structure it is preferred to have the hexacoordination complex present during grain formation. Having the complex present before or during silver halide precipitation is contemplated. Also the PtT/PdT metal can be effectively incorporated by having the complex present while surface ripening of the grains is occurring—i.e., having the complex and one or more ripening agents concurrently present in the emulsion. The concentrations of the PtT/PdT metals introduced into the grains are too low to exert any significant influence on the shape or distribution of the grains produced.

Among metals that are taught by the art to be incorporated as grain dopants as bare ions rather than as part of a coordination complex are metals such as copper, thallium, lead, mercury, bismuth, zinc, cadmium, rhenium, iron, ruthenium, rhodium, palladium, osmium, iridium, and platinum. Illustrations of metal ions being incorporated as dopants without explicit mention of also including the metal counter ion as a dopant are provided by the following: Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; the disclosures of which are here incorporated by reference. For background as to alternatives known to the art attention is also directed to B. H. Carroll, "Iridium Sensitization: A Literature Review", *Photographic Science and Engineering*, Vol. 24, NO. 6, Nov./Dec. 1980, pp. 265-257, and Grzeskowiak et al published European Patent Application 0 264 288.

The invention is particularly advantageous in providing high chloride (greater than 50 mole percent chloride) tabular grain emulsions, since conventional high chloride tabular grain emulsions having tabular grains bounded by {111} are inherently unstable and require the presence of a morphological stabilizer to prevent the grains from regressing to nontabular forms. Particularly preferred high chloride emulsions are according to the invention that are those that contain more than 70 mole percent (optimally more than 90 mole percent) chloride.

Although not essential to the practice of the invention, a further procedure that can be employed to maximize the population of tabular grains having {100} major faces is to incorporate an agent capable of restraining the emergence of non-{100} grain crystal faces in the emulsion during its preparation. The restraining agent, when employed, can be active during grain nucleation, during grain growth or throughout precipitation.

Useful restraining agents under the contemplated conditions of precipitation are organic compounds containing a nitrogen atom with a resonance stabilized $\pi$ electron pair. Resonance stabilization prevents protonation of the nitrogen atom under the relatively acid conditions of precipitation.

Aromatic resonance can be relied upon for stabilization of the $\pi$ electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula:

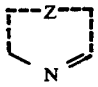

(XIII)

where

Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

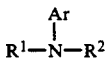

(XIV)

where

Ar is an aromatic ring structure containing from 5 to 14 carbon atoms and $R^1$ and $R^2$ are independently hydrogen, Ar, or any convenient aliphatic group or together complete a five or six membered ring.

Ar is preferably a carbocyclic aromatic ring, such as phenyl or naphthyl. Alternatively any of the nitrogen and carbon containing aromatic rings noted above can be attached to the nitrogen atom of formula XIV through a ring carbon atom. In this instance, the resulting compound satisfies both formulae XIII and XIV. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocyclic rings, such as those containing oyxgen and/or nitrogen hetero atoms. Cyclopentyl, cyclohexyl, pyrrolidinyl, piperidinyl, furanyl and similar heterocyclic rings are specifically contemplated.

The following are representative of compounds contemplated satisfying formulae XIII and/or XIV:

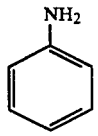

R-1 aniline

-continued
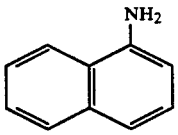
α-naphthylamine
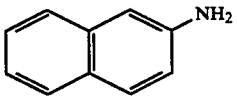
β-naphthylamine
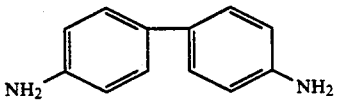
benzidine
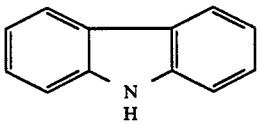
carbazole
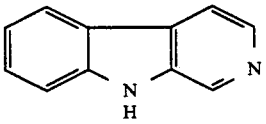
norharman
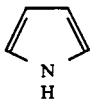
pyrrole
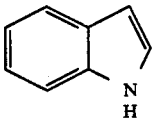
indole
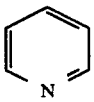
pyridine
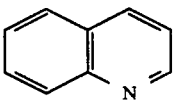
quinoline
-continued
RA-2
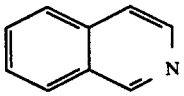
isoquinoline
RA-3
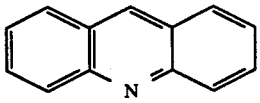
acridine
RA-4
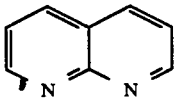
1, 8-naphthyridine
RA-5
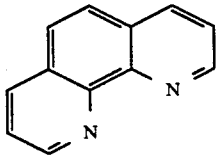
1, 10-phenanthroline
RA-6
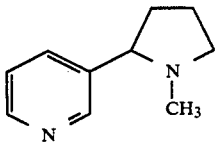
nicotine
RA-7
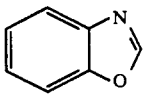
benzoxazole
RA-8
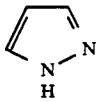
pyrazole
RA-9
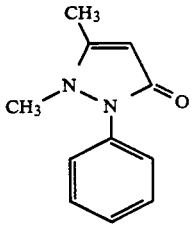
antipyrine
RA-10
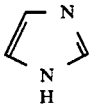
imidazole
RA-11
RA-12
RA-13
RA-14
RA-15
RA-16
RA-17
RA-18
RA-19

-continued

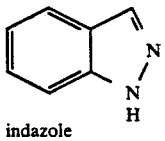

indazole

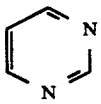

pyrimidine

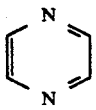

pyrazine

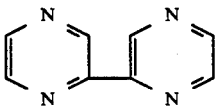

2, 2'-bipyrazine

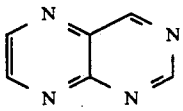

pteridine

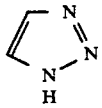

1,2,3-triazole

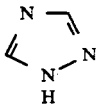

1,2,4-triazole

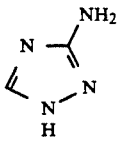

3-amino-1,2,4-triazole

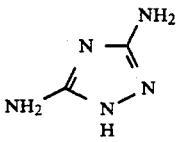

3,5-diamino-1,2,4-triazole

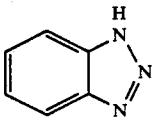

-continued

RA-20

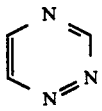

1,2,4-triazine

RA-21

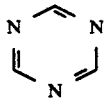

1,3,5-triazine

RA-22

Selection of preferred restraining agents and their useful concentrations can be accomplished by the following selection procedure: The compound being considered for use as a restraining agent is added to a silver chloride emulsion consisting essentially of cubic grains with a mean grain edge length of 0.3 μm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners. In some instances instead of dissolved silver chloride depositing exclusively onto the edges of the cubic grains a new population of grains bounded by {100} crystal faces is formed. Optimum restraining agent activity occurs when the new grain population is a tabular grain population in which the tabular grains are bounded by {100} major crystal faces.

It is specifically contemplated to deposit epitaxially silver salt onto the tabular grains acting as hosts. Conventional epitaxial depositions onto high chloride silver halide grains are illustrated by Maskasky U.S. Pat. No. 4,435,501 (particularly Example 24B); Ogawa et al U.S. Pat. Nos. 4,786,588 and 4,791,053; Hasebe et al U.S. Pat. Nos. 4,820,624 and 4,865,962; Sugimoto and Miyake, "Mechanism of Halide Conversion Process of Colloidal AgCl Microcrystals by Br−Ions", Parts I and II, *Journal of Colloid and Interface Science,* Vol. 140, No. 2, Dec. 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan). The disclosures of the above U.S. patents are here incorporated by reference.

The emulsions of the invention can be chemically sensitized with active gelatin as illustrated by T. H. James, *The Theory of the Photographic Process,* 4th Ed., Macmillan, 1977, pp. 67–76, or with sulfur, selenium, tellurium, gold, platinum, palladium, iridium, osmium, rhenium or phosphorus sensitizers or combinations of these sensitizers, such as at pAg levels of from 5 to 10, pH levels of from 5 to 8 and temperatures of from 30 to 80° C., as illustrated by *Research Disclosure, Vol.* 120, April, 1974, Item 12008, *Research Disclosure,* Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 297,804; and thiosulfonates as described by Nishikawa et al European Patent Application EP 293,917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amneboranes as illustrated by Allén et al U.S. Pat. No. 2,983,609, Oftedahl et al *Research Disclosure,* Vol. 136, August, 1975, Item 13654, Lowe et al U.S. Pat. Nos. 2,518,698 and 2,739,060, Roberts et al U.S. Pat. Nos. 2,743,182 and 183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure,* Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al European Patent Application EP 273,404. In many instances epitaxial deposition onto selected tabular grain sites (e.g., edges or corners) can either be used to direct chemical sensitization or to itself perform the functions normally performed by chemical sensitization.

The emulsions of the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chromantricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering,* Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions of the invention are those found in U.K.

Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions,* American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure,* Vol. 81, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 87,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Publication 24185/71. The dyes can be selectively adsorbed to particular crystallographic faces of the emulsion grain as a means of restricting chemical sensitization centers to other faces, as described by Mifune et al published European Patent Application EP 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1
Anhydro-5'-chloro-3'-di-(3-sulfopropyl)naphtho[1,2-d]thiazolothiacyanine hydroxide, sodium salt SS-2
Anhydro-5'-chloro-3'-di-(3-sulfopropyl)naphtho[1,2-d]oxazolothiacyanine hydroxide, sodium salt SS-3
Anhydro-4,5-benzo-3'-methyl-4'-phenyl-1-(3-sulfopropyl)naphtho[1,2-d]thiazolothiazolocyanine hydroxide SS-4
1,1'-Diethylnaphtho[1,2-d]thiazolo-2'-cyanine bromide SS-5
Anhydro-1,1 -dimethyl-5,5'-di-(trifluoromethyl)-3-(4-sulfobutyl)-3'-(2,2,2-trifluoroethyl)benzimidazolocarbocyanine hydroxide SS-6
Anhydro-3,3'-(2-methoxyethyl)-5,5'-diphenyl-9-ethyloxacarbocyanine, sodium salt SS-7
Anhydro-11-ethyl-1,1'-di-(3-sulfopropyl)naphtho[1,2-d]oxazolocarbocyanine hydroxide, sodium salt SS-8
Anhydro-5,5'-dichloro-9-ethyl-3,3'-di-(3-sulfopropyl-)oxaselenacarbocyanine hydroxide, sodium salt SS-9
5,6-Dichloro-3',3'-dimethyl-1,1',3-triethylbenzimidazlo-3H-indolocarbocyanine bromide SS-10
Anhydro-5,6-dichloro-1,1-diethyl-3-(3-sulfopropylbenzimidazolooxacarbocyanine hydroxide SS-11
Anhydro-5,5 -dichloro-9-ethyl-3,3'-di-(2-sulfoethylcarbamoylmethyl)thiacarbocyanine hydroxide, sodium salt SS-12
Anhydro-5',6'-dimethoxy-9-ethyl-5-phenyl-3-(3-sulfobutyl)-3'-(3-sulfopropyl)oxathiacarbocyanine hydroxide, sodium salt SS-13
Anhydro-5,5'-dichloro-9-ethyl-3-(3-phosphonopropyl)-3'-(3-sulfopropyl)thiacarbocyanine hydroxide SS-14
Anhydro-3,3'-di-(2-carboxyethyl)-5,5'-dichloro-9-ethylthiacarbocyanine bromide SS-15
Anhydro-5,5'-dichloro-3-(2-carboxyethyl)-3'-(3-sulfopropyl)thiacyanine sodium salt SS-16
9-(5-Barbituric acid)-3,5-dimethyl-3'-ethyltellurathiacarbocyanine bromide SS-17
Anhydro-5,6-methylenedioxy-9-ethyl-3-methyl-3'-(3-sulfopropyl)tellurathiacarbocyanine hydroxide SS-18
3-Ethyl-6,6'-dimethyl-3'-pentyl-9.11-neopentylenethiadicarbocyanine bromide SS-19
Anhydro-3-ethyl-9,11-neopentylene-3'-(3-sulfopropyl)-thiadicarbocyanine hydroxide SS-20
Anhydro-3-ethyl-11,13-neopentylene-3 -(3-sulfopropyl-)oxathiatricarbocyanine hydroxide, sodium salt SS-21
Anhydro-5-chloro-9-ethyl-5 -phenyl-3'-(3-sulfobutyl)-3-(3-sulfopropyl)oxacarbocyanine hydroxide, sodium salt SS-22
Anydro-5,5'-diphenyl-3,3'-di-(3-sulfobutyl)-9-ethyloxacarbocyanine, sodium salt

SS-23

Anhydro-5,5'-dichloro-3,3'-di-(3-sulfopropyl)-9-ethylthiacarbocyanine hydroxide, triethylammonium salt
SS-24

Anhydro-5,5'-dimethyl-3,3'-di-(3-sulfopropyl)-9-ethylthiacarbocyanine hydroxide, sodium salt
SS-25

Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt
SS-26

Anhydro-11-ethyl-1,1'-di-(3-sulfopropyl)naphth[1,2-d]oxazolocarbocyanine hydroxide, sodium salt
SS-27

Anhydro-3,9-diethyl-3'-methylsulfonylcarbamoylmethyl-5-phenyloxathiacarbocyanine p-toluenesulfonate
SS-28

Anhydro-6,6'-dichloro-1,1'-diethyl-3,3'-di-(3-sulfopropyl)-5,5'-bis(trifluoromethyl)benzimidazolocarbocyanine hydroxide, sodium salt
SS-29

Anhydro-5'-chloro-5-phenyl-3,3'-di-(3-sulfopropyl)oxathiacyanine hydroxide, sodium salt
SS-30

Anhydro-5,5 -dichloro-3,3'-di-(3-sulfopropyl)thiacyanine hydroxide, sodium salt
SS-31

3-Ethyl-5-[1,4-dihydro-1-(4-sulfobutyl)pyridin-4-ylidene]rhodanine, triethylammonium salt
SS-32

1-Carboxyethyl-5-[2-(3-ethylbenzoxazolin-2-ylidene)ethylidene]-3-phenylthiohydantoin
SS-33

4-[2-((1,4-Dihydro-1-dodecylpyridin-ylidene)ethylidene]-3-phenyl-2-isoxazolin-5-one
SS-34

5-(3-Ethylbenzoxazolin-2-ylidene)-3-phenylrhodanine
SS-35

1,3-Diethyl-5-{[1-ethyl-3-(3-sulfopropyl)benzimidazolin-2-ylidene]ethylidene}-2-thiobarbituric acid
SS-36

5-[2-(3-Ethylbenzoxazolin-2-ylidene)ethylidene]-1-methyl-2-dimethylamino-4-oxo-3-phenylimidazolinium p-toluenesulfonate
SS-37

5-[2-(5-Carboxy-3-methylbenzoxazolin-2-ylidene)ethylidene]-3-cyano-4-phenyl-1-(4-methylsulfonamido-3-pyrrolin-5-one
SS-38

2-[4-(Hexylsulfonamido)benzoylcyanomethine]-2-(2-(3-(2-methoxyethyl)-5-[(2-methoxyethyl)sulfonamido]-benzoxazolin-2-ylidene)ethylidene]acetonitrile
SS-39

3-Methyl-4-[2-(3-ethyl-5,6-dimethylbenzotellurazolin-2-ylidene)ethylidene]-1-phenyl-2-pyrazolin-5-one
SS-40

3-Heptyl-1-phenyl-5-{4-[3-(3-sulfobutyl)-naphtho[1,2-thiazolin]-2-butenylidene}-2-thiohydantoin
SS-41

1,4-Phenylene-bis(2-aminovinyl-3-methyl-2-thiazolinium]dichloride
SS-42

Anhydro-4-{2-[3-(3-sulfopropyl)thiazolin-2-ylidene]ethylidene}-2-{3-[3-(3-sulfopropyl)thiazolin-2-ylidene]propenyl-5-oxazolium, hydroxide, sodium salt
SS-43

3-Carboxymethyl-5-{3-carboxymethyl-4-oxo-5-methyl1,3,4-thiadiazolin-2-ylidene)ethylidene]thiazolin-2-ylidene}rhodanine, dipotassium salt
SS-44

1,3-Diethyl-5-[1-methyl-2-(3,5-dimethylbenzotellurazolin-2-ylidene)ethylidene]-2-thiobarbituric acid
SS-45

3-Methyl-4-[2-(3-ethyl-5,6-dimethylbenzotellurazolin-2-ylidene)-1-methylethylidene]-1-phenyl-2-pyrazolin-5-one
SS-46

1,3-Diethyl-5-[1-ethyl-2-(3-ethyl-5,6-dimethoxybenzotellurazolin-2-ylidene)ethylidene]-2-thiobarbituric acid
SS-47

3-Ethyl-5-{[(ethylbenzothiazolin-2-ylidene)-methyl](1,5-dimethylnaphtho[1,2-d]selenazolin-2-ylidene)methyl]methylene}rhodanine
SS-48

5-{Bis[(3-ethyl-5,6-dimethylbenzothiazolin-2-ylidene)-methyl]methylene}-1,3-diethyl-barbituric acid
SS-49

3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine
SS-50

Anhydro-5,5'-diphenyl-3,3'-di-(3-sulfopropyl)thiacyanine hydroxide, triethylammonium salt
SS-51

Anhydro-5-chloro-5'-phenyl-3,3'-di-(3-sulfopropyl)-thiacyanine hydroxide, triethylammonium salt Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions of this invention can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et at U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenese, particularly tetraazaindenes, as illustrated by Heimbach U.S. Pat. No. 2,444,605, Knott U.S. Pat. No. 2,933,388, Williams U.S.

Pat. 3,202,512, *Research Disclosure,* Vol. 134, June, 1975, Item 13452, and Vol. 148, August, 1976, Item 14851, and Nepker et al U.K. Patent 1,3338,567; mercaptotetrazoles, -triazoles and -diazoles as illustrated by Kendall et al U.S. Pat. No. 2,403,927, Kennard et al U.S. Pat. No. 3,266,897, *Research Disclosure,* Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure,* Item 1684, cited above; purines as illustrated by Sheppard et al U.S. Pat. No. 2,319,090, Birr et al U.S. Pat. No. 2,152,460, *Research Disclosure,* Item 13452, cited above, and Dostes et al French Patent 2,296,204, polymers of 1,3-dihydroxy(and/or 1,3-carbamoxy)-2-methylenepropane as illustrated by Saleck et al U.S. Pat. No. 3,926,635 and tellurazoles, tellurazolines, tlllurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides as illustrated by Maffet U.S. Pat. No. 2,953,455; phenols as illustrated by Smith U.S. Pat. Nos. 2,955,037 and '038; ethylene diurea as illustrated by Dersch U.S. Pat. No. 3,582,346; barbituric acid derivatives as illustrated by Wood U.S. Pat. No. 3,617,290; boranes as illustrated by Bigelow U.S. Pat. No. 3,725,078; 3-pyrazolidinones as illustrated by Wood U.K. Patent 1,158,059 and aldoximines, amides, anilides and esters as illustrated by Butler et al U.K. Patent 988,052.

The emulsions can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines as illustrated by Carroll et al U.K. Patent 623,448 and meta- and polyphosphates as illustrated by Draisbach U.S. Pat. No. 2,239,284, and carboxylic acids such as ethylenediamine tetraacetic acid as illustrated by U.K. Patent 691,715.

Among stabilizers useful in layers containing synthetic polymers of the type employed as vehicles and to improve covering power are monohydric and polyhydric phenols as illustrated by Forsgard U.S. Pat. No. 3,043,697; saccharides as illustrated by U.K. Patent 897,497 and Stevens et al U.K. Patent 1,039,471, and quinoline derivatives as illustrated by Dersch et al U.S. Pat. No. 3,446,618.

Among stabilizers useful in protecting the emulsion layers against dichroic fog are addenda such as salts of nitron as illustrated by Barbier et al U.S. Pat. Nos. 3,679,424 and 3,820,998; mercaptocarboxylic acids as illustrated by Willems et al U.S. Pat. No. 3,600,178; and addenda listed by E. J. Birr, *Stabilization of Photographic Silver Halide Emulsions,* Focal Press, London, 1974, pp. 126–218.

Among stabilizers useful in protecting emulsion layers against development fog are addenda such as azabenzimidazoles as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives as illustrated by Herz et al U.S. Pat. No. 3,220,839, and thiodiazole derivatives as illustrated by von Konig U.S. Pat. No. 3,364,028 and von Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421; nitro-substituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et al U.S. Pat. Nos. 3,232,761 and 3,232,764, or further in combination with maleic acid hydrazide as illustrated by Rees et al U.S. Pat. No. 3,295,980.

To protect emulsion layers coated on linear polyester supports, addenda can be employed such as parabanic acid, hydantoin acid hydrazides and urazoles as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate as illustrated by Overman U.S. Pat. No. 2,628,167; compounds, polymeric latices and dispersions of the type disclosed by Jones et al U.S. Pat. Nos. 2,759,821 and '822; azole and mercaptotetrazole hydrophilic colloid dispersions of the type disclosed by *Research Disclosure,* Vol. 116, December, 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure,* Vol. 99, July, 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents as illustrated by Seiter et al U.S. Pat. No. 3,424,583; cycloalkyl-1,3-diones as illustrated by Beckett et al U.S. Pat. No. 3,447,926; enzymes of the catalase type as illustrated by Matejec et al U.S. Pat. No. 3,600,182; halogen-substituted hardeners in combination with certain cyanine dyes as illustrated by Kumai et al U.S. Pat. No. 3,881,933; hydrazides as illustrated by Honig et al U.S. Pat. No. 3,386,831; alkenyl benzothiazolium salts as illustrated by Arai et al U.S. Pat. No. 3,954,478; hydroxy-substituted benzylidene derivatives as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives as illustrated by Ezekiel U.K. Patent 1,389,089; propynylthio derivatives of benzimidazoles, pyrimidines, etc., as illustrated by von Konig et al U.S. Pat. No. 3,910,791; combinations of iridium and rhodium compounds as disclosed by Yamasue et al U.S. Pat. No. 3,901,713; sydnones or sydnone imines as illustrated by Noda et al U.S. Pat. No. 3,881,939; thiazolidine derivatives as illustrated by Ezekiel U.K. Patent 1,458,197 and thioether-substituted imidazoles as illustrated by *Research Disclosure,* Vol. 136, August, 1975, Item 13651.

Among the various stabilizers identified above, stabilizers from the following groups are generally preferred:

A. A mercapto heterocyclic nitrogen compound containing a mercapto group bonded to a carbon atom which is linked to an adjacent nitrogen atom in a heterocyclic ring system, B. A quaternary aromatic chalcogenazolium salt wherein the chalcogen is sulfur, selenium or tellurium, C. A triazole or tetrazole containing an ionizable hydrogen bonded to a nitrogen atom in a heterocyclic ring system, D. A dichalcogenide compound comprising an —X—X— linkage between carbon atoms wherein each X is divalent sulfur, selenium or tellurium, E. An organic compound containing a thiosulfonyl group having the formula —$SO_2SM$ where M is a proton or cation, F. A mercuric salt, or G. A quinone compound.

The Group A photographic stabilizers employed in the practice of this invention are mercapto heterocyclic nitrogen compounds containing a mercapto group bonded to a carbon atom which is linked to an adjacent nitrogen atom in a heterocyclic ring system. Typical Group A stabilizers are heterocyclic mercaptans such as mercaptotetrazoles, for example a 5-mercaptotetrazole, and more particularly, an aryl 5-mercaptotetrazole such as a phenyl 5-mercaptotetrazole. Suitable Group A stabilizers that can be employed are described in the following documents, the disclosures of the U.S. patents which are hereby incorporated herein by reference: mercaptotetrazoles, -triazoles and -diazoles as illustrated by Kendall, U.S. Pat. No. 2,403,927, Kennard et al. U.S. Pat. No. 3,266,897, *Research Disclosure,* Vol. 116, December 1973, Item 1684, Luckey et al. U.S. Pat. No. No. 3,397,987, Salesin U.S. Pat. No. 3,708,303 and purines as illustrated by Sheppard et al., U.S. Pat. No. 2,319,090.

The heterocyclic ring system of the Group A stabilizers can contain one or more heterocyclic rings wherein the heterocyclic atoms (i.e., atoms other than carbon, including nitrogen, oxygen, sulfur, selenium and tellurium) are members of at least one heterocyclic ring. A heterocyclic ring in a ring system can be fused or condensed to one or more rings that do not contain heterocyclic atoms. Suitable heterocyclic ring systems include the monoazoles (e.g., oxazoles, benzoxazoles, selenazoles, benzothiazoles), diazoles (e.g., imidazoles, benzimidazoles, oxadiazoles and thiadiazoles), triazoles (e.g., 1,2,4-triazoles, especially those containing an amino substituent in addition to the mercapto group), pyrimidines, 1,2,4-triazines, s-triazines, and azaindenes (e.g., tetraazaindenes). It is understood that the term mercapto includes the undissociated thioenol or tautomeric thiocarbonyl forms, as well as the ionized, or salt forms. When the mercapto group is in a salt form, it is associated with a cation of an alkali metal such as sodium or potassium, or ammonium, or a cationic derivative of such amines as triethylamine, triethanolamine, or morpholine.

Any of the mercapto heterocyclic nitrogen compounds, as described herein, will act as stabilizers in the practice of this invention. However, particularly good results are obtained with the mercapto azoles, especially the 5-mercapto tetrazoles. 5-Mercapto tetrazoles which can be employed include those having the structure:

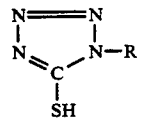

(A-I)

where R is an aliphatic or aromatic radical containing up to 20 carbon atoms. The alkyl or aryl radicals comprising R may be unsubstituted or substituted. Suitable substituents include, for example, alkoxy, phenoxy, halogen, cyano, nitro, amino, substituted amino, sulfo, sulfamyl, substituted sulfamyl, sulfonylphenyl, sulfonylalkyl, fluosulfonyl, sulfonamidophenyl, sulfonamidoalkyl, carboxy, carboxylate, ureido carbamyl, carbamylphenyl, carbamylalkyl, carbonylalkyl, and carbonylphenyl.

Some thiadiazole or oxadiazole Group A stabilizers that can be employed in the practice of this invention can be represented by the following structure:

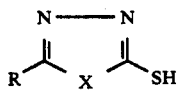

(A-II)

where X is S or O, and R is as defined in Formula (A-I) hereinbefore.

Some benzoxazole Group A stabilizers that can be employed in the practice of this invention can be represented by the following structure:

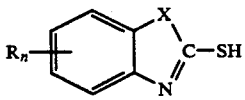

(A-III)

where X is O, S or Se, R is alkyl containing up to four carbon atoms, such as methyl, ethyl, propyl, butyl; alkoxy containing up to four carbon atoms, such as methoxy, ethoxy, butoxy; halogen, such as chloride or bromide, cyano, amido, sulfamido or carboxy, and n is 0 to 4.

Examples of Group A photographic stabilizers useful in the practice of this invention are 1-(3-acetamidophenyl)-5-mercaptotetrazole, 1-phenyl-5-mercaptotetrazole, 1(3-methoxyphenyl)-5-mercaptotetrazole, 1-(3-ureidophenyl)-5-mercaptotetrazole, 1-(3-N-carboxymethyl)ureidophenyl)-5-mercaptotetrazole, 1-(3-N-ethyl oxalamido)phenyl)-5-mercaptotetrazole, 1-(4-ureidophenyl)-5-mercaptotetrazole, 1-(4'-acetamidophenyl)-5-mercaptotetrazole, 1-(4-methoxyphenyl)-5-mercaptotetrazole, 1-(4-carboxyphenyl)-5-mercaptotetrazole, 1-(4-chlorophenyl)-5-mercaptotetrazole, 2-mercapto-5-phenyl-1,3,4-oxadiazole, 2-mercapto-5-(4-acetamidophenyl)-1,3,4-oxadiazole, 2-mercapto-5-phenyl-1,3,4-thiadiazole, 2-mercapto-5-(4-ureidophenyl)-1,3,4-thiadiazole, 2-mercaptobenzoxazole, 2-mercaptobenzothiazole, 2-mercaptobenzoselenazole, 2-mercapto-5-methylbenzoxazole, 2-mercapto-5-methoxybenzoxazole, -mercapto-6-chlorobenzothiazole and 2-mercapto-6-methylbenzothiazole.

The Group B photographic stabilizers are quaternary aromatic chalcogenazolium salts wherein the chalcogen is sulfur, selenium or tellurium. Typical Group B stabilizers are azolium salts such as benzothiazolium salts, benzoselenazolium salts and benzotellurazolium salts. Charge balancing counter ions for such salts include a wide variety of negatively charged ions, as well known in the photographic art, and exemplified by chloride, bromide, iodide, perchlorate, benzenesulfonate, propylsulfonate, toluenesulfonate, tetrafluoroborate, hexafluorophosphate and methyl sulfate. Suitable Group B stabilizers that can be employed are described in the following U.S. patents, the disclosures of which are hereby incorporated herein by reference: quaternary ammonium salts of the type illustrated by Allen et al. U.S. Pat. No. 2,694,716, Brooker et al. U.S. Pat. No. 2,131,038, Graham U.S. Pat. No. 3,342,596, Arai et al. U.S. Pat. No. 3,954,478 and Przyklek-Elling U.S. Pat. No. 4,661,438.

Some Group B stabilizers that may be employed in the practice of this invention can be represented by the following structure:

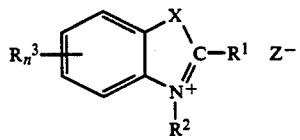

(A-III)

where X is S, Se or Te, $R^1$ is hydrogen where X is S, and is methyl where X is Se or Te, $R^2$ is alkyl or alkenyl containing up to four carbon atoms, such as methyl, ethyl, propyl, propenyl; substituted alkyl containing up to four carbon atoms, such as sulfopropyl or sulfamylmethyl, $R^3$ is alkyl containing up to four carbon atoms, such as methyl, propyl, butyl; alkoxy containing up to four carbon atoms such as ethoxy or propoxy; halogen, cyano, amido, sulfamido or carboxy; n is 0–2, and Z is a counter ion, such as halogen, benzenesulfonate or tetrafluoroborate.

Examples of useful Group B photographic stabilizers include 2-methyl-3-ethylbenzoselenazolium p-toluenesulfonate, 3-[2-(N-methylsulfonyl)carbamoylethyl]-benzothiazolium tetrafluoroborate, 3,3'-decamethylene-bis-(benzothiazolium) bromide, 3-methylbenzothiazolium hydrogen sulfate, 3-allylbenzothiazolium tetrafluoroborate, 5,6-dimethoxy-3-sulfopropylbenzothiazolium salt, 5-chloro-3-methyl-benzothiazolium tetrafluoroborate, 5,6-dichloro-3-ethylbenzothiazolium tetrafluoroborate, 5-methyl-3-allylbenzothiazolium tetrafluoroborate, 2-methyl-3-ethylbenzotellurazolium tetrafluoroborate, 2-methyl-3-allylbenzotellurazolium tetrafluoroborate, 2-methyl-3-allyl-5-chlorobenzoselenazolium tetrafluoroborate, 2-methyl-3-allyl-5-chlorobenzoselenazolium tetrafluoroborate and 2-methyl-3-allyl-5,6-dimethoxybenzoselenazolium p-toluenesulfonate.

The Group C photographic stabilizers are triazoles or tetrazoles which contain an ionizable (or dissociable) hydrogen bonded to a nitrogen atom in a heterocyclic ring system. Such a hydrogen atom is ionizable under normal conditions of preparation, storing or processing of the high chloride {100} tabular grain emulsions of this invention. The triazole or tetrazole ring can be fused to one or more aromatic, including heteroaromatic, rings containing 5 to 7 ring atoms to provide a heterocyclic ring system. Such heterocyclic ring systems include, for example, benzotriazoles, naphthotriazoles, tetraazaindenes and triazolotetrazoles. The triazole or tetrazole rings can contain substituents including lower alkyl such as methyl, ethyl, propyl, aryl containing up to 10 carbon atoms, for example, phenyl or naphthyl. Suitable additional substituents in the heterocyclic ring system include hydroxy, halogen such as chlorine, bromine, iodine; cyano, alkyl such as methyl, ethyl, propyl, trifluoromethyl; aryl such as phenyl, cyanophenyl, naphthyl, pyridyl; aralkyl such as benzyl, phenethyl; alkoxy such as methoxy, ethoxy; aryloxy such as phenoxy; alkylthio such as methylthio, carboxymethylthio; acyl such as formyl, formamidino, acetyl, benzoyl, benzenesulfonyl; carboalkoxy such as carboethoxy, carbomethoxy or carboxy.

Typical Group C stabilizers are tetrazoles, benzotriazoles and tetraazaindenes. Suitable Group C stabilizers that can be employed are described in the following documents, the disclosures of the U.S. patents which are hereby incorporated herein by reference: tetrazoles, as illustrated by P. Glafkides "Photographic Chemistry", Vol. 1, pages 375–376, Fountain Press, London, published 1958, azaindenes, particularly tetraazaindenes, as illustrated by Heimbach et al. U.S. Pat. No. 2,444,605, Knott U.S. Pat. No. 2,933,388, Williams et al. U.S. Pat. No. 3,202,512, *Research Disclosure,* Vol. 134, June 1975, Item 13452 and Vol. 148, August 1976, Item 14851, Nepker et al. U.K. Patent No. 1,338,567, Birr et al. U.S. Pat. No. 2,152,460 and Dostes et al. French Patent No. 2,296,204.

Some useful Group C stabilizers that can be employed in the practice of this invention can be represented by the following structures:

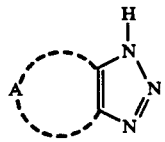
(C-I)

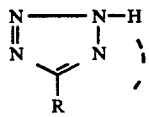
(C-II)

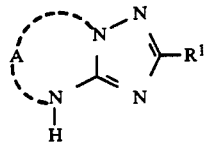
(C-III)

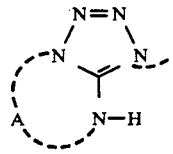
(C-IV)

where R is lower alkyl such as methyl, ethyl, propyl, butyl; or aryl containing up to 10 carbon atoms such as cyanophenyl or naphthyl; $R^1$, in addition to being the same as R, can also be hydrogen; alkoxy containing up to 8 carbon atoms, such as methoxy, ethoxy, butoxy, octyloxy; alkylthio containing up to 8 carbon atoms, such as methylthio, propylthio, pentylthio, octylthio; or aryloxy or arylthio containing up to 10 carbon atoms; and A represents the non-metallic atoms necessary to complete a 5- to 7- membered aromatic ring which can be substituted with, for example, hydroxy, halogen such as chlorine, bromine, iodine; cyano, alkyl such as methyl, ethyl, propyl, trifluoromethyl; aryl such as phenyl, cyanophenyl, naphthyl, pyridyl; aralkyl such as benzyl, phenethyl; alkoxy such as methoxy, ethoxy; aryloxy such as phenoxy; alkylthio such as methylthio, carboxymethylthio; acyl such as formyl, acetyl, benzoyl; alkylsulfonyl or arylsulfonyl, such as methanesulfonyl or benzenesulfonyl; carboalkoxy such as carboethoxy, carbomethoxy; or carboxy.

Typical useful Group C photographic stabilizers include 5-chlorobenzotriazole, 5,6-dichlorobenzotriazole, 5-cynnobenzotriazole, 5-trifluoromethylbenzotriazole, 5,6-diacetylbenzotriazole, 5-(p-cyanophenyl)tetrazole, 5-(p-trifluoromethylphenyl)tetrazole, 5-(1-naphthyl)tetrazole, 5-(2-pyridyl)tetrazole, 4-hydroxy-6-methyl-1,3,3a,7-tetraazaindene sodium salt, 5-bromo-4-hydroxy-6-methyl-1,3,3a,7-tetraazaindene sodium salt, 4-hydroxy-6-methyl-2-methylthio-1,3,3a,7-tetraazaindene sodium salt, 5-bromo-4hydroxy-6-methyl-2-octylthio-1,3,3a,7-tetraazaindene sodium salt.

The Group D photographic stabilizers are dichalcogenide compounds comprising an —X—X— linkage between carbon atoms wherein each X is divalent sulfur, selenium or tellurium. Typical Group D stabilizers are organic disulfides, diselenides and ditellurides where the chalcogen joins aliphatic or aromatic groups or are part of a ring system. Suitable Group D stabilizers that can be employed are described in the following documents, the disclosures of the U.S. patents which are hereby incorporated herein by reference: diselenides as illustrated by Brown et al. U.K. Patent No. 1,336,570, Pollet et al. U.K. Patent No. 1,282,303, aromatic tellurochalcogenides, as illustrated by Gunther et al. U.S. Pat. No. 4,607,000 and Lok et al. U.S. Pat. No. 4,607,001, cyclic oxaspiro ditellurides, as illustrated by Lok et al. U.S. Pat. No. 4,861,703, 5-thiooctic acid, as illustrated by U.S. Pat. No. 2,948,614, and acylamidophenyl disulfides, as illustrated by U.S. Pat. No. 3,397,986. Some useful Group D photographic stabilizers that can be employed in the practice of this invention can be represented by the following structure:

$$R—X—X—R^1 \qquad (D)$$

where X is divalent S, Se or Te, R and $R^1$ can be the same or different alkyl, typically containing one to four carbon atoms such as methyl, ethyl, propyl, butyl; aryl typically containing up to ten carbon atoms such as phenyl or naphthyl, and R and $R^1$ together can form a to 7-membered ring containing only carbon atoms in combination with the S, Se or Te atoms. Such ring can be further substituted with halogen such a chlorine, acetamido, carboxyalkyl such as carboxybutyl and alkoxy, typically containing one to four carbon atoms such as methoxy, propoxy and butoxy. Examples of useful Group D photographic stabilizers are bis-(4-acetamido)phenyl disulfide, bis-(4-glutaramido)phenyl disulfide, bis(4-oxalamido)phenyl disulfide, bis-(4-succinamido)phenyl disulfide, 6-thiooctic acid, 5-thiooctic acid, alpha,alpha-dithiodipropionic acid, beta,beta-dithiodipropionic acid, 2-oxa-6,7-diselenaspiro[3,4]octane, 2-oxa-6,7-ditelluraspiro[3,4]octane, bis-[2-(N-methylacetamido)-4,5-dimethylphenyl]ditelluride, bis-[2-(N-methylacetamido)-4-methoxyphenyl]ditelluride, bis-(2-acetamido-4-methoxyphenyl)diselenide, m-carboxyphenyl diselenide and p-cyanophenyl diselenide.

The Group E photographic stabilizers are organic compounds containing a thiosulfonyl group having the formula $—SO_2SM$ where M is a proton or cation, preferably an alkali metal such as potassium. Typical Group E stabilizers are alkyl and aryl thiosulfonates. Suitable Group E stabilizers that can be employed have the general formula $Z—SO_2S—M$ where Z represents alkyl, aryl or a heterocycle, and M represents hydrogen, a metal cation, e.g., a cation of an alkali metal such as sodium or potassium, organic cations such as ammonium ions and guanidium ions, as illustrated in Nishikawa et al. U.S. Pat. No. 4,960,689, the disclosure of which is hereby incorporated herein by reference.

Some useful Group E stabilizers that can be employed in the practice of this invention can be represented by the following structure:

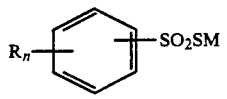
(E)

wherein R is alkyl or aryl, typically containing up to 10 carbon atoms, as exemplified by lower alkyl such as methyl, ethyl, propyl; phenyl, lower alkoxy such as ethoxy, methoxy, propoxy, pentoxy, halogen such as chlorine, nitro, amino; and carboxyl, M is a proton or a cation such as an alkali metal cation, typically sodium or potassium or an organic cation, typically ammonium or guanidinium, and n is 0 to 4.

Typical Group E photographic stabilizers include p-tolylthiosulfonate potassium salt, p-chlorophenylthiosulfonate potassium salt, 1-butylthiosulfonate potassium salt, 1,4-dithiosulfonatobutane dipotassium salt and p-methoxyphenylthiosulfonate potassium salt.

The Group F photographic stabilizers are mercuric salts. Preferred Group F stabilizers are inorganic mercury salts such as mercuric halides, as exemplified by mercuric chloride, which are readily available and conveniently employed. Examples of useful Group F stabilizers that can be employed are mercuric chloride or mercuric iodide, or mercuric salts of thiazoles, as illustrated by Allen et al. U.S. Pat. No. 2,728,663 and Saleck et al. U.S. Pat. No. 3,432,304, the disclosures of which are hereby incorporated herein by reference.

The Group G photographic stabilizers are quinone compounds. Typical examples of such oxidants are benzoquinone and napthoquinone.

Some useful Group G stabilizers that can be employed in the practice of this invention can be represented by the following structure:

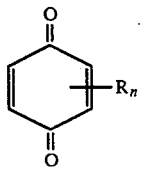

(G)

where R is lower alkyl such as methyl, ethyl, butyl; aryl containing up to 10 carbon atoms, such as phenyl or naphthyl; halogen, such as chlorine, bromine, fluorine; cyano; acyl, such as acetyl or benzoyl; alkylsulfonyl or arylsulfonyl, such as methanesulfonyl or benzenesulfonyl; carboalkoxy; or carboxy; n is 0 to 4; and two R groups can combine to form an aromatic ring containing up to 10 carbon atoms, for example a benzo or naphtho ring which can contain substituents such as those just described.

The photographic stabilizers of Groups A-G can be used in combination within each group, or in combination between different groups. Enolic reducing compounds that can be used in combination with the photographic stabilizers in Group A are described in T. H. James, *The Theory of the Photographic Process,* 4th Edition, MacMillan Publishing Company, Inc., 1977, Chapter 11, Section E, developing agents of the type HO—(CH=CH)$_n$—OH, and on page 311, Section F, developing agents of the type HO—(CH=CH)$_n$—NH$_2$. Representative members of the Section E developing agents hydroquinone or catechol. Representative members of the Section F developing agents are aminophenols and the aminopyrazolones. Suitable reducing agents that can be used in combination with the photographic stabilizers in Group A are also described in European Patent Application Nos. 476 521 A2 and 482 599 A1 and East German Patent Application DD 293 207 A5. Specific examples of useful reducing compounds are piperidinohexose reductone, 4,5-dihydroxybenzene-1,3-disulfonic acid (catecholdisulfonic acid), disodium salt, 4-(hydroxymethyl)-4-methyl-1-phenyl-3-pyrazolidinone, and hydroquinone compounds. Typical hydroquinones or hydroquinone derivatives that can be used in the combination described can be represented by the following structure:

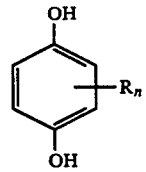

(RA-1)

where R is the same or different and is alkyl such as methyl, ethyl, propyl, butyl, octyl; aryl such as phenyl, and contains up to 20 carbon atoms, typically 6–20 carbon atoms, or is —L—A where L is a divalent linking group such as oxygen, sulfur or amido, and A is a group which enhances adsorption onto silver halide grains such as a thionamido group, a mercapto group, a group containing a disulfide linkage or a 5- or 6-membered nitrogen-containing heterocyclic group and n is 0–2. Beneficial results can also be achieved using the photographic stabilizers of Group E in combination with salts of aryl sulfinates such as tolylsulfinate sodium salt, typically in a weight ratio in range of about 1:10 to 10:1.

The photographic stabilizers used in the practice of this invention are conveniently incorporated into the high chloride {100} tabular grain emulsions or elements comprising such emulsions just prior to coating the emulsion in the elements However, they can be added to the emulsion at the time the emulsion is manufactured, for example, during chemical or spectral sensitization. It is generally most convenient to introduce such stabilizers after chemical ripening of the emulsion and before coating. The stabilizers can be added directly to the emulsion, or they can be added at a location within a photographic element which permits permeation to the emulsion to be protected. For example, the photographic stabilizers can be incorporated into hydrophilic colloid layers such as in an overcoat, interlayer or subbing layer just prior to coating. Any concentration of photographic stabilizer effective to protect the emulsion against changes in development fog and sensitivity can be employed. Optimum concentrations of photographic stabilizer for specific applications are usually determined empirically by varying concentrations in the manner well known to those skilled in the art. Such investigations are typically relied upon to identify effective concentrations for a specific situation. Of course, the effective concentration used will vary widely depending upon such things as the particular emulsion chosen, its intended use, storage conditions and the specific photographic stabilizer selected. Although an effective concentration for stabilizing the high chloride {100} tabular grain emulsions may vary, concentrations of at least about 0.005 millimole per silver mole in the radiation sensitive silver halide emulsion have been found to be effective in specific situations. More typically, the minimum effective amount of photographic stabilizer is at least 0.03 millimole, and frequently at least 0.3 millimole per silver mole. For many of the photographic stabilizers used in this invention, the effective concentration is in the range of about 0.06 to 0.8 and often about 0.2 to 0.5 millimole/mole silver. However, as illustrated by the following Examples, concentrations well outside of these ranges can be used.

Negative-type emulsion coatings which contain photographic stabilizers of Groups A–G can be further protected against instability by incorporation of other stabilizers, antifoggants, antikinking agents, latent-image stabilizers and similar addenda in the emulsion and contiguous layers prior to coating. Most of the antifoggants effective in the emulsions used in this manner can also be used in developers and can be classified under a few general headings, as illustrated by C. E. K. Mees, *The Theory of the Photographic Process,* 2nd Ed., Macmillan, 1954, pp. 677–680.

Apart from the features that have been specifically discussed the tabular grain emulsion preparation procedures, the tabular grains that they produce, and their further use in photography can take any convenient conventional form. Substitution for conventional emulsions of the same or similar silver halide composition is generally contemplated, with substitution for silver halide emulsions of differing halide composition, particularly tabular grain emulsions, being also feasible in many types of photographic applications. The low levels of native blue sensitivity of the high chloride {100} tabular grain emulsions of the invention allows the emulsions to be employed in any desired layer order arrangement in multicolor photographic elements, including any of the layer order arrangements disclosed by Kofron et al U.S. Pat. 4,439,520, the disclosure of which is here incorporated by reference, both for layer order arrangements and for other conventional features of photographic elements containing tabular grain emulsions. Conventional features are further illustrated by the following incorporated by reference disclosures:

ICBR-1: *Research Disclosure,* Vol. 308, December 1989, Item 308,119;

ICBR-2: *Research Disclosure,* Vol. 225, January 1983, Item 22,534;

ICBR-3: Wey et al U.S. Pat. 4,414,306, issued Nov. 8, 1983;

ICBR-4: Solberg et al U.S. Pat. 4,433,048, issued Feb. 21, 1984;

ICBR-5: Wilgus et al U.S. Pat. 4,434,226, issued Feb. 28, 1984;

ICBR-6: Maskasky U.S. Pat. 4,435,501, issued Mar. 6, 1984;

ICBR-7: Maskasky U.S. Pat. 4,643,966, issued Feb. 17, 1987;

ICBR-8: Daubendiek et al U.S. Pat. 4,672,027, issued Jan. 9, 1987;

ICBR-9: Daubendiek et al U.S. Pat. 4,693,964, issued Sep. 15, 1987;

ICBR-10: Maskasky U.S. Pat. 4,713,320, issued Dec. 15, 1987;

ICBR-11: Saitou et al U.S. Pat. 4,797,354, issued Jan. 10, 1989;

ICBR-12: Ikeda et al U.S. Pat. 4,806,461, issued Feb. 21, 1989;

ICBR-13: Makino et al U.S. Pat. 4,853,322, issued Aug. 1, 1989; and

ICBR-14: Daubendiek et al U.S. Pat. 4,914,014, issued Apr. 3, 1990.

In their simplest form photographic elements of the invention employ a single silver halide emulsion layer containing high chloride {100} tabular grain emulsions and a support. It is, of course, recognized that more than one such silver halide emulsion layer can be usefully included. Where more than one emulsion layer is used, e.g., two emulsion layers, all such layers can be high chloride {100} tabular grain emulsion layers. However, the use of one or more conventional silver halide emulsion layers, including other tabular grain emulsion layers, in combination with one or more high chloride {100} tabular grain emulsion layers is specifically contemplated. It is also specifically contemplated to blend the high chloride {100} tabular grain emulsions of the present invention with each other or with conventional emulsions to satisfy specific emulsion layer requirements. Instead of blending emulsions, the same effect can usually be achieved by coating the emulsions to be blended as separate layers in an emulsion unit. For example, coating of separate emulsion layers to achieve exposure latitude is well known in the art. It is further well known in the art that increased photographic speed can be realized when faster and slower silver halide emulsions are coated in separate layers. Typically the faster emulsion layer in an emulsion unit is coated to lie nearer the exposing radiation source than the slower emulsion layer. Coating the faster and slower emulsions in the reverse layer order can change the contrast obtained. This approach can be extended to three or more superimposed emulsion layers in an emulsion unit. Such layer arrangements are specifically contemplated in the practice of this invention.

The high chloride {100} tabular grain emulsions and photographic elements of this invention can contain dye image-forming compounds and photographically useful group-releasing compounds, sometimes referred to herein simply as a "PUG-releasing compound". A dye image-forming compound is typically a coupler compound, a dye redox releaser compound, a dye developer compound, an oxichromic developer compound, or a bleachable dye or dye precursor compound. Dye redox releaser, dye developer, and oxichromic developer compounds useful in color photographic elements that can be employed in image transfer processes are described in *The Theory of the Photographic Process,* 4th edition, T. H. James, editor, Macmillan, New York, 1977, Chapter 12, Section V, and in Section XXIII of *Research Disclosure,* December 1989, Item 308119. Dye compounds useful in color photographic elements employed in dye bleach processes are described in Chapter 12, Section IV, of *The Theory of the Photographic Process,* 4th edition.

Preferred dye image-forming compounds are coupler compounds, which react with oxidized color developing agents to form colored products, or dyes. A coupler compound contains a coupler moiety COUP, which is combined with the oxidized developer species in the coupling reaction to form the dye structure. A coupler compound can additionally contain a group, called a coupling-off group, that is attached to the coupler moiety by a bond that is cleaved upon reaction of the coupler compound with oxidized color developing agent. Coupling-off groups can be halogen, such as chloro, bromo, fluoro, and iodo, or organic radicals that are attached to the coupler moieties by atoms such as oxygen, sulfur, nitrogen, phosphorus, and the like.

A PUG-releasing compound is a compound that contains a photographically useful group and is capable of reacting with an oxidized developing agent to release said group. Such a PUG-releasing compound comprises a carrier moiety and a leaving group, which are linked by a bond that is cleaved upon reaction with oxidized developing agent. The leaving group contains the PUG, which can be present either as a preformed species, or as a blocked or precursor species that undergoes further reaction after cleavage of the leaving group from the carrier to produce the PUG. The reaction of an oxidized developing agent with a PUG-releasing compound can produce either colored or colorless products.

Carrier moieties (CAR) include hydroquinones, catechols, aminophenols, sulfonamidophenols, sulfonamidonaphthols, hydrazides, and the like that undergo cross-oxidation by oxidized developing agents. A preferred carrier moiety in a PUG-releasing compound is a coupler moiety COUP, which can combine with an oxidized color developer in the cleavage reaction to form a colored species, or dye. When the carrier moiety is a COUP, the leaving group is referred to as a coupling-off group. As described previously for leaving groups in general, the coupling-off group contains the PUG, either as a preformed species or as a blocked or precursor species. The coupler moiety can be ballasted or unballasted. It can be monomeric, or it can be part of a dimeric, oligomeric or polymeric coupler, in which case more than one group containing PUG can be contained in the coupler, or it can form part of a bis compound in which the PUG forms part of a link between two coupler moieties.

The PUG can be any group that is typically made available in a photographic element in an imagewise fashion. The PUG can be a photographic reagent or a photographic dye. A photographic reagent, which upon release further reacts with components in the photographic element as described herein, is a moiety such as a development inhibitor, a development accelerator, a bleach inhibitor, a bleach accelerator, an electron transfer agent, a coupler (for example, a competing coupler, a dye-forming coupler, or a development inhibitor releasing coupler, a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer, or a desensitizer.

The PUG can be present in the coupling-off group as a preformed species or it can be present in a blocked form or as a precursor. The PUG can be, for example, a preformed development inhibitor, or the development inhibiting function can be blocked by being the point of attachment to the carbonyl group bonded to PUG in the coupling-off group. Other examples are a preformed dye, a dye that is blocked to shift its absorption, and a leuco dye.

A PUG-releasing compound can be described by the formula CAR-$(TIME)_n$-PUG, wherein (TIME) is a linking or timing group, n is 0, 1, or 2, and CAR is a carrier moiety from which is released imagewise a PUG (when n is 0) or a PUG precursor $(TIME)_1$-PUG or $(TIME)_2$-PUG (when n is 1 or 2) upon reacting with oxidized developing agent. Subsequent reaction of $(TIME)_1$-PUG or $(TIME)_2$-PUG produces PUG.

Linking groups (TIME), when present, are groups such as esters, carbamates, and the like that undergo base-catalyzed cleavage, including intramolecular nucleophilic displacement, thereby releasing PUG. Where n is 2, the (TIME) groups can be the same or different. Suitable linking groups, which are also known as timing groups, are shown in U.S. Pat. Nos. 5,151,343; 5,051,345; 5,006,448; 4,409,323; 4,248,962; 4,847,185; 4,857,440; 4,857,447 4,861,701: 5,021,322: 5,026,628, and 5,021,555, all incorporated herein by reference. Especially useful linking groups are p-hydroxphenylmethylene moieties, as illustrated in the previously mentioned U.S. Pat. Nos. 4,409,323; 5,151,343 and 5,006,448, and o-hydroxyphenyl substituted carbamate groups, disclosed in U.S. Pat. Nos. 5,151,343 and 5,021,555, which undergo intramolecular cyclization in releasing PUG.

Following is a listing of patents and publications that describe representative coupler compounds that contain COUP groups useful in the invention:

Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999, "Farbkuppler-eine Literaturubersicht," published in Agfa Mitteilungen, Band III, pp. 156–175 (1961), and Section VII D of *Research Disclosure,* Item 308119, December 1989. Preferably such couplers are phenols and naphthols.

Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573, "Farbkuppler-eine Literaturubersicht," published in Agfa Mitteilungen, Band III, pp. 126–156 (1961), and Section VII D of Research Disclosure, Item 308119, December 1989. Preferably such couplers are pyrazolones or pyrazolotriazoles.

Couplers which form yellow dyes upon reaction with oxidized and color developing agent are described in such representative patents and publications as: U.S. Pat. Nos. 2,875,057; 2,407,210; 3,265,506; 2,298,443; 3,048,194; 3,447,928, "Farbkuppler-eine Literaturubersicht," published in Agfa Mitteilungen, Research Disclosure, Item 308119, December 1989. Preferably such couplers are acylacetamides, such as benzoylacetamides and pivaloylacetamides.

Couplers which form colorless products upon reaction with oxidized color developing agent are described in such representative patents as: U.K. Patent No. 861,138; U.S. Pat. Nos. 3,632,345; 3,928,041; 3,958,993 and 3,961,959. Preferably, such couplers are cyclic carbonyl-containing compounds which react with oxidized color developing agents but do not form dyes.

PUG groups that are useful in the present invention include, for example:

1. PUG's which form development inhibitors upon release

PUG's which form development inhibitors upon release are described in such representative patents as U.S. Pat. Nos. 3,227,554; 3,384,657; 3,615,506; 3,617,291; 3,733,201 and U.K. Pat. No. 1,450,479.

2. PUGs which are dyes, or form dyes upon release

Suitable dyes and dye precursors include azo, azomethine, azophenol, azonaphthol, azoaniline, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381; 3,942,987, and 4,840,884.

Suitable azo, azamethine and methine dyes are represented by the formulae in U.S. Pat. No. 4,840,884, col. 8, lines 1–70.

Dyes can be chosen from those described, for example, in J. Fabian and H. Hartmann, *Light Absorption of Organic Colorants,* published by Springer-Verlag Co., 3. PUG's which are couplers Couplers released can be nondiffusible color-forming couplers, non-color forming couplers or diffusible competing couplers. Representative patents and publications describing competing couplers are: "*On the Chemistry of White Couplers,*" by W. Puschel, Agfa-Gevaert AG Mitteilungen and der Forschungs-Laboratorium der Agfa-Gevaert AG, Springer Verlag, 1954, pp. 352–367; U.S. Pat. Nos. 2,998,314; 2,808,329; 2,689,793; 2,742,832; German Patent No. 1,168,769 and British Patent No.907,274.

4. PUG's which form developing agents

Developing agents released can be color developing agents, black-and-white developing agents or cross-oxidizing developing agents. They include aminophenols, phenylenediamines, hydroquinones and pyrazolidones. Representative patents are: U.S. Pat. Nos. 2,193,015; 2,108,243; 2,592,364; 3,656,950; 3,658,525; 2,751,297; 2,289,367; 2,772,282; 2,743,279; 2,753,256 and 2,304,953.

5. PUG's which are bleach inhibitors

Representative patents are U.S. Pat. Nos. 3,705,801; 3,715,208; and German OLS No. 2,405,279.

6. PUG's which are bleach accelerators

PUGs representative of bleach accelerators, can be found in for example U.S. Pat. Nos. 4,705,021; 4,912,024; 4,959,299; 4,705,021; 5,063,145, columns 21–22, lines 1–70; and EP Patent No. 0,193,389.

7. PUGs which are electron transfer agents (ETAs)

ETAs useful in the present invention are -aryl-3-pyrazolidinone derivatives which, once released, become active electron transfer agents capable of accelerating development under processing conditions used to obtain the desired dye image.

The electron transfer agent pyrazolidinone moieties which have been found to be useful in providing development acceleration function are derived from compounds generally of the type described in U.S. Pat. Nos. 4,209,580;, 4,463,081; 4,471,045; and 4,481,287 and in published Japanese patent application No. 62-123,172. Such compounds comprise 3-pyrazolidinone structures having an unsubstituted or substituted aryl group in the 1-position. Also useful are the combinations disclosed in U.S. Pat. No. 4,859,578. Preferably these compounds have one or more alkyl groups in the 4- or 5-positions of the pyrazolidinone ring.

8. PUGs which are development inhibiting redox releasers (DIRRs)

DIRRs useful in the present invention include hydroquinone, catechol, pyrogallol, 1,4-naphthohydroquinone, 1,2-naphthoquinone, sulfonamidophenol, sulfonamidonaphthol and hydrazide derivatives which, once released, become active inhibitor redox releasing agents that are then capable of releasing a development inhibitor upon reaction with a nucleophile such as hydroxide ion under processing conditions used to obtain the desired dye image. Such redox releasers are represented by formula (II) in U.S. Pat. No. 4,985,336; col. 3, lines 10 to 25 and formulas (III) and (IV) col. 14, line 54 to col. 17, line 11. Other redox releasers can be found in European Patent Application No. 0,285,176.

Other examples of development inhibiting redox releasers can be found in the couplers represented in for example European Patent Application 0,362,870; page 13, line 25 to page 29, line 20.

The dye image-forming compounds and PUG-releasing compounds can be incorporated in photographic elements of the present invention by means and processes known in the photographic art. A photographic element in which the dye image-forming and PUG-releasing compounds are incorporated can be a monocolor element comprising a support and a single silver halide emulsion layer, or it can be a multicolor, multilayer element comprising a support and multiple silver halide emulsion layers. The above described compounds can be incorporated in at least one of the silver halide emulsion layers and/or in at least one other layer, such as an adjacent layer, where they are in reactive association with the silver halide emulsion layer and are thereby able to react with the oxidized developing agent produced by development of silver halide in the emulsion layer. Additionally, the silver halide emulsion layers and other layers of the photographic element can contain addenda conventionally contained in such layers.

A typical multilayer photographic element can comprise a support having thereon a red-sensitized silver halide emulsion unit having associated therewith a cyan dye image-forming compound, a green-sensitized silver halide emulsion unit having associated therewith a magenta dye image-forming compound, and a blue-sensitized silver halide emulsion unit having associated therewith a yellow dye image-forming compound. Each silver halide emulsion unit can be composed of one or more layers, and the various units and layers can be arranged in different locations with respect to one another, as known in the prior art.

In an element of the invention, a layer or unit affected by PUG can be controlled by incorporating in appropriate locations in the element a layer that confines the action of PUG to the desired layer or unit. Thus, at least one of the layers of the photographic element can be, for example, a scavenger layer, a mordant layer, or a barrier layer. Examples of such layers are described in, for example, U.S. Pat. Nos. 4,055,429; 4,317,892; 4,504,569; 4,865,946; and 5,006,451. The element can also contain additional layers such as antihalation layers, filter layers and the like. The element typically will have a total thickness, excluding the support, of from 5 to 30 μm. Thinner formulations of 5 to about 25 μm are generally preferred since these are known to provide improved contact with the process solutions. For the same reason, more swellable film structures are likewise preferred. Further, this invention may be particularly useful with a magnetic recording layer such as those described in *Research Disclosure,* Item 34390, November 1992, p. 869.

In the following discussion of suitable materials for use in the elements of this invention, reference will be made to *Research Disclosure,* December 1989, Item 308119, the disclosures of which are incorporated herein by reference.

Suitable dispersing media for the emulsions, emulsion layers and other layers of elements of this invention are described in Section IX of *Research Disclosure,* December 1989, Item 308119, and publications therein.

In addition to the compounds described herein, the emulsions and photographic elements of this invention can include additional dye image-forming compounds, as described in Sections VII A–E and H, and additional PUG-releasing compounds, as described in Sections VII F and G of *Research Disclosure,* December 1989, Item 308119, and the publications cited therein.

The elements of this invention can contain brighteners (Section V), antifoggants and stabilizers other than or in addition to the Group A–G stabilizers described previously(Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in Research Disclosure, December 1989, Item 308119.

The elements of the invention can be coated on a variety of supports, as described in Section XVII of *Research Disclosure,* December 1989, Item 308119, and references cited therein.

The elements and emulsions of this invention can be exposed to actinic radiation, typically in the visible region of the spectrum, to form a latent image and then processed to form a visible image, as described in Sections XVIII and XIX of *Research Disclosure,* December 1989, Item 308119. Typically, processing to form a visible dye image includes the step of contacting the element with a color developing agent to reduce developable silver halide and oxidize the color developing agent. Oxidized color developing agent in turn reacts with the coupler to yield a dye. Preferred color developing agents are p-phenylenediamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxy-ethylaniline sulfate, 4-amino-3-β-(methanesulfonamido)ethyl-N,N-diethylaniline hydrochloride, and 4-amino-N-ethyl-N-(2-methoxyethyl)m-toluidine di-p-toluenesulfonic acid.

With negative-working silver halide, the processing step described above provides a negative image. The described elements are preferably processed in the known Kodak TM Flexicolor color process as described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak TM E-6 Process is a typical reversal process. Development is followed by the conventional steps of bleaching, fixing, or bleach-fixing, to remove silver or silver halide, washing, and drying.

Of course, the photographic elements used in the practice of this invention can contain any of the optional additional layers and components known to be useful in such elements in general, such as, for example, subbing layers, overcoat layers, surfactants and plasticizers, some of which are discussed in detail hereinbefore. They can be coated onto appropriate supports using any suitable technique, including, for example, those described in *Research Disclosure,* December 1989, Item 308117, Section XV Coating and Drying Procedures, the disclosure of which is incorporated herein by reference.

As previously indicated, a photographic element of the invention can comprise a single radiation-sensitive emulsion layer on a support. Particularly useful embodiments, however, are multilayer elements that contain a red light-sensitized, a green light-sensitized, and a blue light-sensitized unit, each unit containing at least one dye image-forming compound in reactive association with a radiation-sensitive silver halide emulsion.

If desired, the recording elements can be used in conjunction with an applied magnetic layer as described in *Research Disclosure,* November 1992, Item 34390.

The photographic elements containing radiation sensitive {100} tabular grain emulsions according to this invention can be imagewise-exposed with various forms of energy which encompass the ultraviolet and visible (e.g., actinic) and infrared regions of the electromagnetic spectrum, as well as electron-beam and beta radiation, gamma ray, X-ray, alpha particle, neutron radiation and other forms of corpuscular and wave-like radiant energy in either noncoherent (random phase) forms or coherent (in phase) forms as produced by lasers. Exposures can be monochromatic, orthochromatic or panchromatic. Imagewise exposures at ambient, elevated or reduced temperatures and/or pressures, including high-or low-intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18 and 23.

EXAMPLES

The invention can be better appreciated by reference to the following examples.

Throughout the examples the acronym APMT is employed to designate 1-(3-acetamidophenyl)-5-mercaptotetrazole. The term "low methionine gelatin" is employed, except as otherwise indicated, to designate gelatin that has been treated with an oxidizing agent to reduce its methionine content to less than 30 micromoles per gram. The acronym DW is employed to indicate distilled water. The acronym mppm is employed to indicate molar parts per million, whereas ppm is employed to parts per million on a weight basis. The term "Rsens" is in some instances employed to indicate relative sensitivity.

EXAMPLE 1 (Invention)

This example demonstrates the preparation of an ultrathin tabular grain silver iodochloride emulsion satisfying the requirements of this invention.

A 2030 mL solution containing 1.75% by weight low methionine gelatin, 0.011M sodium chloride and $1.48\times10^{-4}$M potassium iodide was provided in a stirred reaction vessel. The contents of the reaction vessel were maintained at 40° C. and the pCl was 1.95.

While this solution was vigorously stirred, 30 mL of 1.0M silver nitrate solution and 30 mL of a 0.99M sodium chloride and 0.01M potassium iodide solution were added simultaneously at a rate of 30 mL/min each. This achieved grain nucleation to form crystals with an initial iodide concentration of 2 mole percent, based on total silver.

The mixture was then held 10 minutes with the temperature remaining at 40° C. Following the hold, a 1.0M silver nitrate solution and a 1.0M NaCl solution were then added simultaneously at 2 mL/min for 40 minutes with the pCl being maintained at 1.95.

The resulting emulsion was a tabular grain silver iodochloride emulsion containing 0.5 mole percent iodide, based on silver. Fifty percent of total grain projected area was provided by tabular grains having {100} major faces having an average ECD of 0.84 μm and an average thickness of 0.037 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 23 and an average tabularity ($ECD/t^2$) of 657. The ratio of major face edge lengths of the selected tabular grains was 1.4. Seventy two percent of total grain projected area was made up of tabular grains having {100} major faces and aspect ratios of at least 7.5. These tabular grains had a mean ECD of 0.75 μm, a mean thickness of 0.045 μm, a mean aspect ratio of 18.6 and a mean tabularity of 488.

A representative sample of the grains of the emulsion is shown in FIG. 1.

EXAMPLE 2 (Comparative)

This emulsion demonstrates the importance of iodide in the precipitation of the initial grain population (nucleation).

This emulsion was precipitated identically to that of Example 1, except no iodide was intentionally added.

The resulting emulsion consisted primarily of cubes and very low aspect ratio rectangular grains ranging in size from about 0.1 to 0.5 μm in edge length. A small number of large rods and high aspect ratio {100} tabular grains were present, but did not constitute a useful quantity of the grain population.

A representative sample of the grains of this emulsion is shown in FIG. 2.

EXAMPLE 3 (Invention)

This example demonstrates an emulsion according to the invention in which 90% of the total grain projected area is comprised of tabular grains with {100} major faces and aspect ratios of greater than 7.5.

A 2030 mL solution containing 3.52% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 2.0M silver nitrate solution and 30 mL of a 1.99M sodium chloride and 0.01M potassium iodide solution were added simultaneously at a rate of 60 mL/min each. This achieved grain nucleation to form crystals with an initial iodide concentration of 1 mole percent, based on total silver.

The mixture was then held 10 minutes with the temperature remaining at 40° C. Following the hold, a 0.5M silver nitrate solution and a 0.5M NaCl solution were then added simultaneously at 8 mL/min for 40 minutes with the pCl being maintained at 2.35. The 0.5

$AgNO_3$ solution and the 0.5M NaCl solution were then added simultaneously with a ramped linearly increasing flow from 8 mL per minute to 16 mL per minute over 130 minutes with the pCl maintained at 2.35.

The resulting emulsion was a tabular grain silver iodochloride emulsion containing 0.06 mole percent iodide, based on silver. Fifty percent of total grain projected area was provided by tabular grains having {100} major faces having an average ECD of 1.86 μm and an average thickness of 0.082 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 24 and an average tabularity ($ECD/t^2$) of 314. The ratio of major face edge lengths of the selected tabular grains was 1.2. Ninety three percent of total grain projected area was made up of tabular grains having {100} major faces and aspect ratios of at least 7.5. These tabular grains had a mean ECD of 1.47 μm, a mean thickness of 0.086 μm, a mean aspect ratio of 17.5 and a mean tabularity of 222.

EXAMPLE 4 (Invention)

This example demonstrates an emulsion prepared similarly as the emulsion of Example 3, but an initial 0.08 mole percent iodide and a final 0.04% iodide.

A 2030 mL solution containing 3.52% by weight low methionine gelatin, 0.0056M sodium chloride and $00\times10^{-5}$M potassium iodide was provided in a stirred reaction vessel. The contents of the reaction vessel were maintained at 40° C. and the pCl was 2.25.

While this solution was vigorously stirred, 30 mL of 5.0M silver nitrate solution and 30 mL of a 4.998M sodium chloride and 0.002M potassium iodide solution were added simultaneously at a rate of 60 mL/min each. This achieved grain nucleation to form crystals with an initial iodide concentration of 0.08 mole percent, based on total silver.

The mixture was then held 10 minutes with the temperature remaining at 40° C. Following the hold, a 0.5M silver nitrate solution and a 0.5M sodium chloride solution were then added simultaneously at 8 mL/min for 40 minutes with the pCl being maintained at 2.95.

The resulting emulsion was a tabular grain silver iodochloride emulsion containing 0.04 mole percent iodide, based on silver. Fifty percent of the total grain projected area was provided by tabular grains having {100} major faces having an average CCD of 0.67 μm and an average thickness of 0.035 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 20 and an average tabularity (ECD/t2) of 651. The ratio of major face edge lengths of the selected tabular grains was 1.9. Fifty two percent of total grain projected area was made up of tabular grains having {100} major faces and aspect ratios of at least 7.5. These tabular grains had a mean ECD of 0.63 μm, a mean thickness of 0.036 μm, a mean aspect ratio of 18.5 and a mean tabularity of 595.

EXAMPLE 5 (Invention)

This example demonstrates an emulsion in which the initial grain population contained 6.0 mole percent iodide and the final emulsion contained 1.6% iodide.

A 2030 mL solution containing 3.52% by weight low methionine gelatin, 0.0056M sodium chloride and $3.00\times10^{-5}$M potassium iodide was provided in a stirred reaction vessel. The contents of the reaction vessel were maintained at 40° C. and the pCl was 2.25.

While this solution was vigorously stirred, 30 mL of 1.0M silver nitrate solution and 30 mL of a 0.97M sodium chloride and 0.03M potassium iodide solution were added simultaneously at a rate of 60 mL/min each. This achieved grain nucleation to form crystals with an initial iodide concentration of 6.0 mole percent, based on total silver.

The mixture was then held 10 minutes with the temperature remaining at 40° C. Following the hold, a 1.00M silver nitrate solution and a 1.00M sodium chloride solution were then added simultaneously at 2 mL/min for 40 minutes with the pCl being maintained at 2.35.

The resulting emulsion was a tabular grain silver iodochloride emulsion containing 1.6 mole percent iodide, based on silver. Fifty percent of total grain projected area was provided by tabular grains having {100} major faces having an average ECD of 0.57 μm and an average thickness of 0.036 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 16.2 and an average tabularity (ECD/$t^2$) of 494. The ratio of major face edge lengths of the selected tabular grains was 1.9. Sixty two percent of total grain projected area was made up of tabular grains having {100} major faces and aspect ratios of at least 7.5. These tabular grains had a mean ECD of 0.55 μm, a mean thickness of 0.041 μm, a mean aspect ratio of 14.5 and a mean tabularity of 421.

EXAMPLE 6 (Invention)

This example demonstrates an ultrathin high aspect ratio {100} tabular grain emulsion in which 2 mole percent iodide is present in the initial population and additional iodide is added during growth to make the final iodide level 5 mole percent.

A 2030 mL solution containing 1.75% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.2.

While this solution was vigorously stirred, 30 mL of 1.0M silver nitrate solution and 30 mL of a 0.99M sodium chloride and 0.01M potassium iodide solution were added simultaneously at a rate of 90 mL/min each. This achieved grain nucleation to form crystals with an initial iodide concentration of 2 mole percent, based on total silver.

The mixture was then held 10 minutes with the temperature remaining at 40° C. Following the hold, a 1.00M silver nitrate solution and a 1.00M sodium chloride solution were then added simultaneously at 8 mL/min while a $3.375\times10^{-2}$M potassium iodide was simultaneously added at 14.6 mL/min for 10 minutes with the pCl being maintained at 2.35.

The resulting emulsion was a tabular grain silver iodochloride emulsion containing 5 mole percent iodide, based on silver. Fifty percent of total grain projected area was provided by tabular grains having {100} major faces having an average ECD of 0.58 μm and an average thickness of 0.030 μm, selected on the basis of an aspect ratio rank ordering of all {100} tabular major face edge length ratio less than 10. The selected tabular grain population had an average aspect ratio (ECD/t) of 20.6 and an average tabularity (ECD/$t^2$) of 803. The ratio of major face edge lengths of the selected tabular grains was 2. Eighty seven percent of total grain projected area was made up of tabular grains having {100} major faces and aspect ratios of at least 7.5. These tabular grains had a mean ECD of 0.54 μm, a mean thickness of 0.033 μm, a mean aspect ratio of 17.9 and a mean tabularity of 803.

EXAMPLE 7 (Invention)

This example demonstrates a high aspect ratio {100} tabular emulsion where 1 mole percent iodide is present in the initial grain population and 50 mole percent bromide is added during growth to make the final emulsion 0.3 mole percent iodide, 36 mole percent bromide and 63.7 mole percent chloride.

A 2030 mL solution containing 3.52% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 1.0M silver nitrate solution and 30 mL of a 0.99M sodium chloride and 0.01M potassium iodide solution were added simultaneously at a rate of 60 mL/min each. This achieved grain nucleation.

The mixture was then held 10 minutes with the temperature remaining at 40° C. Following the hold, a 0.5M silver nitrate solution and a 0.25M sodium chloride and 0.25M sodium bromide solution were then added simultaneously at 8 mL/min for 40 minutes with the pCl being maintained at 2.60 to form crystals with an initial iodide concentration of 2 mole percent, based on total silver.

The resulting emulsion was a tabular grain silver iodobromochloride emulsion containing 0.27 mole percent iodide and 36 mole percent bromide, based on silver, the remaining halide being chloride. Fifty percent of total grain projected area was provided by tabular grains having {100} major faces having an average ECD of 0.4 μm and an average thickness of 0.032 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 12.8 and an average tabularity (ECD/$t^2$) of 432. The ratio of major face edge lengths of the selected tabular grains was 1.9. Seventy one percent of total grain projected area was made up of tabular grains having {100} major faces and aspect ratios of at least 7.5. These tabular grains had a mean ECD of 0.38 μm, a mean thickness of 0.034 μm, a mean aspect ratio of 11.3 and a mean tabularity of 363.

EXAMPLE 8 (Invention)

This example demonstrates the preparation of an emulsion satisfying the requirements of the invention employing phthalated gelatin as a peptizer.

To a stirred reaction vessel containing a 310 mL solution that is 1.0 percent by weight phthalated gelatin, 0.0063M sodium chloride and $3.1\times10^{-4}$M KI at 40° C., 6.0 mL of a 0.1M silver nitrate aqueous solution and 6.0 mL of a 0.11M sodium chloride solution were each added concurrently at a rate of 6 mL/min.

The mixture was then held 10 minutes with the temperature remaining at 40° C. Following the hold, the silver and salt solutions were added simultaneously with a linearly accelerated flow from 3.0 mL/min to 9.0 mL/min over 15 minutes with the pCl of the mixture being maintained at 2.7.

The resulting emulsion was a high aspect ratio tabular grain silver iodochloride emulsion. Fifty percent of total grain projected area was provided by tabular grains having {100} major faces having an average ECD of 0.37 μm and an average thickness of 0.037 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 10 and an average tabularity ($ECD/t^2$) of 330. Seventy percent of total grain projected area was made up of tabular grains having {100} major faces and aspect ratios of at least 7.5. These tabular grains had a mean ECD of 0.3 μm, a mean thickness of 0.04 μm, and a mean tabularity of 210.

Electron diffraction examination of the square and rectangular surfaces of the tabular grains confirmed major face {100} crystallographic orientation.

EXAMPLE 9 (Invention)

This example demonstrates the preparation of an emulsion satisfying the requirements of the invention employing an unmodified bone gelatin as a peptizer.

To a stirred reaction vessel containing a 2910 mL solution that is 0.69 percent by weight bone gelatin, 0.0056M sodium chloride, $1.86\times10^{-4}$M KI and at 55° C. and pH 6.5, 60 mL of a 4.0M silver nitrate solution and 60.0 mL of a 4.0M sodium chloride solution were each added concurrently at a rate of 120 mL/min.

The mixture was then held for 5 minutes during which a 5000 mL solution that is 16.6 g/L of low methionine gelatin was added and the pH was adjusted to 6.5 and the pCl to 2.25. Following the hold, the silver and salt solutions were added simultaneously with a linearly accelerated flow from 10 mL/min to 25.8 mL/min over 63 minutes with the pCl of the mixture being maintained at 2.25.

The resulting emulsion was a high aspect ratio tabular grain silver iodochloride emulsion containing 0.01 mole % iodide. About 65% of the total projected grain area was provided by tabular grains having an average diameter of 1.5 μm and an average thickness of 0.18 μm.

EXAMPLE 10

This example compares the photographic performance of a {100} silver chloride tabular emulsion according to the invention to a silver chloride cubic grain emulsion of similar average grain volume.

Emulsion A

Silver iodochloride tabular emulsion with {100} major faces

Precipitation a remake of the Example 3 emulsion scaled up 3×

A 6090 ml solution containing 3.52% by weight of low methionine gelatin, 0.0056M sodium chloride and $1.48\times10^{-4}$ potassium iodide was provided in a stirred reaction vessel at 40° C. While the solution was vigorously stirred, 90 mL of 2.0M silver nitrate and 90 mL of a 1.99M sodium chloride and 0.01M potassium iodide solution were added simultaneously at a rate of 180 mL/min each. The mixture was then held for 10 minutes with the temperature remaining at 40° C. Following the hold, a 0.5M silver nitrate solution and a 0.5M sodium chloride solution were added simultaneously at 24 mL/min for 40 minutes followed by a linear acceleration from 24 mL/min to 48 mL/min over 130 minutes, while maintaining the pCl at 2.35. The pCl was then adjusted to 1.30 with sodium chloride then washed using ultrafiltration to a pCl of 2.0 then adjusted to a pCl of 1.65 with sodium chloride. The resulting emulsion was a tabular grain silver chloride emulsion contained 0.06 mole percent iodide and had a mean equivalent circular grain diameter of 1.45 μm and a mean grain thickness of 0.13 μm.

Sensitization

An optimum green light sensitization was found for Emulsion A by conducting numerous small scale finishing experiments where the level of sensitizing dye, sodium thiosulfate pentahydrate, aurous dithiosulfate dihydrate and the hold time at 65° C. were varied. The optimum finish was as follows: to a 0.5 mole portion of Emulsion A melted at 40° C. and well stirred, 0.800 mmol/mole of green light sensitizing dye A was added followed by a 20 minute hold. To this was added 0.10 mg/mole of sodium thiosulfate pentahydrate and 0.20 mg/mole of sodium aurous dithiosulfate dihydrate. The temperature was then increased to 65° C. over 9 minutes and then held for 4 minutes at 65° C. and rapidly cooled to 40° C.

Sensitizing Dye A

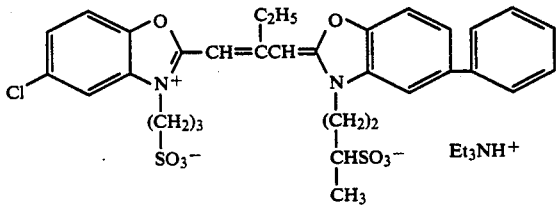

Emulsion B

Silver chloride cubic grain emulsion (Control)

Precipitation

A monodisperse silver chloride cube with a cubic edge length of 0.59 μm was prepared by simultaneous addition of 3.75M silver nitrate and 3.75M sodium chloride to a well stirred solution containing 8.2 g/l of sodium chloride, 28.2 g/l of bone gelatin and 0.212 g/liter of 1,8-dithiadioctanediol while maintaining the temperature at 68.3° C. and the pCl at 1.0. The temperature was reduced to 40° C. and the emulsion was washed by ultrafiltration to a pCl of 2.0, then adjusted to a pCl of 1.65 with sodium chloride.

Sensitization

An optimum green light sensitization was found in the same manner as described for Emulsion A. The conditions for the optimum were as follows: to a 0.05 mole quantity of Emulsion B melted at 40° C. and well stirred, 0.2 mmol/mole of sensitizing dye A was added followed by a 20 minute hold. To this was added 0.25 mg/mole of sodium thiosulfate pentahydrate and 0.50 mg/mole of sodium aurous dithiosulfate dihydrate. The temperature was then increased to 65° C. over 9 minutes and held for 10 minutes followed by rapid cooling to 40° C.

Photographic Performance

Each of the sensitized emulsions was coated on antihalation support at 0.85 $g/m^2$ of silver along with 1.1 $g/m^2$ of cyan dye-forming coupler C and 2.7 $g/m^2$ of gelatin. This was overcoated with 1.6 $g/m^2$ of gelatin and hardened with 1.7 weight percent, based on total gelatin, of bis(vinylsulfonylmethyl)ether. The coatings were evaluated for intrinsic sensitivity by exposing for 0.02 seconds in a step wedge sensitometer with the 365 nm line of a mercury vapor lamp as the light source. Sensitivity to green light was measured by exposing the coatings for 0.02 seconds using a step wedge sensitometer with a 3000° K. tungsten lamp filtered to simulate a Daylight V light source and filtered to transmit only green and red light by a Kodak Wratten TM 9 filter (transmitting wavelengths longer than 450 nm). The coatings were processed using the Kodak Flexicolor TM C-41 color negative process, described in *Brit. J. Photog. Annual* 1988, p196–198, and the dye density was measured using status M red filtration.

Coupler C

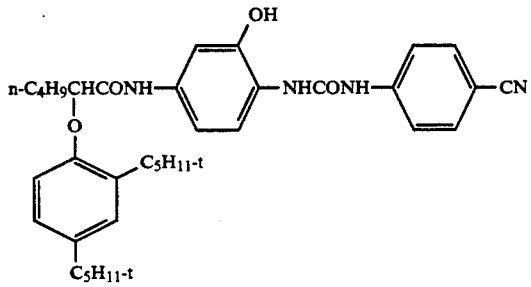

The photographic results are summarized in Table I.

TABLE I

| | 365 line exposure | | | Wratten TM 9 exposure | | |
|---|---|---|---|---|---|---|
| Emulsion | Dmin | Rsens | contrast | Dmin | Rsens | contrast |
| Emulsion A (tab.) | | | | | | |
| unsensitized | 0.06 | 10 | 1.75 | — | — | — |
| green sensitized | 0.22 | 129 | 1.96 | .22 | 371 | 2.08 |
| Emulsion B (cubic) | | | | | | |
| unsensitized | 0.06 | 7 | 4.03 | — | — | — |
| green sensitized | 0.22 | 120 | 2.89 | .16 | 128 | 2.86 |

Table I shows that for intrinsic sensitivity as measured by the 365 line exposure, both Emulsions A and B are very similar as would be expected based on their similar grain volume. Comparing the green light sensitivity as measured by the Wratten TM 9 exposures shows that the tabular emulsion is 2.9 times more sensitive to green light than the cubic emulsion. This clearly shows the advantage of the tabular morphology.

EXAMPLE 11

This example describes the sensitization and photographic performance of a {100} silver chloride tabular emulsion and a silver chloride cubic emulsion of similar average grain volume sensitized using gold sulfide and a blue spectral sensitizing dye, and compared in low silver coatings on a resin coated paper support.

Precipitation of Silver Chloride Tabular Emulsion with {100} Major Faces

This emulsion was prepared in an identical fashion to the {100} silver chloride tabular emulsion described in Example 10.

Precipitation of Silver Chloride Cubic Emulsion

This emulsion was prepared in a similar fashion to the cubic emulsion described in Example 10, except the ripener 1,8-dithiadioctanediol was omitted and flow rates and precipitation time were adjusted to achieve the same size emulsion.

Sensitization

Both emulsions were sensitized to blue light using the following procedures. A quantity of each emulsion was melted at 40° C., 660 mg/mole Ag of sensitizing dye B was added to the {100} tabular emulsion and 220 mg/mole of the same dye was added to the cubic emulsion based on their specific surface area, followed by a 20 minute hold. 2.0 mg/mole of aurous sulfide was added to each emulsion followed by a 5 minute hold. The temperature was then raised to 60° C. and held for 30 minutes after which 90 mg/mole of APMT was added and the emulsion was chill set.

Photographic Performance

Each of the sensitized emulsions was coated on resin coated paper support at 0.28 g/m$^2$ of silver along with 1.1 g/m$^2$ of yellow dye forming coupler B and 0.82 g/m$^2$ of gelatin. The coatings were evaluated for intrinsic sensitivity by exposing for 0.1 seconds in a step wedge sensitometer with the 365 nm line of a mercury vapor lamp as the light source. Sensitivity to white light was measured by exposing the coatings for 0.1 seconds using a step wedge sensitometer with a 3000° K. tungsten lamp. The coatings were processed using a standard RA-4 color paper process as described in *Research Disclosure,* Vol. 308, p.933, 1989. Dye density was measured using standard reflection geometry and status A filtration.

The photographic results are summarized in Table II.

TABLE II

| | 365 line exposure | | | 3000° K. Tungsten exposure | | |
|---|---|---|---|---|---|---|
| Emulsion | Dmin | Rsens | contrast | Dmin | Rsens | contrast |
| {100} tabular | 0.08 | 98 | 2.53 | .08 | 154 | 2.53 |
| cubic | 0.11 | 100 | 2.64 | .11 | 100 | 2.64 |

Table II shows that for intrinsic sensitivity as measured by the 365 line exposure, both the cubic and the tabular emulsion are similar in sensitivity, as would be expected based on their similar grain volume. Comparing the white light sensitivity as measured by the 3000° K. tungsten exposures shows that the tabular emulsion is about 50% more sensitive to blue light than the cubic emulsion.

EXAMPLE 12

This example shows how bromide can be added at the end of the precipitation or during the finish to produce emulsions with surface halide structure and/or growths. These emulsions show good photographic performance.

Emulsion A (Invention)

This emulsion was prepared identically to the {100} tabular emulsion described in Example 10. A quantity of this emulsion was then melted at 40° C. and 1200 mg/mole of potassium bromide was rapidly added. 0.6 mmol of green sensitizing dye A per mole of emulsion was then added followed by a 20 minute hold. 1.0 mg/mole of sodium thiosulfate pentahydrate and 1.3 mg/mole of potassium tetrachloroaurate were then added followed by a temperature ramp to 60° C. and a 10 minute hold. The emulsion was then cooled to 40° C. and 70 mg/mole of APMT was added and the emulsion was chill set. Examination of the crystals by scanning electron microscopy revealed that the edges of the crystal had been roughened by the bromide deposition and some surface roughening was also present.

This emulsion illustrates the precipitation and sensitization of a {100} silver chloride tabular emulsion where potassium bromide was added during the final step of the precipitation to form an emulsion whereby the majority of the grains have epitaxial deposits located at 3 or 4 of the 4 available tabular grain corners.

Precipitation

A 1536 mL solution containing 3.52% by weight low methionine gelatin, 0.0056M sodium chloride and $2.34\times10^{-4}$M potassium iodide was provided in a stirred reaction vessel at 40° C. and pH 5.74. While this solution was vigorously stirred, 30 mL of 2.0M silver nitrate and 30 mL of 2.0M sodium chloride were added simultaneously at a rate of 60 mL/min each. This achieved grain nucleation.

The mixture was then held for 10 seconds after which a 0.5M silver nitrate and a 0.5M sodium chloride solution were added simultaneously at 5.3 mL/min for 60 minutes with the pCl maintained at 2.35. The silver nitrate and sodium chloride solutions were then added using linearly accelerated flow rates from 5.3 mL/min to 15.6 mL/min over 150 minutes.

The pCl was then adjusted to 1.55 with sodium chloride and 25 g of phthalated deionized gel was added and dissolved. The pH was then reduced to 3.85 and the stirring was stopped to allow the coagulum to settle. The supernatant was discarded and distilled water was added back to the coagulum to bring it to its original volume at the end of the precipitation. Stirring was resumed and the pH was adjusted back to 5.36 and the pCl was 2.45.

With vigorous stirring, 39 mL of 1.5M potassium bromide solution was added over 30 minutes bringing the pCl to 1.8.

The pH was adjusted to 5.8 and 25 g of phthalated deionized gel was added and dissolved. The pH was reduced to 3.85 and stirring was stopped to allow the coagulum to settle. The supernatant was removed, 27 g of low methionine gel was added and the emulsion weight was raised to 800 g with distilled water. The pH was adjusted to 5.77 and the pCl to 1.65 with 1.0M sodium chloride solution.

The resulting emulsion had a mean equivalent circular diameter of 1.6 μm and a mean grain thickness of 0.135 μm. The halide composition was 93.964% silver chloride, 6.0% silver bromide and 0.0036% silver iodide. Seventy-five percent of the grains had three or more minor edges with epitaxial deposits.

Sensitization

A 0.15 mole quantity of emulsion was melted at 40° C. with stirring. To this was added 0.70 mmol/mole of green sensitizing dye A followed by a 20 minute hold. To this was added 1.0 mg/mole of sodium thiosulfate pentahydrate and 1.3 mg/mole of potassium tetrachloroaurate. The temperature was then increased to 60° C. over 12 minutes and held for 5 minutes followed by rapid cooling to 40° C. 70 mg/mole of APMT was then added and the emulsion was chill set.

Emulsion C (Invention)

This example illustrates the precipitation and sensitization of a {100} silver chloride tabular emulsion where potassium bromide was added during the final step of the precipitation to form an emulsion where the majority of the grains had epitaxial deposits located at only 1 or 2 of the minor edges.

Precipitation

A 1536 mL solution containing 3.52% by weight low methionine gelatin, 0.0056M sodium chloride and $2.34\times10^{-4}$M potassium iodide was provided in a stirred reaction vessel at 40° C. and pH 5.74. While this solution was vigorously stirred. 30 mL of 2.0M silver nitrate and 30 mL of 2.0M sodium chloride were added simultaneously at a rate of 60 mL/min each. This achieved grain nucleation.

The mixture was then held for 10 seconds after which a 0.5M silver nitrate and a 0.5M sodium chloride solution were added simultaneously at 8.0 mL/min for 40 minutes with the pCl maintained at 2.35. The silver nitrate and sodium chloride solutions were then added using linearly accelerated flow rates from 8.0 mL/min to 16.1 mL/min over 130 minutes.

The pCl was then adjusted to 1.65 by running the sodium chloride solution at 20 mL/min for 8.0 min. This was followed by a 10 minute hold. The pCl was then increased back to 2.15 by running the silver nitrate solution at 5.0 mL/min for 27.7 min. This was followed by the addition of a 1.5M potassium bromide solution at 2.0 mL/min over 20 minutes bringing the pCl to 1.70.

25 g of phthalated deionized gel was then added and dissolved. The pH was reduced to 3.85 and stirring was stopped to allow the coagulum to settle. The supernatant was removed and distilled water was added back to original volume. The pH was then adjusted back to 5.7 with vigorous stirring resumed. The pH was then adjusted back to 3.8 and the stirring was again stopped to allow the coagulum to form. The supernatant was again discarded and 20 g of low methionine gel was added and the emulsion weight was raised to 800 g with distilled water. The pH was adjusted to 5.77 and the pCl to 1.65 with 1.0M sodium chloride solution.

The resulting emulsion had a mean equivalent circular diameter of 1.65 μm and a mean grain thickness of 0.14 μm. The halide composition was 93.964% silver chloride, 6.0% silver bromide and 0.0036% silver iodide. Examination of the emulsion by scanning electron microscopy showed that 97 percent of the grains had epitaxial depositions visible on two or fewer of the four available host tabular grain corners.

Sensitization

The sensitization was identical to that used in Example 1 except the level of sodium thiosulfate pentahydrate and potassium tetrachloroaurate were increased by 50%.

Emulsion D (Control)

This emulsion was composed of silver chloride cubic grains and was precipitated identically to the cubic emulsion in Example 10 and is of similar grain volume to the three tabular emulsions in this example. This emulsion was sensitized as follows: a quantity was melted at 40° C. and 500 mg/mole of potassium bromide was added followed by 0.2 mg/mole of sensitizing dye A and a 20 minute hold. To this was added 0.25 mg/mole of sodium thiosulfate pentahydrate and 0.50 mg/mole of sodium aurous dithiosulfate dihydrate followed by a temperature ramp to 65° C. and a 12 minute hold. The emulsion was then quickly chilled. Photographic Performance Each of the sensitized emulsions was coated on antihalation support at 0.85 g/m$^2$ of silver along with 1.1 g/m$^2$ of cyan dye forming coupler C and 2.7 g/m$^2$ of gelatin. This was overcoated with 1.6 g/m$^2$ of gelatin and hardened with bis(vinylsulfonylmethyl)ether at 1.75% of the total coated gelatin weight. The coatings were evaluated for intrinsic sensitivity by exposing for 0.02 seconds in a step wedge sensitometer with the 365 nm line of a mercury vapor lamp as the source. Sensitivity to green light was measured by exposing the coatings for 0.02 seconds using a step wedge sensitometer with a 3000° K. tungsten lamp filtered to simulate a Daylight V source and filtered to transmit only light with wavelengths longer than 400 nm by a Kodak Wratten TM 2B filter. The coatings were then processed using the Kodak Flexicolor TM C-41 color negative process. The dye density was measured using status M red filtration.

The photographic results are tabulated and summarized in Table III.

TABLE III

| | Wratten TM 2B exposure | | | 365 line exposure | | |
|---|---|---|---|---|---|---|
| Emulsion | Dmin | Rsens | contrast | Dmin | Rsens | contrast |
| Emulsion A | .14 | 200 | 2.22 | .12 | 60 | 1.87 |
| Emulsion B | .13 | 275 | 2.05 | .14 | 141 | 1.89 |
| Emulsion C | .12 | 245 | 2.36 | .13 | 79 | 2.65 |
| Emulsion D (control) | .14 | 100 | 2.82 | .18 | 100 | 2.48 |

Table III shows all of the {100} tabular grain emulsion examples are at least 2 times more sensitive to a white light exposure than the similarly sensitized cubic grain emulsion even though emulsion A and C showed less intrinsic sensitivity to the 365 mercury line exposure.

Sensitizing Dye B

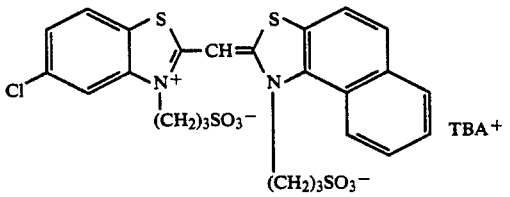

TBA+ = *tributylammonium*

Coupler Y

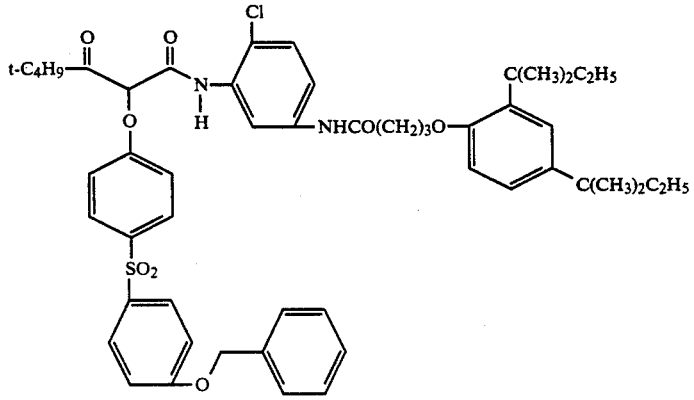

EXAMPLE 13 (Comparison)

The purpose of this Example is to demonstrate the inability of a ripening out procedure—specifically the procedure referred to in the 1963 Torino Symposium, cited above—to produce a tabular grain emulsion satisfying the requirements of the invention.

To a reaction vessel containing 75 mL distilled water, 6.75 g deionized bone gelatin and 2.25 mL of 1.0M NaCl solution at 40° C. were simultaneously added with efficient stirring 15 mL of 1.0M $AgNO_3$ solution and 15 mL of 1.0M NaCl solution each at 15 mL per minute. The mixture was stirred at 40° C. for 4 minutes, then the temperature was increased to 77° C. over a period of 10 minutes and 7.2 mL of 1.0M NaCl solution were added. The mixture was stirred at 77° C. for 180 minutes and then cooled to 40° C.

The resulting grain mixture was examined by optical and electron microscopy. The emulsion contained a population of small cubes of approximately 0.2 μm edge length, large nontabular grains, and tabular grains with square or rectangular major faces. In terms of numbers of grains the small grains were overwhelmingly predominant. The tabular grains accounted for no more than 25 percent of the total grain projected area of the emulsion.

The mean thickness of the tabular grain population was determined from edge-on views obtained using an electron microscope. A total of 26 tabular grains were measured and found to have a mean thickness of 0.38

μm. Of the 26 tabular grains measured for thickness, only one had a thickness of less than 0.3 μm, the thickness of that one tabular grain being 0.25 μm.

EXAMPLE 14

This example has as its purpose to demonstrate successful preparation of an emulsion satisfying the requirements of the invention employing commercially available deionized gelatin as a starting material.

To a reaction vessel, equipped with a stirrer, were added 2865 g of distilled water containing 20 g of deionized gelatin (purchased from Rousellot TM). The initial calcium ion level was $8\times10^{-6}$ molar. Additional calcium ion was added to the reaction vessel as calcium chloride hydrate to compensate for calcium ion removal during deionization of the gelatin, thereby bringing the calcium ion concentration up to 2.36 millimolar. Adjustment of the dispersing medium within the reaction vessel was completed by adding 0.96 g of sodium chloride and 45 g of 0.012 molar potassium iodide solution. The pH was adjusted to 6.5 at 55° C. and maintained at that value throughout the precipitation by addition of sodium hydroxide or nitric acid solutions.

A 4.0M silver nitrate and a 4.0M sodium chloride solution were added for 30 seconds at a rate consuming 5 percent of the total silver. The emulsion was then held at 62° C. for 10 minutes followed by the addition of 5000 g of a solution containing 1.6 percent of the deionized gelatin. This was followed by simultaneous addition of the silver nitrate and sodium chloride with the flow rates linearly increased by a factor of 2.58 over 70 minutes with the pAg maintained at 6.37. The total amount of silver iodochloride precipitated was 4.745 moles.

Greater than 80 percent of total grain projected area was accounted for by tabular grains. The tabular grains exhibited an average ECD of 1.65 μm, an average thickness of 0.165 μm, and an average aspect ratio of 10.

When the preparation procedure described above was repeated with calcium acetate substituted for calcium chloride hydrate, greater than 85 percent of total grain projected area was accounted for by tabular grains. The tabular grains exhibited an average ECD of 1.5 μm, an average thickness of 0.16 μm, and an average aspect ratio of 9.4. When magnesium, aluminum or iron ions were substituted for calcium ions in the dispersing medium, emulsions satisfying the requirements of the invention were also obtained.

EXAMPLES 15 AND 16

These examples demonstrate the preparation of emulsions satisfying the requirements of the invention employing a dual-zone growth process in which the growth reactants are premixed in a continuous reactor prior to being added to the growth reactor, to yield tabular grains with an ECD greater than 2 μm.

EXAMPLE 15

To a stirred reaction vessel containing a 2945 mL solution that is 1.77 percent by weight bone gelatin, 0.0056M sodium chloride, $1.86\times10^{-4}$M potassium iodide and at 55° C. and pH 6.5, 15 mL of a 4.0 M silver nitrate solution and 15 mL of a 4.0M sodium chloride solution were each added concurrently at a rate of 30 mL/min.

The mixture was then held for 5 minutes during which 7000 mL of distilled water were added and the temperature was raised to 65° C., while the pCl was adjusted to 2.15 and the pH to 6.5. Following the hold, the size of the resulting grains was increased through growth using a dual-zone process. In this process, a solution of 0.67M silver nitrate was premixed with a 0.6M solution of sodium chloride and a solution of 0.5 percent by weight bone gelatin at a pH of 6.5, in a continuous reactor with a total volume of 30 mL, which was well-mixed. The effluent from this premixing reactor was then added to the original reaction vessel, which during this step acted as a growth reactor. During the growth step the fine crystals from the continuous reactor were ripened onto the original crystals through Ostwald ripening. The total suspension volume of the growth reactor during this growth step was maintained constant at 13.5 L using ultrafiltration.

The flow rates of the 0.67M silver nitrate solution and the 0.67M sodium chloride solution were linearly increased from 20 to 80 mL/min, 150 mL/min and 240 mL/min in 25 minute intervals. The flow rate of the 0.5 percent gelatin reactant was maintained constant at 500 mL/min. The continuous reactor in which these reactants were premixed was kept at 30° C. and a pCl of 2.45, while the growth reactor was maintained at a temperature of 65° C., a pCl of 2.15, and a pH of 6.5.

This procedure resulted in 6 moles of a high aspect ratio tabular grain iodochloride emulsion containing 0.01 mole % iodide. More than 90% of the total projected grain area was provided by tabular grains having {100} major faces, an average ECD of 2.55 μm, and an average thickness of 0.165 μm. Therefore, the tabular grain population had an average aspect ratio of 15.5 and an average tabularity of 93.7.

EXAMPLE 16

Silver iodochloride nuclei were formed in a 30 mL well-mixed, continuous reactor by mixing a 0.447M silver nitrate solution (at 100 mL/min) with a 0.487M sodium chloride and 0.00377M potassium iodide solution (at 100 mL/min) and a 2.0 percent by weight bone gelatin solution (at 1 L/min) at a pCl of 2.3 and a temperature of 40° C. The resulting mixture containing the nuclei was transferred to a stirred semi-batch reactor for 1.5 min. The semi-batch reactor was maintained at 65° C. and a constant volume of 13.5 L (using ultrafiltration) and was initially at a pCl of 2.15, a pH of 6.5 and a bone gelatin concentration of 0.37 percent by weight. During the nuclei transfer from the continuous reactor to the semi-batch reactor the pCl of the latter was maintained at 2.15 by the addition of a 1M sodium chloride solution.

After holding for 5 min, growth of the initial nuclei was achieved by the dual-zone process as follows. A solution of 0.67M silver nitrate, a solution of 0.67M sodium chloride and a solution of 0.5 percent by weight bone gelatin at a pH of 6.5 were premixed in the 30 mL continuous reactor, and then transferred to the semi-batch reactor. Growth occurred by Ostwald ripening whereby the crystals from the continuous reactor were dissolved in the semi-batch reactor and the original nuclei increased in size. The total suspension volume of the semi-batch reactor was maintained constant at 13.5 L during this step, as during the nucleation step.

During the growth step the flow rates of the 0.67M silver nitrate solution and the 0.67M sodium chloride solution were linearly increased from 20 to 80 mL/min, 150 mL/min and 240 mL/min in 25 minute intervals. The flow rate of the 0.5 percent gelatin reactant was maintained constant at 500 mL/min. The continuous reactor in which these reactants were premixed was kept at 30° C. and a pCl of 2.45, while the growth reactor was maintained at a temperature of 65° C., a pCl of 2.15, and a pH of 6.5.

This procedure resulted in 6 moles of a large, high aspect ratio tabular grain iodochloride emulsion containing 0.01 mole % iodide. More than 80% of the total projected grain area was provided by tabular grains having {100} major faces, an average ECD of 2.28 μm, and an average thickness of 0.195 μm. Therefore, the tabular grain population had an average aspect ratio of 11.7 and an average tabularity of 60.0.

EXAMPLE 17

This example has as its purpose to demonstrate the thinning of high chloride {100} tabular grains through the introduction of bromide and/or iodide ions during the growth stages of precipitation.

Emulsion 17A

A silver iodochloride {100} tabular grain emulsion.

A 6000 mL solution containing 3.52% by weight of low methionine gelatin, 0.0056M sodium chloride was provided in a stirred reaction vessel at 40° C. While the solution was vigorously stirred, 90 mL of a 0.01M potassium iodide solution was added followed by simultaneous addition of a 90 mL of 2.0M silver nitrate and 90 mL of a 1.99M sodium chloride, 0.01M potassium iodide solution at a rate of 180 mL/min each. The mixture was then held for 10 minutes with the temperature remaining at 40° C. Following the hold, a 1.0M silver nitrate solution and a 1.0M sodium chloride solution were added simultaneously at 12 mL/min for 40 minutes followed by a linear acceleration from 12 mL/min to 33.7 mL/min over 233.2 minutes, while maintaining the pCl at 2.25. The pCl within the reaction vessel was then adjusted to 1.65 with sodium chloride then the emulsion was washed and concentrated using ultrafiltration to a pCl of 2.0. The pCl was adjusted to 1.65 with sodium chloride and the pH to 5.7.

The resulting emulsion was a silver iodochloride {100} tabular grain emulsion containing 0.015 mole percent iodide. The emulsion grains exhibited a mean ECD 1.51 μm and a mean grain thickness of 0.21 μm.

Emulsion 17B

This example demonstrates that bromide ion in the halide salt solution at a 1 mole percent level during the final 89 percent of the precipitation significantly reduces the average grain thickness of the emulsion.

This emulsion was prepared identically to Emulsion 17A, except that the halide salt solution used during the 233.2 minute accelerated flow period was a 0.99M sodium chloride and 0.01M sodium bromide solution.

The resulting high chloride {100} tabular grain emulsion contained 0.015 mole percent iodide, 0.89 percent bromide and 99.095 mole percent silver chloride. The mean ECD was 1.69 μm and the average thickness was 0.17 μm.

Emulsion 17C

This example demonstrates that bromide ion in the salt solution at a 10 percent level during the final 89 percent of the precipitation significantly reduces the average grain thickness of the emulsion.

This emulsion was prepared identically to Emulsion 17A, except that the halide salt solution used during the 233.2 minute accelerated flow period was a 0.90M sodium chloride, 0.10M sodium bromide solution.

The resulting high chloride {100} tabular grain emulsion contained 0.015 mole percent iodide, 8.9 percent bromide and 91.085 mole percent silver chloride. The mean ECD was 1.69 μm and the average grain thickness was 0.17 μm.

Emulsion 17D

A silver iodochloride {100} tabular grain emulsion with a bulk composition of 99.97 percent silver chloride and 0.03 percent silver iodide, where only silver chloride was precipitated during the growth stages.

A 1.5 L solution containing 3.52% by weight of low methionine gelatin, 0.0056M sodium chloride and 0.3 mL of polyethylene glycol antifoamant provided in a stirred reaction vessel at 40° C. While the solution was vigorously stirred, 45 mL of a 0.01M potassium iodide solution was added followed by 50.0 mL of 1.25M silver nitrate and 50.0 mL of a 1.25M sodium chloride solution added simultaneously at a rate of 100 mL/min each. The mixture was then held for 10 seconds with the temperature remaining at 40° C. Following the hold, a 0.625M silver nitrate solution containing 0.08 mg mercuric chloride per mole of silver nitrate and a 0.625M sodium chloride solution were added simultaneously at 10 mL/min for 30 minutes followed by a linear acceleration from 10 mL/min to 15 mL/min over 125 minutes, then 30 minutes at a constant flow rate of 15 mL/min. The pCl was maintained at 2.35 during this time. The pCl was then adjusted to 1.65 with a sodium chloride solution. Fifty grams of phthalated gelatin were added and the emulsion was washed and concentrated using procedures of Yutzy et al U.S. Pat. No. 2,614,928. The pCl after washing was 2.0. Thirty-four grams of low methionine gel were added, the pCl was adjusted to 1.65 with sodium chloride, and the pH was adjusted to 5.7.

The resulting high chloride tabular grain emulsion had an ECD of 1.86 μm and a mean grain thickness of 0.11 μm.

Emulsion 17E

This emulsion demonstrates that the addition of low levels of iodide ion during the growth stage of precipitation results in lower average tabular grain thicknesses.

This emulsion was precipitated identically to Emulsion 17D, except that the salt solution used during the accelerated growth stage and the final constant growth stage had a composition of 0.621M sodium chloride and 0.004M potassium iodide.

The resulting high chloride {100} tabular grain emulsion had an ECD of 1.8 μm and an average thickness of 0.09 μm.

EXAMPLE 18

This example demonstrates advantages for introducing bromide ion rapidly during {100} tabular grain formation.

Emulsion Precipitations

Emulsion 18A

Silver iodobromochloride {100} tabular emulsion having a bulk halide composition of 96.964 mole percent chloride, 0.036 mole percent iodide, and 3 mole percent bromide, with slow addition of bromide over 30 minutes at a pCl at 1.6.

A 1.5 L solution containing 3.52% by weight of low methionine gelatin, 0.0056M sodium chloride, and 0.3 mL of polyethylene glycol antifoamant provided in a stirred reaction vessel at 40° C. While the solution was vigorously stirred, 36 mL of a 0.01M potassium iodide solution was added followed by 50 mL of 1.25M silver nitrate and 50 mL of a 1.25M sodium chloride solution added simultaneously at a rate of 100 mL/min each. The mixture was then held for 10 seconds with the temperature remaining at 40° C. Following the hold, a 0.5M silver nitrate solution containing 0.08 mg mercuric chloride per mole of silver nitrate and a 0.5M sodium chloride solution were added simultaneously at 10 mL/min for 30 minutes followed by a linear acceleration from 10 mL/min to 15 mL/min over 125 minutes, while maintaining the pCl at 2.35. The pCl was then adjusted to 1.60 by delivering the 1.25M sodium chloride solution at 20 mL/min over 8 minutes followed by a 10 minute hold. A 0.5M potassium bromide solution was then added at 3.0 mL/min over 20 minutes. 50 g of phthalated gelatin was added and the emulsion was washed and concentrated using procedures of Yutzy et al U.S. Pat. No. 2,614,929. The pCl after washing was 2.0. Twenty-one grams of low methionine gelatin was added, the pCl was adjusted to 1.65 with sodium chloride, and the pH was adjusted to 5.7. The resulting emulsion was a {100} tabular grain emulsion had a mean ECD of 1.6 μm and a mean grain thickness of 0.125 μm.

Emulsion 18B

Silver iodobromochloride {100} tabular grain emulsion with a bulk halide composition of 96.964 mole percent chloride, 0.036 mole percent iodide, and 3 mole percent bromide with the bromide added rapidly at a pCl of 1.7.

This emulsion was precipitated identically to Emulsion 18A, except that at the end of the ramped growth portion, a 1.5M sodium chloride solution was added at 20 mL/min for 15 minutes followed by the addition of 1.0M silver nitrate at 5.0 mL/min for 30 minutes. This was followed by the addition of a 23 mL of 1.5M potassium bromide solution over about 1 second. The emulsion then held for 10 minutes. The emulsion was washed and concentrated with the same pCl and pH adjustments as in the precipitation of Emulsion 18A. The ECD of the emulsion grains 1.6 μm, and average grain thickness was 0.14 μm.

Emulsion 18C

Silver iodobromochloride {100} tabular grain emulsion with a bulk halide composition of 97.964 mole percent chloride, 0.036 mole percent iodide, and 2 mole percent bromide where the bromide was added slowly at a pCl of 1.6.

This emulsion was precipitated identically to Emulsion 18A, except that 0.625M silver nitrate and 0.625M sodium chloride solutions were used during the 30 minute constant flow growth and the 125 minute ramped flow growth. At the end of the ramped flow growth portion, a 1.25M sodium chloride solution was added at 20 mL/min for 7.5 minutes followed by a 10 minute hold. This was followed by the addition of a 60 mL of 0.5M potassium bromide solution over 20 minutes at 3 mL/min. The emulsion was washed and concentrated with the same pCl and pH adjustments as made in the preparation of Emulsion 1A. The emulsion grain ECD was 1.5 μm, and the average grain thickness was 0.12 μm.

Emulsion 18D

Silver iodobromochloride {100} tabular grain emulsion with a bulk halide composition of 97.964 mole percent chloride, 0.036 mole percent iodide, and 2 mole percent bromide with the bromide added rapidly at a pCl of 2.3.

This emulsion was precipitated identically to Emulsion 18A, except 0.625M silver nitrate and 0.625M sodium chloride solutions were used during the 30 minute constant flow growth and the 125 minute ramped flow growth. At the end of the ramped flow growth portion, a 1.25M sodium chloride solution was added at 20 mL/min for 7.5 minutes followed by a 10 minute hold. This was followed by the addition of the 1.25M silver nitrate solution at 5.0 mL/min for 30 minutes. This was followed by the addition of a 60 mL of 0.5M potassium bromide solution over about 1 second. The emulsion was then held for 20 minutes. The emulsion was washed and concentrated with the same pCl and pH adjustments as made in Emulsion 18A. The emulsion grain ECD was 1.8 μm, and the average grain thickness was 0.14 μm.

Emulsion 18E

Silver iodobromochloride {100} tabular emulsion with a bulk halide composition of 97.964 mole percent chloride, 0.036 mole percent iodide, and 2 mole percent bromide with the bromide added rapidly at a pCl of 1.6.

This emulsion was precipitated identically to Emulsion 18A, except that addition of 150 mL of 1.25M silver nitrate to adjust the pCl back to 2.3 before the addition of the potassium bromide was omitted so that potassium bromide solution was added at a pCl of 1.6. The emulsion was washed and concentrated with the same pCl and pH adjustments as made in Emulsion 18A. The emulsion grain ECD was 1.6 μm, and the average grain thickness was 0.13 μm.

Sensitization of Emulsions 18A and 18B to Produce Examples 18/1 through 18/4

The sensitizing procedure was as follows: A quantity of emulsion suitable for experimental coating was melted at 40° C. Red spectral sensitizing dye was then added at levels estimated from specific surface area measurements. The addition of each dye was followed by a 15 minute hold. The red sensitizing dyes were used as a set of two dyes. Set R-1 consisted of red spectral sensitizing dyes Dye SS-23 and SS-25 in the mole ratio of 8 parts SS-23 per part SS-25. Sodium thiosulfate pentahydrate at a level of 1.0 mg/mole Ag was then added followed by potassium tetrachloroaurate at 0.7 mg/mole Ag. The temperature of the well stirred mixture was then raised to 60° C. over 12 minutes and held at 60° C. for a specified time. The emulsion was then cooled to 40° C. as quickly as possible, and 70 mg/mole of APMT was then added and the emulsion was chill set.

Photographic Measurements

Each embodiment was coated on an antihalation support at 0.85 g/m$^2$ of silver with 1.08 g/m$^2$ of cyan dye-forming coupler C-1 and 2.7 g/m$^2$ of gelatin. This layer was overcoated with 1.6 g/m$^2$ of gelatin, and the entire coating was hardened with bis(vinylsulfonylmethyl)ether at 1.75 percent by weight of the total coated gelatin. Coatings were exposed through a step wedge for 0.02 second with a 3000° K. tungsten source through Daylight V and Kodak Wratten TM 2B filters. An additional set of coatings were also given a 0.02 sec exposure with a 365 nm line emission from a mercury vapor lamp. The coatings were processed in the Flexicolor TM C-41 color negative process.

TABLE IV

| Example | Emulsion | C-1 Dye level | 60° C. hold time | Dmin | Wr 2B Rsens | 365 Hg In. Rsens |
|---|---|---|---|---|---|---|
| 18/1 | 18A | 0.8 | 5 | 0.18 | 100 | 100 |
| 18/2 | 18A | 0.8 | 10 | 0.18 | 110 | 98 |
| 18/3 | 18B | 0.7 | 5 | 0.17 | 162 | 93 |
| 18/4 | 18B | 0.7 | 10 | 0.21 | 186 | 115 |

As demonstrated in Table IV, although Emulsion 18A provided thinner tabular grains and had a higher specific surface area, which allowed more sensitizing dye to be adsorbed, Emulsion 18B was significantly faster even though its projected area was the same and its intrinsic sensitivity as measured with the 365 Hg line exposure were about the same. This demonstrates that the spectral sensitization of Emulsion 18B was more efficient, which is in turn a function of the more rapid bromide addition described above.

Sensitization of Emulsions 18C though 18E to produce Examples 18/5 through 18/16

The sensitizing procedure was identical to that used for Examples 18/1 through 18/4 with the exception that Examples 18/11 through 18/16 used a different red sensitizing dye combination R-2, which consists of spectral sensitizing dye Dyes SS-23 and SS-25 in a molar ratio of 2 parts Dye SS-23 to 1 part of Dye SS-25.

Photographic Measurements

Coatings were prepared, exposed and process as described for Examples 18/1 through 18/4 above.

TABLE V

| Example | Emulsion | Dye type | 60° C. hold time | Dmin | Wr 2B Rsens | 365 Hg In. Rsens |
|---|---|---|---|---|---|---|
| 18/5 | 18C | R-1 | 5 | 0.10 | 100 | 100 |
| 18/6 | 18C | R-1 | 10 | 0.12 | 138 | 155 |
| 18/7 | 18D | R-1 | 5 | 0.08 | 295 | 200 |
| 18/8 | 18D | R-1 | 10 | 0.09 | 263 | 186 |
| 18/9 | 18E | R-1 | 5 | 0.11 | 309 | 174 |
| 18/10 | 18E | R-1 | 10 | 0.11 | 331 | 178 |
| 18/11 | 18C | R-2 | 5 | 0.11 | 186 | 151 |
| 18/12 | 18C | R-2 | 10 | 0.23 | 257 | 186 |
| 18/13 | 18D | R-2 | 5 | 0.16 | 380 | 255 |
| 18/14 | 18D | R-2 | 10 | 0.21 | 447 | 263 |
| 18/15 | 18E | R-2 | 5 | 0.20 | 209 | 138 |
| 18/16 | 18E | R-2 | 10 | 0.19 | 219 | 129 |

Examples 18/5 through 18/10 of Table V show that Emulsions 18D and 18E, to which the bromide was added rapidly as compared to Emulsion 18C, show both improved spectral (Kodak Wratten TM 2B filter) sensitivity as well as improved intrinsic sensitivity (365 Hg line exposure). The fact that the spectral sensitivity increases are larger than the intrinsic sensitivity increases shows that the bromide band formed by rapid addition improves the interaction with the spectral sensitizing dyes so that transfer of the photoelectron from the excited sensitizing dye to the silver halide grain is more efficient.

Examples 18/11 though 18/16 show that this favorable interaction between emulsions with a high bromide band formed by rapid bromide addition and spectral sensitizing dyes is dependent on both the sensitizing dyes used and the pCl used for precipitation of the bromide band. Note that Emulsion D, the bromide band of which was precipitated at a pCl of 2.35, again showed much higher spectral and intrinsic speed relative to Emulsion 18C (slow bromide addition), but Emulsion 18E, to which bromide was rapidly added at a pCl of 1.6, exhibited a speed in the region of spectral sensitization intermediate that of Emulsion 18C (slow bromide addition) and preferred examples Emulsion 18D.

From the examples that high chloride {100} tabular grain emulsions with bromide bands generally perform better when the bromide source is added rapidly. The performance of these emulsions is further enhanced in some cases when the rapid bromide addition is carried out at pCl values where the excess chloride ion in solution is relatively low.

EXAMPLE 19

This example has as its purpose to demonstrate the effectiveness of various ripening agents in increasing the percentage of total grain projected area accounted for by {100} tabular grains.

Emulsion 19A: Control Emulsion

Solutions

Solution A: 4M silver nitrate solution.

Solution B: 4M sodium chloride solution.

Solution C: 0.012M potassium iodide solution.

Solution D: 6.5 L of distilled water containing 2.1 g of sodium chloride.

Solution E: 2.865 L of distilled water containing 0.96 g sodium chloride, 25 g of gelatin and 90 mL of solution C.

Precipitation

Solution E was charged in a reaction vessel equipped with stirrer. The content of the vessel was maintained at pH 6.5 and 55 ° C. While the solution was vigorously stirred, solutions A and B were added at 120 mL/min. each for 30 seconds.

Solution D was then added to the mixture. At the same time the mixture temperature was raised to 62° C., pCl adjusted to 1.91, and pH was maintained at 6.5 throughout the precipitation process. The mixture was then allowed to sit for 5 min. Following the hold, solutions A and B were then added simultaneously at linearly accelerated rates from 10 mL/min to 24 mL/min in 56 min. with the pCl maintained at 2.14.

The resulting emulsion had 50 % of its total grain projected area accounted for by {100} tabular grains having a mean ECD of ca. 1.4 μm and a mean aspect ratio of 8. The emulsion contained a large quantity of fine grains.

Emulsion 19B

Methionine as a growth accelerator.

Solution AA 4M silver nitrate containing 2325 ppm of methionine.

Precipitation

This emulsion was precipitated the same way as emulsion 19A, except that solution AA was used, instead of solution A, for the growth period (the period after the hold). The resulting emulsion was essentially free of fine particle with greater than 65% of total grain projected area accounted for by {100} tabular grains having a mean thickness of 0.16 μm and a mean ECD of 1.5 μm.

Emulsion 19C 1,10-Dithia-4,7,13,16-tetraoxacyclodecane as a growth accelerator.

This emulsion was the same as Emulsion 19B, except that Solution AA, instead of containing methionine, contained 1162 ppm of 1,10-dithia-4,7,13,16-tetraoxacyclodecane. The resulting emulsion was essentially free of fine particles with greater than 65 % of its total grain projected area accounted for by {100} tabular grains having a mean thickness of 0.14 μm and a mean ECD of 1.2 μm.

Emulsion 19D 1,8-Dihydroxy-3,6-dithiaoctane as a growth accelerator.

This emulsion was the same as Emulsion 19B

Solution AA, instead of containing methionine, contained 23 ppm of 1,8-dihydroxy-3,6-dithiaoctane. The resulting emulsion was essentially free of fine particles with greater than 65 % of total grain projected area accounted for by {100} tabular grains having a mean thickness of 0.14 μm and a mean ECD of 1.2 μm.

Emulsion 19E 2,5-Dithiasuberic acid as a growth accelerator.

This emulsion was the same as Emulsion 19B, except that Solution AA, instead of containing methionine, contained 58 ppm of 2,5-dithiasuberic acid. The resulting emulsion was essentially free of fine particles with greater than 65 % of total grain projected area accounted for by {100} tabular grains having a mean thickness of 0.13 μm and a mean ECD of 1.2 μm.

Emulsion 19F

Glycine as a growth accelerator.

This emulsion was the same as Emulsion 19B, except that Solution AA, instead of containing methionine, contained 5813 ppm of glycine. The resulting emulsion was essentially free of fine particles with greater than 70 % of total grain projected area accounted for by {100} tabular grains having a mean thickness of 0.14 μm and a mean ECD of 1.1 μm.

Emulsion 19G

Sodium sulfite as a growth accelerator.

This emulsion was the same as Emulsion 19B, except that Solution AA, instead of containing methionine, contained 174 ppm of sodium sulfite. The resulting emulsion was essentially free of fine particles with greater than 65% of total grain projected area accounted for by {100} tabular grains having a mean thickness of 0.14 μm and ECD of 1.2 μm.

Emulsion 19H

Thiocyanate as a growth accelerator.

This emulsion was the same as Emulsion 19B, except that Solution AA, instead of containing methionine, contained 79 ppm of sodium thiocyanate. The resulting emulsion was essentially free of fine particles with greater than 65% of total grain projected area being accounted for by {100} tabular grains having a mean thickness of 0.15 μm and a mean ECD of 1.1 μm.

Emulsion 19I

Imidazole as a growth accelerator.

This emulsion was the same as Emulsion 19B, except that Solution AA, instead of containing methionine, contained 581 ppm of imidazole. The resulting emulsion was essentially free of fine particles with greater than 60% of total grain projected area being accounted for by {100} tabular grains having a mean thickness of 0.14 μm and ECD of 1.4 μm.

EXAMPLES 20 TO 23

Iridium dopants in concentrations of from $1\times10^{-9}$ to $1\times10^{-6}$, preferably $1\times10^{-8}$ to $1\times10^{-7}$, mole per silver mole are contemplated for the purpose of reducing reciprocity failure in the emulsions of the invention. Photographic exposure is the product of exposure intensity and exposure time (see equation II above). Reciprocity failure is the term applied to failures of equal exposures to produce the same photographic response when they are constituted by different exposure intensities and times. Iridium dopants are particularly contemplated to reduced low intensity reciprocity failure (LIRF)—that is, departures from exposure reciprocity in the exposure time range of from $10^{-2}$ to 10 seconds.

EXAMPLE 20

Emulsion 20A

Silver chloride {100} tabular grain emulsion with potassium hexachloroiridate added after 0% of the precipitation to give a bulk concentration of 0.05 mg/mole of emulsion.

A 4900 mL solution containing 3.52% by weight of low methionine gelatin, 0.0056M sodium chloride and 1.0 mL of polyethylene glycol antifoamant provided in a stirred reaction vessel at 40 C. While the solution was vigorously stirred, 149 mL of a 0.01M potassium iodide solution was added followed by 95 mL of 1.25M silver nitrate and 95 mL of a 1.25M sodium chloride solution added simultaneously at a rate of 180 mL/min each. The mixture was then held for 10 seconds with the temperature remaining at 40° C. Following the hold, a 0.5M silver nitrate solution and a 0.5M sodium chloride solution were added simultaneously at 25 mL/min for 40 minutes followed by a linear acceleration from 25 mL/min to 40.3 mL/min over 107 minutes, while maintaining the pCl at 2.35. At this point 30 mL of a solution containing 5.12 mg potassium hexachloroiridate per liter was added over a 1.2 minute period while the 0.5M silver and salt solutions continued to run from 40.3 to 40.5 mL/min. Following the addition of the iridium salt, the addition of the 0.5M silver nitrate and the 0.5M sodium chloride solutions was continued for 33.0 minutes with the flow rates linearly ramped from 40.5 mL/min to 45.0 mL/min. The pCl was then adjusted to 1.65 with sodium chloride then the emulsion was washed and concentrated using ultrafiltration to a pCl of 2.0. 16 g of low methionine gelatin was added then the pCl was adjusted to 1.65 with sodium chloride and the pH to 5.7. The resulting emulsion was a tabular grain silver chloride emulsion containing 0.048 mole percent iodide and had a mean ECD of 1.64 μm and a mean grain thickness of 0.146 μm.

Emulsion 20B

Silver chloride {100} tabular grain emulsion with potassium hexachloroiridate added after 80% of the precipitation to give a bulk concentration of 0.005 mg/mole of emulsion.

This emulsion was prepared identically to Emulsion 20A, except that the solution containing the iridium salt had a concentration of 0.512 mg potassium hexachloroiridate per liter. The resulting emulsion was a tabular grain silver chloride emulsion containing 0.048 mole percent iodide and had a mean ECD of 1.8 μm and a mean grain thickness of 0.148 μm.

Emulsion 20C

Silver chloride {100} tabular grain emulsion lacking an iridium dopant.

This emulsion was prepared identically to emulsion A except no iridium salt solution was added. The resulting emulsion was a tabular grain silver chloride emulsion containing 0.048 mole percent iodide and had a mean equivalent circular grain diameter of 1.7 μm and a mean grain thickness of 0.145 μm.

Sensitization

Type I Embodiments 1 through 26

This type of sensitization used sodium thiosulfate pentahydrate and potassium tetrachloroaurate as chemical sensitizing agents. A variety of sensitization embodiments were prepared where the level of potassium bromide, the type of sensitizing dye and the hold time at 60° C. were varied.

The sensitizing procedure was as follows: A quantity of emulsion suitable for experimental coating was melted at 40° C. Potassium bromide was added followed by a total of 0.7 mmol of green or red sensitizing dye per mole of emulsion. The green spectral sensitizing dye consisted of a Dye SS-21. The red sensitizing dyes were used as a set of two dyes. Set R-1 consisted of red spectral sensitizing dyes Dye SS-23 and Dye SS-24 in the ratio of 8 parts SS-23 to 1 part SS-24. Set R-2 consisted of Dye SS-23 and Dye SS-25 in the ratio of 2 parts Dye SS-23 to 1 part Dye SS-25. The dye addition was followed by a 20 minute hold. One mg pr mole of sodium thiosulfate pentahydrate, and 0.7 mg/mole of potassium tetrachloroaurate were then added. The temperature of the well stirred mixture was then raised to 60° C. over 12 minutes and held at 60° C. for a specified time. The emulsion was then cooled to 40° C. as quickly as possible and 70 mg/mole of APMT was then added and the emulsion was chill set.

TABLE VI

| Embodiment | Emulsion | KBr Level mg/mole | Dye Type | hold time minutes |
|---|---|---|---|---|
| 1 | 20C | 1200 | SS-21 | 5 |
| 2 | 20C | 1200 | SS-21 | 10 |
| 3 | 20C | 1200 | R-1 | 5 |
| 4 | 20C | 1200 | R-1 | 10 |
| 5 | 20C | 2400 | R-1 | 5 |
| 6 | 20C | 2400 | R-1 | 10 |
| 7 | 20C | 1200 | R-2 | 5 |
| 8 | 20C | 1200 | R-2 | 10 |
| 9 | 20C | 2400 | R-2 | 5 |
| 10 | 20C | 2400 | R-2 | 10 |
| 11 | 20A | 1200 | SS-21 | 5 |
| 12 | 20A | 1200 | SS-21 | 10 |
| 13 | 20A | 1200 | R-1 | 5 |
| 14 | 20A | 1200 | R-1 | 10 |
| 15 | 20A | 2400 | R-1 | 5 |
| 16 | 20A | 2400 | R-1 | 10 |
| 17 | 20A | 1200 | R-2 | 5 |
| 18 | 20A | 1200 | R-2 | 10 |
| 19 | 20A | 2400 | R-2 | 5 |

TABLE VI-continued

| Embodiment | Emulsion | KBr Level mg/mole | Dye Type | hold time minutes |
|---|---|---|---|---|
| 20 | 20A | 2400 | R-2 | 10 |
| 21 | 20C | 1200 | SS-21 | 5 |
| 22 | 20C | 1200 | SS-21 | 10 |
| 23 | 20A | 1200 | SS-21 | 5 |
| 24 | 20A | 1200 | SS-21 | 10 |
| 25 | 20B | 1200 | SS-21 | 5 |
| 26 | 20B | 1200 | SS-21 | 10 |

TYPE II—Embodiment Numbers 27 Through 30

This type of sensitization used a colloidal aurous sulfide suspension as the chemical sensitizing agent added after the addition of sensitizing dye and potassium bromide.

The general sensitizing procedure was as follows: A quantity of emulsion suitable for experimental coating was melted at 40° C. Embodiments 27 and 28 used emulsion C and embodiments 29 and 30 used emulsion A. 0.7 mmol/mole Ag of green sensitizing SS-21 was added to each emulsion. The dye addition was followed by a 20 min hold. 600 mg/mole of potassium bromide was then added to embodiments 24 and 26 followed by a 10 minute hold. 2.5 mg/mole of aurous sulfide was then added followed by a 5 minute hold. The temperature of the well stirred mixture was then raised to 60° C. over 12 minutes and held at 60° C. for 30 minutes. The emulsion was then cooled to 40° C. as quickly as possible and 90 mg/mole of APMT was then added and the emulsion was chill set.

TYPE III—Embodiment Numbers 31 Through 34

This type of sensitization used a colloidal aurous sulfide suspension as the chemical sensitizing agent added at 40° C. before the addition of the sensitizing dye.

The general sensitizing procedure was as follows. A quantity of emulsion suitable for experimental coating was melted at 40° C. Embodiments 31 and 32 used emulsion C and embodiments 33 and 34 used emulsion A. 0.25 mg/mole g of aurous sulfide was added followed by a 5 minute hold. In embodiments 27 and 29 the temperature was ramped to 60° C. over 12 minutes and held at 60° C. for 30 minutes then ramped back to 40° C. over 12 minutes. Embodiments 28 and 30 were held constant at 40° C. during this same time. 0.7 mmol/mole Ag of sensitizing dye SS-21 was added to each emulsion followed by a 20 min hold and the addition of 90 mg/mole of APMT followed by chill set.

Photographic Results

Each embodiment was coated on an antihalation support at 0.85 g/m$^2$ of silver with 1.08 g/m$^2$ of cyan dye forming coupler C and 2.7 g/m$^2$ of gelatin. This layer was overcoated with 1.6 g/m$^2$ of gelatin and the entire coating was hardened with bis(vinylsulfonylmethyl)ether at 1.75% of the total coated gelatin. Coatings were exposed with a Xenon lamp filtered with a Kodak Wratten TM 2B filter. The intensity of the lamp was varied with inconel filter so that different exposure times received the same total exposure. The coatings were processed in a Kodak Flexicolor TM C-41 process.

TABLE VII

| Embodiment | Emulsion | Iridium Level mg/mole Ag | $10^{-4}$–10 sec sensitivity difference | $10^{-2}$–10 sec sensitivity difference |
|---|---|---|---|---|
| 1 | 20C | 0 | 32 | 20 |
| 2 | 20C | 0 | 32 | 32 |
| 3 | 20C | 0 | 10 | 29 |
| 4 | 20C | 0 | 12 | 26 |
| 5 | 20C | 0 | 17 | 38 |
| 6 | 20C | 0 | 0 | 35 |
| 7 | 20C | 0 | 51 | 51 |
| 8 | 20C | 0 | 45 | 41 |
| 9 | 20C | 0 | 58 | 41 |
| 10 | 20C | 0 | 51 | 45 |
| 11 | 20A | 0.05 | 38 | 17 |
| 12 | 20A | 0.05 | 29 | 20 |
| 13 | 20A | 0.05 | 10 | 10 |
| 14 | 20A | 0.05 | −7 | 7 |
| 15 | 20A | 0.05 | 26 | 12 |
| 16 | 20A | 0.05 | 23 | 10 |
| 17 | 20A | 0.05 | 7 | 7 |
| 18 | 20A | 0.05 | 10 | 5 |
| 19 | 20A | 0.05 | 17 | 5 |
| 20 | 20A | 0.05 | 15 | 7 |
| 21 | 20C | 0 | 45 | 29 |
| 22 | 20C | 0 | 45 | 29 |
| 23 | 20A | 0.05 | 23 | 2 |
| 24 | 20A | 0.05 | 15 | 2 |
| 25 | 20B | 0.005 | 45 | 5 |
| 26 | 20B | 0.005 | 41 | 7 |
| 27 | 20C | 0 | 66 | 74 |
| 28 | 20C | 0 | 2 | 48 |
| 29 | 20A | 0.05 | 20 | 12 |
| 30 | 20A | 0.05 | 20 | 20 |
| 31 | 20C | 0 | 209 | 104 |
| 32 | 20C | 0 | 35 | 48 |
| 33 | 20A | 0.05 | 23 | 29 |
| 34 | 20A | 0.05 | 7 | 20 |

Comparing the iridium containing embodiments with the embodiments lacking iridium, it can be seen that the iridium containing emulsion show improved reciprocity for both the overall $10^{-4}$ to 10 sec range as well as the $10^{-2}$ to 10 second (low intensity) range. Furthermore by investigating the effects of the iridium over a wide range of sensitizations, it can be seen that the iridium improves the robustness of the reciprocity behavior as a function of the extent of finish.

EXAMPLES 21 AND 22

These examples demonstrate the effectiveness of iridium as a dopant to reduce low intensity reciprocity failure (LIRF) when the iridium is located very near the grain surface. In these examples LIRF was measured by comparing 1/10 and 10 second exposures. Three individual silver iodochloride {100} tabular grain emulsions were prepared for use in these examples. Table VIII describes the grain dimensions and iodide content.

TABLE VIII

| Emulsion | Iodide % | Average Thickness (μm) | Average ECD (μm) |
|---|---|---|---|
| S-1 | 0.04 | 0.15 | 1.48 |
| S-2 | 0.07 | 0.13 | 1.43 |
| S-3 | 0.07 | 0.12 | 1.45 |

The dopants used in combination with the emulsions S-1, 2 and 3 to improve LIRF are given in Table IX.

TABLE IX

| Dopant | Chemical Formula |
|---|---|
| D-1 | $K_3IrCl_6$ |
| D-2 | $K_4Ir_2Cl_{10}$ |

TABLE IX-continued

| Dopant | Chemical Formula |
|---|---|
| D-3 | $K_6Ir_6Cl_{24}$ |

The examples that follow describe the use of these dopants in various amounts and in various locations during the sensitization of emulsions S-1 to S-3.

The sensitized emulsions were coated onto cellulose acetate film support. The coating format was an emulsion layer comprised of 200 mg/ft$^2$ (21.5 mg/dm$^2$) of the tabular silver chloride emulsion dispersed in 500 mg/ft$^2$ (53.8 mg/dm$^2$) of gelatin; an overcoat comprised of 100 mg/ft$^2$ (10.8 mg/dm$^2$) gelatin and a hardener, bis(vinylsulfonylmethyl)ether at a level of 0.5% by weight, based on total gelatin.

The coated photographic elements were evaluated for reciprocity response by giving them a series of calibrated (total energy) exposures ranging from 1/10 of a second to 10 seconds. The exposed film was processed for 6 minutes in a hydroquinone-Elon TM (p-N-methylaminophenol hemisulfate) developer.

EXAMPLE 21

This example demonstrates the usefulness of dopant D-2 added during spectral sensitization by means of a pCl cycle which is comprised of sequential addition of chloride ion, D-2, and silver ion. The introduction of the dopant in the pCl cycle produces an emulsion with improved LIRF behavior as compared to either an emulsion that is spectrally sensitized without use of the dopant or the pCl cycle or an emulsion that is spectrally sensitized with the pCl cycle, but with the dopant omitted, where the emulsions are otherwise the same.

Emulsion S-1 was spectrally sensitized by treating a portion with 550 mg per mole of silver of blue spectral sensitizing dye Dye SS-1 followed by heat digestion. APMT was added thereafter at an amount of mg per silver mole. This represents the control emulsion.

Other portions of S-1 were spectrally sensitized in a similar manner, except that a pCl cycle of 2 mole % chloride ion and D-2 addition followed by 2 mole % silver ion addition was performed to effect the incorporation of D-2. Such a pCl cycle was accomplished either before or after the treatment of S-1 with the sensitizing dye. These samples constitute examples of the invention.

A final example was prepared in which a pCl cycle without dopant was performed to demonstrate the effect of the 2 mole % cycle, free of any dopant effects.

Table X summarizes the photographic results of various amounts of D-2 added via a pCl cycle technique.

TABLE X

| Ex. 21 Part # | cycle before/after dye | D-2 microgram. per mole | Speed 365 nm | Speed whitelight | LIRF |
|---|---|---|---|---|---|
| 21/1 | none | none | 160 | 160 | 30 |
| 21/2 | after | none | 171 | 158 | 23 |
| 21/3 | after | 15 | 164 | 151 | 23 |
| 21/4 | after | 50 | 150 | 134 | 8 |
| 21/5 | after | 100 | 150 | 134 | 5 |
| 21/6 | before | 15 | 169 | 160 | 18 |
| 21/7 | before | 50 | 161 | 152 | 15 |
| 21/8 | before | 100 | 161 | 152 | 13 |

From Table X it is apparent that the use of D-2 reduces LIRF of the emulsion. Speed as reported in Tables X, XI, XIII and XXIII is 100 times the log of the exposure required to provide a density of 0.15 above the minimum density.

EXAMPLE 22

This example demonstrates the usefulness of dopants D-1, D-2 and D-3 in reducing LIRF when added via a pCl cycle technique to the spectral and chemical sensitization of emulsions S-2 and S-3.

Separate portions of S-2 and S-3 were spectrally and chemically sensitized by treating each portion with 550 mg per mole of silver of blue spectral sensitizing dye Dye SS-1 followed by a heat digestion. Then 2 mg per mole of a colloidal gold sulfide reagent were added followed by heat digestion for 30 minutes at 60° C. Thereafter, the temperature was adjusted to 40° C., and 90 mg per mole of APMT were added. The resulting parts represent the undoped emulsions for comparison to the doped emulsions.

Another undoped example was prepared in a similar manner, except a 2 mole % pCl cycle consisting of chloride ion followed by silver ion was performed after the dye addition and digestion steps, but before the chemical sensitization step.

Other portions were spectrally and chemically sensitized, given a pCl cycle with various amounts of dopant added, then treated with APMT as described above.

The photographic results showing the LIRF improvements of the parts containing the dopants D-1, D-2 and D-3 is documented in Table XI. Also noteworthy is the significant speed increases that are obtained with certain amounts of D-1 and D-3.

TABLE XI

| Ex. 22 Part # | Emulsion | vAg cycle | Dopant | Amount µg/mole Ag | White light speed | LIRF |
|---|---|---|---|---|---|---|
| 22/1 | S-2 | none | none | 0 | 221 | 25 |
| 22/2 | S-2 | Yes | none | 0 | 231 | 19 |
| 22/3 | S-2 | Yes | D-2 | 1500 | 205 | 6 |
| 22/4 | S-2 | Yes | D-2 | 5000 | 155 | 4 |
| 22/5 | S-3 | none | none | 0 | 221 | 20 |
| 22/6 | S-3 | Yes | D-1 | 15 | 231 | 12 |
| 22/7 | S-3 | Yes | D-1 | 50 | 230 | 8 |
| 22/8 | S-3 | Yes | D-1 | 100 | 233 | 14 |
| 22/9 | S-3 | Yes | D-1 | 200 | 218 | 12 |
| 22/10 | S-3 | Yes | D-3 | 5 | 243 | 9 |
| 22/11 | S-3 | Yes | D-3 | 15 | 265 | 4 |
| 22/12 | S-3 | Yes | D-3 | 50 | 239 | 2 |
| 22/13 | S-3 | Yes | D-3 | 100 | 230 | 1 |

EXAMPLE 23

This example demonstrates the effectiveness of iridium to reduce LIRF when incorporated during precipitation with a silver bromide Lippmann emulsion.

The host high chloride {100} tabular grain emulsion employed Emulsion S-3, described in Example 23.

Lippmann silver bromide emulsions (of approximately 0.08 µm edge length) were prepared with and without incorporated dopants. Table XII lists the Lippmann emulsions used and the dopant type and amount contained in each emulsion. By blending doped and undoped Lippmann emulsions a variety of dopant concentrations were available for incorporation onto the host AgCl {100} tabular grain emulsion.

TABLE XII

| Lippmann Emulsion | Size (µm) | Dopant Formula | Dopant abbreviation | Amount MPPM |
|---|---|---|---|---|
| L-1 | 0.08 | undoped | — | 0 |
| L-2 | 0.09 | $K_3IrCl_6$ | D-1 | 200 |
| L-3 | 0.09 | $K_4Ir_2Cl_{10}$ | D-2 | 100 |

Portions of host emulsion S-3 were spectrally and chemically sensitized by treating each portion with 550 mg per mole of silver of blue spectral sensitizing dye Dye SS-1 followed by a heat digestion. Two mg per silver mole of a colloidal gold sulfide reagent were added followed by heat digestion for 30 minutes at 60° C. Thereafter, the temperature was adjusted to 40° C. and 90 mg per silver mole of APMT were added. The resulting parts represent the undoped emulsions provided for comparison.

Another comparative emulsion was prepared in a similar manner to that described above, except that 2 mole % of an undoped Lippmann silver bromide emulsion were added after the colloidal gold sulfide and heat digestion. Once the Lippmann emulsion was added an additional heat digestion of 10 minutes at 60° C. was performed. Then the temperature was lowered to 40° C., and 90 mg per silver mole of APMT was added. This comparative example was provided to demonstrate the effect of an undoped Lippman bromide on the S-3 host emulsion.

Other portions of the S-3 host emulsion were sensitized as the above comparative example, except that doped Lippmann silver bromide emulsions or blends of doped and undoped Lippmann silver bromide emulsions were added and digested for 10 minutes at 60° C. Table XIII shows the LIRF benefit when the doped Lippmann additions were made.

Coating, exposure and process were undertaken as described in Example 22.

TABLE XIII

| Ex. 23 Part # | 2% Lippmann bromide | Dopant Type | Amount of dopant (PPM) | White light speed | LIRF |
|---|---|---|---|---|---|
| 23/1 | none | none | 0 | 221 | 20 |
| 23/2 | Yes | none | 0 | 233 | 20 |
| 23/3 | Yes | D-1 | 0.8 | 230 | 16 |
| 23/4 | Yes | D-1 | 2.0 | 238 | 10 |
| 23/5 | Yes | D-1 | 4.0 | 244 | 12 |
| 23/6 | Yes | D-2 | 0.4 | 237 | 17 |
| 23/7 | Yes | D-2 | 1.0 | 231 | 15 |
| 23/8 | Yes | D-2 | 2.0 | 239 | 11 |

As demonstrated in Table XIII, the treatment of the high chloride {100} tabular grain host emulsion with iridium doped Lippmann silver bromide emulsions results in a significant reduction in LIRF.

EXAMPLE 24

Compounds that release selenium, such as potassium selenocyanate, can be used to sensitize high chloride {100} tabular grain emulsions, both as a replacement for sulfur and as an enhancement to a sulfur and gold sensitization. Advantages include lower fog at similar speed and high speed at equal fog

Emulsion Precipitation

Silver iodochloride {100} tabular grain emulsion with a bulk halide composition of 99.954% chloride and 0.048% iodide on a mole basis.

A 4900 mL solution containing 3.52% by weight of low methionine gelatin, 0.0056M sodium chloride and 1.0 mL of polyethylene glycol antifoamant provided in a stirred reaction vessel at 40° C. While the solution was vigorously stirred, 149 mL of a 0.01M potassium iodide solution was added followed by 95 mL of 1.25M silver nitrate and 95 mL of a 1.25M sodium chloride solution added simultaneously at a rate of 180 mL/min each. The mixture was then held for 10 seconds with the temperature remaining at 40° C. Following the hold, a 0.5M silver nitrate solution and a 0.5M sodium chloride solution were added simultaneously at 25 mL/min for 40 minutes followed by a linear acceleration from 25 mL/min to 45 mL/min over 140 minutes, while maintaining the pCl at 2.35. The pCl was then adjusted to 1.65 with sodium chloride, then the emulsion was washed and concentrated using ultrafiltration to a pCl of 2.0. Sixteen grams of low methionine gelatin were added, then the pCl was adjusted to 1.65 with sodium chloride, and the pH was adjusted to 5.7.

The resulting emulsion was a silver chloride {100} tabular grain emulsion containing 0.048 mole percent iodide that had a mean grain ECD 1.64 μm and a mean grain thickness of 0.146 μm.

Sensitization

Samples of the emulsion were melted at 40° C. Potassium bromide was added followed by a total of 0.7 mmol of green spectral sensitizing dye SS-21 per mole of emulsion. The dye addition was followed by a 20 min hold. Sodium thiosulfate pentahydrate was then added (to some samples only) followed by 0.7 mg/Ag mole of potassium tetrachloroaurate. This was followed by the addition of potassium selenocyanate (to some samples only). The temperature of the well stirred mixture was then raised to 60° C. over 12 minutes and held at 60° C. for a specified time. The emulsion was cooled to 40° C. as quickly as possible, 70 mg/mole of APMT was added, and the emulsion samples were chill set.

A sample of each emulsion was coated on a support having an antihalation backing at 0.85 g/m$^2$ of silver with 1.08 g/m$^2$ of cyan dye-forming coupler C-1 and 2.7 g/m$^2$ of gelatin. The emulsion layer was overcoated with 1.6 g/m$^2$ of gelatin, and the entire coating was hardened with bis(vinylsulfonylmethyl) ether at 1.75 percent by weight of the total coated gelatin.

Photographic Evaluation

The photographic elements were exposed for 1/50 second through a step wedge with a tungsten lamp filtered with a Kodak Wratten TM 2B filter. The coatings were processed in the Kodak Flexicolor TM C-41 color negative process.

TABLE XIV

| Sample | $Na_2S_2O_3$ level mg/ Ag mole | KSeCN level mg/ Ag mole | 60° C. hold time min. | Red Rsens | Dmin |
|---|---|---|---|---|---|
| 24 A | 1.0 | 0 | 5 | 100 | 0.32 |
| 24 B | 1.0 | 0 | 10 | 95 | 0.21 |
| 24 C | 0.5 | 0 | 5 | 63 | 0.26 |
| 24 D | 0.5 | 0 | 10 | 51 | 0.16 |
| 24 E | 0 | 0.6 | 5 | 52 | 0.14 |
| 24 F | 0 | 0.6 | 10 | 56 | 0.17 |
| 24 G | 1.0 | 0.6 | 5 | 87 | 0.16 |
| 24 H | 1.0 | 0.6 | 10 | 112 | 0.26 |

The samples containing selenium included the sample that produced the lowest minimum density and the sample that produced the highest sensitivity. Overall, it is apparent that the use of selenium improved performance when both sensitivity and minimum density were taken in account.

EXAMPLE 25

This example demonstrates the effect of introducing $K_2Ru(CN)_6$ during precipitation as a grain dopant.

A silver iodochloride (0.05 mole percent iodide) {100} tabular grain emulsion according to the invention was prepared in which 10 mppm of $K_2Ru(CN)_6$ was added along with the silver accounting for the segment of the run between 85 and 95 percent of total silver added. In the resulting emulsion greater than percent of total grain projected area was accounted for by tabular grains having {100} major faces. The mean grain ECD was 1.44 μm and mean grain thickness was 0.147 μm. The emulsion was washed by ultrafiltration, and its pH and pCl were adjusted to 5.6 and 1.6, respectively. This emulsion is hereafter designated Emulsion 25/D.

A comparison emulsion, hereinafter designated Emulsion 25/UD was similarly precipitated, except that the $K_2Ru(CN)_6$ dopant was omitted during the precipitation. In the resulting emulsion greater than 0 percent of total grain projected area was accounted for by tabular grains having {100} major faces. The mean grain ECD was 1.61 μm and mean grain thickness was 0.150 μm. The emulsion was washed by ultrafiltration, and its pH and pCl were adjusted to 5.6 and 1.6, respectively.

Each emulsion was combined with a yellow dye-forming coupler stabilized with benzenosulfonic acid. Each emulsion was coated at 2.8 mg/dm$^2$ silver, 0.8 mg/dm$^2$ dye-forming coupler, and 8.3 mg/dm$^2$ gelatin on a resin coated paper support.

Samples of the emulsion coatings were given equal exposures at 100, ½ and 1/100 second. HIRF was measured as a difference between photographic speed at 1/100 and ½ second exposures, while LIRF was measured as a difference between photographic speed at 100 and ½ second exposures. Latent image keeping was measured as a speed difference between strips developed at 30 seconds and 30 minutes after exposure. Heat sensitivity was measured as a speed difference between exposures at 40° C. and room temperature. The rapid access Kodak RA-4 TM process was used.

While both emulsions demonstrated photographic utility, the principal advantage for Emulsion 25/D over Emulsion 25/UD was found in faster speed, improved toe sharpness and higher contrast at comparable latent image keeping and heat sensitivity levels. Emulsion 25/D also exhibited higher sensitivity at shorter exposure times and lower sensitivity at longer exposure times, both of which can be advantageous for particular photographic uses.

EXAMPLE 26

This examples has as its purpose to demonstrate the effectiveness of iron hexacyanide as a dopant in high chloride (100) tabular grain emulsions to reduce high intensity reciprocity failure (HIRF).

EMULSION 26/1

Six solutions were prepared as follows:

| Solution 1 (26/1) | |
|---|---|
| Gelatin (bone) | 211 g |
| NaCl | 1.96 g |
| D.W. | 5800 mL |

-continued

| | |
|---|---|
| Solution 2 (26/1) | |
| KI | 0.15 g |
| D.W. | 90 mL |
| Solution 3 (26/1) | |
| NaCl | 207 g |
| D.W. | 7000 mL |
| Solution 4 (26/1) | |
| NaCl | 13.1 g |
| D.W. | 108 mL |
| Solution 5 (26/1) | |
| $AgNO_3$ soln. 5.722 molar | 922 g |
| D.W. | 5425 mL |
| Solution 6 (26/1) | |
| $AgNO_3$ soln. 5.722 molar | 922 g |
| D.W. | 73.7 mL |
| Solution 7 (26/1) | |
| Gelatin (phthalated) | 100 g |
| D.W. | 1000 mL |
| Solution 8 (26/1) | |
| Gelatin (bone) | 80 g |
| D.W. | 1000 mL |

Solution 1 (26/1) was charged into a reaction vessel equipped with a stirrer at 40° C. Solution 2 (26/1) was added to the reaction vessel, and the pH was adjusted to 5.7. While vigorously stirring the reaction vessel, Solution 4 (26/1) and Solution 6 (26/1) were added at 180 mL/min. for 30 seconds. The reaction vessel was held for 10 min. Following this hold, Solution 3 (26/1) and Solution 5 (26/1) were added simultaneously at 24 mL/min. for 40 minutes with the pCl maintained at 1.91. The rate was then accelerated to 48 mL/min. over 130 minutes. The mixture was then cooled to 40° C. and Solution 7 (26/1) added and stirred for 5 minutes. The pH was then adjusted to 3.8 and the gel allowed to settle. At the same time the temperature was dropped to 15° C. before decanting the liquid layer. The depleted volume was restored with D.W. The pH was adjusted to 4.5, and the mixture held at 40° C. for 20 minutes before the pH was adjusted to 3.8 and the settling and decanting steps repeated. Solution 8 (26/1) was added and the pH and pCl adjusted to 5.6 and the pCl to 1.6, respectively.

EMULSION 26/2

A second emulsion (26/2) was prepared like the first emulsion (26/1), but with 36 mg $K_4Fe(CN)_6$ in 278 gm of a solution otherwise like Solution 3 (26/1) added at 4 mL/min at the same time as Solutions 3 and 5 were accelerated. This addition lasted for 70 min.

Emulsions 26/1 and 26/2 were finished by treating them with 0.5 % NaBr holding for 5 minutes, adding a combination of spectral sensitizing dyes (Dye SS-21 and Dye SS-26 in a 3:1 molar ratio), holding for 10 minutes, adding $Na_2S_2O_3.5H_2O$ at 1.2 mg/mole and $KAuCl_4$ at 1.6 mg/mole and heating for 10 minutes at 60° C. APMT at 90 mg/mole was added after the heating step. The finished emulsions were coated at 50 mg Ag/ft$^2$ (5.38 mg/dm$^2$) with a mixture of magenta dye-forming couplers at 50 mg/ft$^2$ (5.38 mg/dm$^2$). The coatings were overcoated with gel and hardened. Samples of the coatings were equally exposed at decade intervals ranging from $1\times10^{-5}$ to 0.1 second and processed for 2'15" in the Kodak Flexicolor TM C-41 color negative process. The results are summarized in Table XV. Speed is measured at a density of 0.35 above fog.

TABLE XV

| Emulsion | dopant level | Δ speed log E ($10^{-5}$ – 0.1 sec) |
|---|---|---|
| 26/1 | undoped | −0.06 |
| 26/2 | 28 mppm | −0.02 |

EXAMPLE 27

This example illustrates the use of desensitizing dopants with high chloride {100} tabular grain emulsions.

Emulsion 27/1

Six solutions were prepared as follows:

| | |
|---|---|
| Solution 1 (27/1) | |
| Gelatin (bone) | 75 g |
| NaCl | 2.88 g |
| D.W. | 4300 mL |
| Solution 2 (27/1) | |
| KI | 0.44 g |
| D.W. | 220 mL |
| Solution 3 (27/1) | |
| NaCl | 397.4 g |
| D.W. to total volume | 1700 mL |
| Solution 4 (27/1) | |
| NaCl | 4.3 g |
| D.W. | 6500 mL |
| Solution 5 (27/1) | |
| $AgNO_3$ 5.722 M soln. | 2110 g |
| D.W. | 518 mL |
| Solution 6 (27/1) | |
| Gelatin (phthalated) | 200 g |
| D.W. | 1500 mL |
| Solution 7 (27/1) | |
| Gelatin (bone) | 130 g |
| D.W. | 1500 mL |

Solution 1 (27/1) was charged into a reaction vessel equipped with a stirrer. Solution 2 (27/1) was added to the reaction vessel, the pH was adjusted to 6.5, and the temperature was raised to 55° C.. While vigorously stirring the reaction vessel, Solution 3 (27/1) and Solution 5 (27/1) were added at 45 mL/min. for one minute. Solution 4 (27/1) was then added to the mixture. The temperature was raised to 62° C., the pCl was adjusted to 1.91, and the pH maintained at 6.5. The mixture was held for five minutes. Following this hold, Solution 3 (27/1) and Solution 5 (27/1) were added simultaneously each at a linearly accelerated rates ranging from 15 mL/min. to 37 mL/min. in 56 minutes with the pCl maintained at 1.91. The mixture was then cooled to 40° C., and Solution 6 (27/1) was added and stirred for 5 minutes. The pH was then adjusted to 3.2, and the gel was allowed to settle. At the same time the temperature was dropped to 15° C. before decanting the liquid layer. The depleted volume was restored with D. W. The pH was adjusted to 4.5 and the mixture held at 40° C. for 20 minutes before the pH was adjusted to 3.2 and the settling and decanting steps were repeated. Solution 7 (27/1) was added and the pH and pCl adjusted to 6.5 and 1.6, respectively.

EMULSION 27/2

A second emulsion (27/2) was prepared like 27/1 but with $K_{30}S(NO)C15$ added at a formal total concentration of 0.1 mppm in a band from 70 to 80% of the salt and silver addition.

EMULSION 27/3

A third emulsion was prepared like 27/1 but with $K_3Ru(NO)Cl_5$ added at a formal total concentration of 0.1 mppm in a band from 70 to 80% of the salt and silver addition.

Emulsion 27/4M

A fourth emulsion (27/4) was prepared like 27/1 but with $K_3RhCl_6$ added at a formal total concentration of 0.1 mppm in a band from 70 to 80% of the salt and silver addition.

Emulsions 27/1, 27/2 and 27/3 were chemically and spectrally sensitized by treating them with 1.5% NaBr holding for 5 minutes, adding spectral sensitizing dye Dye SS-22, holding for 10 minutes, adding $Na_2S_2O_3.5H_2O$) at 1.6 mg/mole and $KAuCl_4$ at 1.0 mg/mole and heating for 10 minutes at 60° C. APMT at 100 mg/mole was added after the heating step. The emulsions were coated at 5.4 mg Ag/dm$^2$ with 5.4 mg/dm$^2$ of a magenta dye-forming coupler. The coatings were overcoated with gel and hardened. The coatings were given a daylight with a Wratten TM W9 filter exposure for 0.02 second and processed for 3'15" in the Kodak Flexicolor TM C-41 color negative process. The results are summarized in Table XVI. Speed was measured at a density of 0.20 above fog.

A portion of Emulsion 27/1 not previously sensitized (hereinafter referred to as Emulsion 27/1M) and Emulsion 27/4M were chemically and spectrally sensitized by treating them with 2% NaBr holding for 5 minutes, adding a spectrally sensitizing dye mixture (Dye SS-23 and Dye SS-25 in a 2:1 molar ratio), holding for 10 minutes, adding $Na_2S_2O_3.5H_2O$ at 1.6 mg/mole, adding $KAuCl_4$ at 1.0 mg/mole, and heating for 10 minutes at 60° C. APMT at 100 mg/mole was added after the heating step. The finished emulsions were coated at 5.4 mg Ag/dm$^2$ with 5.4 mg/dm$^2$ of a magenta dye-forming coupler. The coatings were overcoated with gel and hardened. The coatings were given a daylight with a Wratten TM 9 filter exposure for 0.02 second and processed for 3'15" in the Kodak Flexicolor TM C-41 color negative process. The results are summarized in Table XVI. Speed was measured at a density of 0.20 above fog.

| Emulsion | dopant level | speed (log E) |
|---|---|---|
| 27/1 | undoped | 2.54 |
| 27/2 | 0.1 mppm | 1.46 |
| 27/3 | 0.1 mppm | 0.62 |
| 27/1M | undoped | 2.36 |
| 27/4M | 0.1 mppm | 0.76 |

Example 28

This example illustrates the use of shallow electron trapping dopants with high chloride {100} tabular grain emulsions.

Emulsion 28/1

Eight solutions were prepared as follows:

| | |
|---|---|
| Solution 1 (28/1) | |
| Gelatin (bone) | 211 g |
| NaCl | 1.96 g |
| D.W. | 5798 mL |
| Solution 2 (28/1) | |
| KI | 0.15 g |
| D.W. | 90 mL |
| Solution 3 (28/1) | |
| NaCl | 206.7 g |
| D.W. | 7000 mL |
| Solution 4 (28/1) | |
| NaCl | 13.1 g |
| KI | 0.19 g |
| D.W. | 108 mL |
| Solution 5 (28/1) | |
| $AgNO_3$ 5.722 M soln. | 70 g |
| D.W. to total volume | 112 mL |
| Solution 6 (28/1) | |
| $AgNO_3$ 5.722 M soln. | 922 g |
| D.W. | 542.6 mL |
| Solution 7 (28/1) | |
| Gelatin (phthalated) | 100 g |
| D.W. | 1000 mL |
| Solution 8 (28/1) | |
| Gelatin (bone) | 80 g |
| D.W. | 1000 g |

Solution 1 (28/1) was charged into a reaction vessel equipped with a stirrer. Solution 2 (28/1) was added to the reaction vessel. The pH was 5.7, and the temperature was raised to 40° C. While vigorously stirring the reaction vessel, Solution 4 (28/1) and Solution 5 (28/1) were added at 130 mL/min for one half minute. The pCl was adjusted to 2.3. The mixture was held for ten minutes. Following this hold, Solution 3 (28/1) and Solution 6 (28/1) were added simultaneously at 24 mL/min for 40 minutes, then the flow was linearly accelerated from 24 mL/min to 48 mL/min in 130 minutes with the pCl maintained at 2.3. Solution 7 (28/1) was added and stirred for 5 minutes. The pH was then adjusted to 3.8 and the gel allowed to settle. At the same time the temperature was dropped to 15° C. before decanting the liquid layer. The depleted volume was restored with D.W. The pH was adjusted to 4.5 and the mixture held at 40° C. for 5 minutes before the pH was adjusted to 3.8 and the settling and decanting steps repeated. Solution 8 (28/1) was added and the pH and pCl adjusted to 5.6 and 1.6, respectively.

Emulsion 28/2

A second emulsion (28/2) was prepared like Emulsion 28/1, but with $K_4Ru(CN)_6$ added at a formal total concentration of 25 mppm in a band extending from 70 to 80 percent of the halide and silver addition.

Emulsion 28/3

A third emulsion (28/3) was prepared like 28/1, but with $K_4Ru(CN)_6$ added at a formal total concentration of 50 mppm in a band extending from 70 to 80 percent of the halide and silver addition.

Emulsions 28/1, 28/2 and 28/3 were finished by treating them with 1% NaBr holding for 5 minutes, adding a spectral sensitizing dye (Dye I-22), holding for 10 minutes, adding $Na_2S_2O_3.5H_2O$ at 0.8 mg/mole and $KAuCl_4$ at 1.0 mg/mole and heating for 10 minutes at 60° C. APMT at 120 mg/mole was added after the heating step. The finished emulsions were coated at 5.4 mg Ag/dm$^2$ with a magenta dye-forming coupler at 5.4 mg/dm$^2$. The coatings were overcoated with gel and hardened. Samples of the coatings were equally exposed at decade time intervals ranging from $1\times10^{-5}$ to 1/10 second and processed for 2' in the Kodak Flexicolor TM C-41 color negative process. The results are summarized in Table XVII. Speed is measured at a density of 0.35 above fog.

TABLE XVII

| Emul. | dopant level | Δ speed log E ($10^{-5}$ – 0.1 sec) |
|---|---|---|
| 28/1 | undoped | −0.08 |
| 28/2 | 25 mppm | +0.05 |
| 28/3 | 50 mppm | +0.12 |

Example 29

The addition of mild silver oxidizing agents during the precipitation and or precipitation under oxidizing conditions such as low pH have shown significant reduction in fog level without speed loss after spectral and chemical sensitization. The mild silver oxidants include inorganic salts such as a mercuric salt or an alkali tetrahaloaurate as well as organic compounds which release silver oxidizing species such as elemental sulfur, such as 4,4'-phenyl disulfide diacetanalide.

Emulsion 29A. (No Oxidizing Feature)

A silver bromochloride (3% bromide) (100) tabular grain emulsion to which no oxidizing agents were added or precipitation modifications made to reduce fog.

A 4.5 liter solution containing 3.52% by weight low methionine gelatin, 0.0056M sodium chloride and 1.0 mL of polyethylene glycol antifoamant was provided in a stirred reaction vessel at 40° C. While the solution was vigorously stirred, 135 mL of a 0.01M potassium iodide solution was added followed by 150 mL of 1.25M silver nitrate and 150 mL of a 1.25M sodium chloride solution added simultaneously at a rate of 300 mL/min each. The mixture was then held for 10 seconds with the temperature remaining at 40° C. Following the hold, a 0.625M silver nitrate solution and a 0.625M sodium chloride solution were added simultaneously at 30 mL/min for 30 minutes followed by a linear acceleration from 30 mL/min to 45 mL/min over 125 minutes, while maintaining the pCl at 2.35. At this point 480 mL of 1.25M sodium chloride was added over 8 minutes, followed by a 10 minute hold. The 1.25M silver nitrate solution was then added at 15 mL/min for 30 minutes after which 180 mL of 0.5M sodium bromide was added and the emulsion was held for 20 minutes. The pCl was then adjusted to 1.65 with sodium chloride then the emulsion was washed and concentrated using ultrafiltration to a pCl of 2.0. Ten grams of low methionine gelatin where added then the emulsion was adjusted to a pCl of 1.65 with sodium chloride and a pH of 5.7. The resulting emulsion was a tabular grain silver chloride emulsion containing 3% silver bromide and 0.032 mole percent iodide. The emulsion exhibited a mean grain ECD of 1.8 μm and a mean grain thickness of 0.15 μm.

Emulsion 29B (Oxidizing Feature)

This emulsion was prepared identically to Emulsion 29A, except that mercuric chloride was added to the silver nitrate solutions at a concentration of 0.08 mg mercuric chloride per mole of silver nitrate.

Emulsion 29C (Oxidizing Feature)

This emulsion was prepared identically to Emulsion 29A, except that potassium tetrachloroaurate was added to the silver nitrate solution at a concentration of 0.2 mg per mole of silver during the 125 ramped flow growth period in which 69 percent of total silver was precipitated.

Emulsion 29D (Oxidizing Feature)

This emulsion was prepared identically to Emulsion 29A, except that 4,4'-diphenyl disulfide acetanalide was added to the silver nitrate solution at a concentration of 1.0 mg per mole of silver during the 125 minute ramped flow growth period in which 69 percent of total silver was precipitated.

Emulsion 29E (Oxidizing Feature)

This emulsion was prepared identically to Emulsion 29A, except that the pH of the emulsion was adjusted from 5.7 to 4.5 with nitric acid after 17 percent of the total silver had been precipitated. The pH remained at 4.5 throughout the completion of the precipitation, but was adjusted back to 5.7 after the emulsion was washed and the final gelatin was added.

Sensitization and Coating

A quantity of emulsion suitable for coating was melted at 40° C. Potassium bromide was added followed by spectral sensitizing dye Dye SS-21. The dye addition was followed by a 20 minute hold. Sodium thiosulfate pentahydrate, a sulfur sensitizer, and potassium tetrachloroaurate, a gold sensitizer, were then added. The temperature of the well stirred mixture was then raised to 60° C. over 12 minutes and held at 60° C. for a time shown below. The emulsion was then cooled to 40° C. as quickly as possible, 70 mg/mole APMT was then added, and the emulsion was chill set.

A sample of each emulsion was coated on a support having an antihalation backing at 0.85 g/m$^2$ of silver with 1.08 g/m$^2$ of cyan dye-forming coupler C-1 and 2.7 g/m$^2$ of gelatin. The emulsion layer was overcoated with 1.6 g/m$^2$ of gelatin, an the entire coating was hardened with bis(vinylsulfonylmethyl) ether at 1.75 percent by weight of the total coated gelatin.

Photographic Evaluation

The photographic elements were exposed for 1/50 second through a step wedge with a tungsten lamp filtered with a Kodak Wratten TM 2B filter. The coatings with processed in the Kodak Flexicolor TM C-41 color negative process.

TABLE XVIII

| Emulsion | Dye SS-21 level mmol/Ag mole | sulfur level mg/Ag mole | gold level mg/Ag mole | 60° C. time min. | Dmin | Red Rsens |
|---|---|---|---|---|---|---|
| 29A | 0.6 | 0.8 | 0.4 | 5 | 0.86 | 100 |
| 29A | 0.6 | 0.8 | 0.4 | 10 | 1.30 | 102 |
| 29A | 0.7 | 0.5 | 0.25 | 5 | 1.40 | 120 |
| 29A | 0.7 | 0.5 | 0.25 | 10 | 0.96 | 105 |
| 29B | 0.6 | 0.8 | 0.4 | 5 | 0.32 | 93 |
| 29B | 0.6 | 0.8 | 0.4 | 10 | 0.22 | 91 |
| 29B | 0.7 | 0.5 | 0.25 | 5 | 0.18 | 100 |
| 29B | 0.7 | 0.5 | 0.25 | 10 | 0.18 | 107 |
| 29C | 0.6 | 0.8 | 0.4 | 5 | 0.27 | 89 |
| 29C | 0.6 | 0.8 | 0.4 | 10 | 0.62 | 102 |
| 29C | 0.7 | 0.5 | 0.25 | 5 | 1.29 | 120 |
| 29C | 0.7 | 0.5 | 0.25 | 10 | 0.37 | 117 |
| 29D | 0.6 | 0.8 | 0.4 | 5 | 0.25 | 95 |
| 29D | 0.6 | 0.8 | 0.4 | 10 | 0.21 | 95 |
| 29D | 0.7 | 0.5 | 0.25 | 5 | 0.33 | 105 |
| 29D | 0.7 | 0.5 | 0.25 | 10 | 1.34 | 110 |
| 29E | 0.6 | 0.8 | 0.4 | 5 | 0.61 | 93 |
| 29E | 0.6 | 0.8 | 0.4 | 10 | 0.42 | 91 |

From Table XVIII it is apparent that the presence of mild oxidants or oxidizing conditions during emulsion precipitation is capable of reducing fog while retaining essentially similar photographic sensitivities.

EXAMPLE 30

This example demonstrates that the addition of a benzothiazolium salt during sensitization produces a high chloride {100} tabular grain emulsion exhibiting higher speed and lower fog.

The emulsion was precipitated as described in Example 24.

Sensitization

Samples of the emulsion were melted at 40° C. Potassium bromide was added followed by a total of 0.7 mmol of green spectral sensitizing dye Dye SS-21 per mole of emulsion. The dye addition was followed by a 20 min hold. Sodium thiosulfate pentahydrate was then added at a level of 1.0 mg/Ag mole followed by 0.7 mg/Ag mole of potassium tetrachloroaurate. This was followed by the addition of 5 mg of 3-(2-methylsulfonylethyl)benzothiazolium tetrafluoroborate (hereinafter referred to as BTZTFB) per mole of silver (in some samples). The temperature of the well stirred mixture was then raised to 60° C. for a time specified below in Table XIX. The emulsion was cooled to 40° C. as quickly as possible, 70 mg/mole of APMT was added, and the emulsion samples were chill set.

A sample of each emulsion was coated on a support having an antihalation backing at 0.85 g/m$^2$ of silver with 1.08 g/m$^2$ of cyan dye-forming coupler C-1 and 2.7 g/m$^2$ of gelatin. The emulsion layer was overcoated with 1.6 g/m$^2$ of gelatin, and the entire coating was hardened with bis(vinylsulfonylmethyl) ether at 1.75 percent by weight of the total coated gelatin.

Photographic Evaluation

The photographic elements were exposed for 1/50 second through a step wedge for with a 3000° K. tungsten lamp filtered with a Daylight V filter and a Kodak Wratten TM filter. The coatings were processed in the Kodak Flexicolor TM C-41 color negative process.

TABLE XIX

| Sample | BTZTFB mg/Ag mol | Hold Time min. | Dmin | Red Rsens |
|---|---|---|---|---|
| 31A | 0 | 5 | 0.38 | 100 |
| 31B | 0 | 10 | 0.34 | 105 |
| 31C | 5 | 5 | 0.10 | 141 |
| 31D | 5 | 10 | 0.15 | 141 |

From Table XVII it is apparent that the addition of the benzothiazolium salt during sensitization not only increased sensitivity but additionally lowered minimum density.

EXAMPLE 31

This example demonstrates the effectiveness of a variety of spectral sensitizing dyes to increase the speed of high chloride {100} tabular grain emulsions.

A silver iodochloride (0.05 mole percent iodide) {100} tabular grain emulsion containing $3\times10^{-7}$ mole mercury per silver mole added with the silver salt during precipitation was employed. Tabular grains with {100} major faces accounted for greater than 50 percent of total grain projected area. The emulsion grain ECD was 1.37 μm and mean grain thickness was 0.148 μm. The emulsion was washed by ultrafiltration, its pH was adjusted to 5.6, and its pCl was adjusted to 1.6.

The emulsion was chemically and spectrally sensitized according to the following scheme:

TABLE XX

| Temperature | Finish Profile Addendum | Hold Time |
|---|---|---|
| 40° C. | 1.5 mole % KBr | 10 minutes |
| " | Dye or Optical Brightener OB-1 plus dye | 20 minutes |
| " | Sodium Thiosulfate (1.6 mg/mole Ag) | 2 minutes |
| " | Potassium Tetrachloroaurate (0.8 mg/mole Ag) | 2 minutes |
| Ramp 5° C./3 min to 60° C. | | 10 minutes |
| Ramp 5° C./3 min to 40° C. | | none |
| 40° C. | APMT (60 mg/Ag mole) | 10 minutes |

OB-1

4,4'-}2-[4-(2-chloroanilino)-6-chloro-1,3,5-triazinyl-]amino}-2,2'-disulfostilbene, disodium salt The samples were coated at 1.61 g Ag/m$^2$ and 3.23 g gel/m$^2$ on an unsubbed 7 mil (178 μm) polyacetate butyrate film support. Surfactants were added as coating aids, and bis(vinylsulfonylmethyl) ether at 1.5 percent by weight was used as a hardener.

Absorptance measurements on the coatings were used to determine the wavelength of maximum light absorption for the dyes. Exposure and processing consisted of 1/5" 5500° K. exposure followed by 6' development in a hydroquinone-Elon TM (p-N-methylaminophenol hemisulfate) developer (Kodak DK-50 TM), a stop bath, a fix (Kodak F-5 TM), and wash. The sensitivities of the coatings were measured as the exposure necessary to produce a density of 0.15 above the minimum density. An undyed comparison coating was assigned a sensitivity value of 100 for purposes of comparison and all the dyed examples are expressed relative to the undyed. The data is summarized in Table XXI.

TABLE XXI

| Sample | Dye | Amount | OB-1 mg/mole Ag | λmax | Relative sensitivity |
|---|---|---|---|---|---|
| 31/1 | none | | 0 | | 100 |
| 31/2 | SS-1 | 0.815 | 0 | 479 | 3550 |
| 31/3 | SS-2 | 0.815 | 0 | 451 | 1200 |
| 31/4 | SS-3 | 0.815 | 0 | 462 | 8130 |
| 31/5 | SS-4 | 0.815 | 0 | 556 | 955 |
| 31/6 | SS-5 | 0.815 | 0 | 549 | 11500 |
| 31/7 | SS-6 | 0.815 | 0 | 548 | 186 |
| 31/8 | SS-7 | 0.815 | 0 | 572 | 1000 |
| 31/9 | SS-8 | 0.815 | 0 | 601 | 2460 |
| 31/10 | SS-9 | 0.815 | 0 | 553 | 3890 |
| 31/11 | SS-10 | 0.815 | 0 | 540 | 6920 |
| 31/12 | SS-11 | 0.815 | 0 | 645 | 891 |
| 31/13 | SS-12 | 0.815 | 0 | 602 | 15500 |
| 31/14 | SS-13 | 0.815 | 0 | 650 | 3720 |
| 31/15 | SS-14 | 0.815 | 0 | 648 | 2950 |
| 31/16 | SS-31 | 0.815 | 0 | 462 | 257 |
| 31/17 | SS-32 | 0.815 | 0 | 539 | 725 |
| 31/18 | SS-33 | 0.815 | 0 | 497 | 2400 |
| 31/19 | SS-34 | 0.815 | 0 | | 676 |
| 31/20 | SS-35 | 0.815 | 0 | 452 | 4170 |
| 31/21 | SS-15 | 0.815 | 0 | 468 | 3550 |
| 31/22 | SS-36 | 0.815 | 0 | 482 | 309 |
| 31/23 | SS-37 | 0.815 | 0 | 537 | 162 |
| 31/24 | SS-38 | 0.815 | 0 | 456 | 417 |
| 31/25 | SS-42 | 0.815 | 0 | 598 | 912 |

TABLE XXI-continued

| Sample | Dye | Amount | OB-1 mg/mole Ag | λmax | Relative sensitivity |
|---|---|---|---|---|---|
| 31/26 | SS-43 | 0.815 | 0 | 575 | 1590 |
| 31/27 | SS-39 | 0.815 | 0 | 526 | 229 |
| 31/28 | SS-16 | 0.815 | 0 | 493 | 155 |
| 31/29 | SS-17 | 0.815 | 0 | 679 | 195 |
| 31/30 | SS-43 | 0.815 | 0 | 433 | 741 |
| 31/31 | SS-18 | 0.0376 | 200 | 677 | 234 |
| 31/32 | SS-19 | 0.0376 | 200 | 694 | 276 |
| 31/33 | SS-20 | 0.0376 | 200 | 768 | 112 |
| 31/34 | SS-40 | 0.102 | 100 | 666 | 145 |

EXAMPLE 32

The following example illustrates the use of blue spectral sensitizing dye combinations to spectrally sensitize high chloride {100} tabular grain emulsions.

The same emulsion employed as in Example 31.

The emulsion was chemically and spectrally sensitized according to the following scheme:

TABLE XXII

Finish Profile

| Temperature | Addendum | Hold Time |
|---|---|---|
| 40° C. | 1.5 mole % KBr | 10 minutes |
| " | Single dye or dye combination | 20 minutes for one dye 10 minutes each for two dyes |
| " | Sodium Thiosulfate (1.6 mg/mole Ag) | 2 minutes |
| " | Potassium Tetrachloroaurate (0.8 mg/mole Ag) | 2 minutes |
| Ramp 5° C./3 min to 63° C. | | 10 minutes |
| Ramp 5° C./3 min to 40° C. | | |
| 40° C. | APMT (80 mg/Ag mole) | 10 minutes |

Each spectrally sensitized emulsion sample was dual melted with a common dye-forming coupler dispersion melt containing dispersion A, dispersion B, and surfactants. The samples were coated on a 5 mil (125 μm) cellulose triacetate support that had been backed with a carbon black (Remjet TM) antihalation backing and subbed with 4.88 g/m$^2$ of gelatin. The emulsion and couplers were laid down at a level of 968 mg/m$^2$ silver, 484 mg/m$^2$ dye-forming coupler Y-1, and mg/m$^2$ coupler Y-2. Surfactants were added as coating aids. The emulsion layer was overcoated with 1.08 g/m$^2$ gelatin and hardened with 1.75 percent by weight bis(vinylsulfonyl)methane, based on total gelatin.

Dispersion A contained 9% by weight yellow dye-forming coupler Y-1, 6% by weight deionized gelatin, 0.44% a sodium triisopropylnaphthalene sulfonate (anionic surfactant), 1.1% 2N propionic acid.

Dispersion B had the following composition: by weight yellow dye-forming coupler Y-2, 4.5% dibutyl phthalate, 6.5% gelatin, 0.6% a sodium triisopropylnaphthalene sulfonate (anionic surfactant), and adjusted to pH 5.1 with 2N propionic acid.

Coupler Y-1

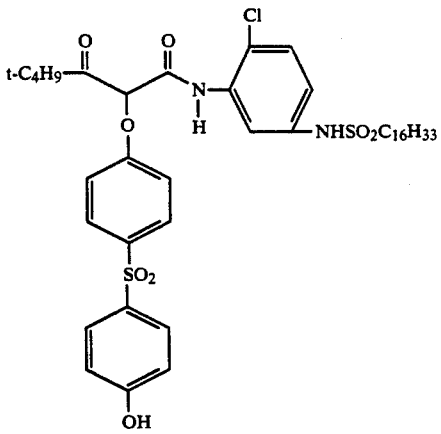

Coupler Y-2

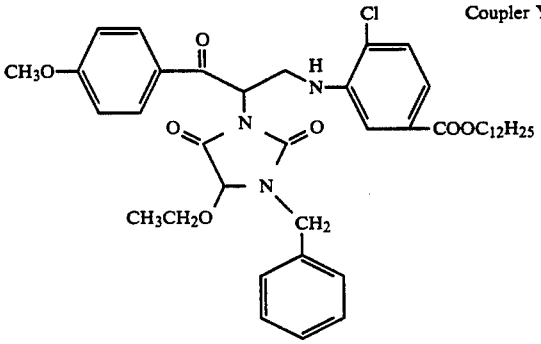

Strips from these coatings were given a 1/50" stepped wedge exposure from a 5500° K. light source through a Wratten TM 2B filter. The samples were processed using the Kodak Flexicolor C41 TM color negative process, but with the composition of the bleach solution modified to include propylenediaminetetraacetic acid. The minimum density was measured and the photographic speed determined as 100 times the log of the exposure required to give a density 0.15 above the minimum density. The data are summarized in Table XXIII.

TABLE XXIII

| Sample | Dye 1 Amount mM/Ag M | Dye 2 Amount mM/Ag M | λ Maximum | Speed |
|---|---|---|---|---|
| 32/1 | SS-29/0.8 | — | 437 nm | |
| 32/2 | — | SS-3/0.8 | 459 nm | 178 |
| 32/3 | | SS-30/0.8 | 464 nm | 219 |
| 32/4 | | SS-1/0.8 | 475 nm | 191 |
| 32/5 | SS-29/0.4 | SS-3/0.4 | 437 nm | 235 |
| 32/6 | SS-29/0.4 | SS-30/0.4 | 453 nm | 227 |
| 32/7 | SS-29/0.4 | SS-1/0.4 | 467 nm | 220 |

The data in Table XXIII show not only that the dye combinations are useful for the spectral sensitization of high chloride {100} tabular grain emulsions, but also that the combinations have a synergistic effect. The combination of dyes imparts more sensitivity to the emulsion than either dye alone.

EXAMPLE 33

This example has as its purpose to demonstrate the effectiveness of combinations of spectral sensitizing dyes in high chloride {100} tabular grain emulsions.

Emulsion Preparation

A 1.5 L solution containing 3.52% by weight of low methionine gelatin, 0.0056M sodium chloride and 0.3 ml of polyethylene glycol antifoamant provided in a stirred reaction vessel at 40° C. While the solution was vigorously stirred, 45 ml of a 0.01M potassium iodide solution was added followed by 50 mL of 1.25M silver nitrate and 50 mL of a 1.25M sodium chloride solution added simultaneously at a rate of 100 mL/min each. The mixture was then held for 10 seconds with the temperature remaining at 40° C. Following the hold, a 0.625M silver nitrate solution containing 0.08 mg mercuric chloride per mole of silver nitrate and a 0.625M sodium chloride solution were added simultaneously at 10 mL/min for 30 minutes followed by a linear acceleration from 10 mL/min to 15 mL/min over 125 minutes, then a constant flow rate growth for 30 minutes at 15 mL/min while maintaining the pCl at 2.35. The pCl was then adjusted to 1.65 with sodium chloride. Fifty grams of phthalated gelatin were added, and the emulsion was washed and concentrated using procedures of Yutzy et al U.S. Pat. No. 2,614,928. The pCl after washing was 2.0. Twenty-one grams of low methionine gel were added, the pCl was adjusted to 1.65 with sodium chloride, and the pH was adjusted to 5.7.

The resulting emulsion was a silver iodochloride {100} tabular grain emulsion containing 0.036 mole percent iodide. The emulsion had a mean grain ECD of 1.6 μm and a mean grain thickness of 0.125 μm.

Sensitization

A sample series of different emulsion sensitizations was undertaken. In each sensitization a quantity of emulsion suitable for coating was melted at 40° C. Potassium bromide was added followed by a total of 0.7 mmol of green spectral sensitizing dye per Ag mole. When two green spectral sensitizing dyes were added, the ratio of the principal and secondary dye was as shown in Table XXIV. The dye addition was followed by a 20 min hold. This was followed by 1.0 mg/mole of sodium thiosulfate pentahydrate then 0.7 mg/mole of potassium tetrachloroaurate. The temperature of the well stirred mixture was then raised to 60° C. over 12 minutes and held at 60° for a specified time. The emulsion was then cooled to 40° C. as quickly as possible, 70 mg/mole of APMT was added, and the emulsion was chill set.

Photographic Results

Each sample was coated on a support having an antihalation layer at 0.85 g/m$^2$ of silver, 1.08 g/m$^2$ of cyan dye-forming coupler C-1, and 2.7 g/m$^2$ of gelatin. This layer was overcoated with 1.6 g/m$^2$ of gelatin, and the entire coating was hardened with bis(vinylsulfonylmethyl)ether at 1.75 percent by weight of the total coated gelatin.

Coatings were exposed through a step wedge for 0.02 second with a 3000° K. tungsten source filtered with Daylight V and Kodak Wratten TM 9 filters. The coatings were processed in the Kodak Flexicolor TM C-41 color negative process.

TABLE XXIV

| Experiment | Principal Dye | Secondary Dye | Prin./Sec. Dye Ratio | 60° C. Hold Time min. | Red Rsens |
|---|---|---|---|---|---|
| 33/1 | SS-21 | None-- | Not Appl. | 5 | 100 |
| 33/2 | SS-21 | None-- | Not Appl. | 15 | 126 |
| 33/3 | SS-21 | SS-26 | 3:1 | 5 | 115 |
| 33/4 | SS-21 | SS-26 | 3:1 | 15 | 129 |
| 33/5 | SS-21 | SS-27 | 6:1 | 15 | 145 |
| 33/6 | SS-21 | SS-28 | 3:1 | 5 | 151 |
| 33/7 | SS-21 | SS-28 | 3:1 | 15 | 169 |
| 33/8 | SS-5 | — | Not Appl. | 5 | 100 |
| 33/9 | SS-5 | — | Not Appl. | 15 | 115 |
| 33/10 | SS-5 | SS-26 | 3:1 | 5 | 200 |
| 33/11 | SS-5 | SS-26 | 3:1 | 15 | 191 |
| 33/12 | SS-5 | SS-27 | 6:1 | 5 | 102 |
| 33/13 | SS-5 | SS-27 | 6:1 | 15 | 120 |
| 33/14 | SS-5 | SS-28 | 3:1 | 5 | 120 |
| 33/15 | SS-5 | SS-28 | 3:1 | 15 | 120 |

From Table XXIV it is apparent that the spectral sensitizing dye combinations produce higher level of response than when the same amount of only one of the dyes is employed.

EXAMPLE 34

This example demonstrates the photographic performance of blue, green and red spectrally sensitized high chloride {100} tabular grain emulsions in yellow, magenta and cyan dye-forming layer units, respectively. The emulsions were then coated on a resin coated paper support and processed.

Blue Sensitized Emulsion (B-SensEm)

An iodochloride (0.05 mole percent iodide) {100} tabular grain emulsion was employed having a mean grain ECD of 1.61 μm and a mean thickness 0.150 μm. The emulsion was washed by ultrafiltration, and its pH and pCl were adjusted to 5.6 and 1.5, respectively. This emulsion was sensitized by addition of blue spectral sensitizing dye SS-1 followed by the addition of gold sulfide and heat digestion, after which APMT was added to the emulsion melt.

Green Sensitized Emulsion (G-SensEm)

An iodochloride (0.05 mole percent iodide) {100} tabular grain emulsion was employed having a mean grain ECD of 1.38 μm and a mean thickness 0.148 μm. The emulsion was washed by ultrafiltration, and its pH and pCl were adjusted to 5.6 and 1.5, respectively. The emulsion was sensitized by addition of red spectral sensitizing dye SS-21 followed by the addition of gold sulfide and heat digestion, after which APMT was added to the emulsion melt.

Red Sensitized Emulsion (R-SensEm)

An iodochloride (0.05 mole percent iodide) {100} tabular grain emulsion was employed having a mean grain ECD of 1.61 μm and a mean thickness 0.150 μm. The emulsion was washed by ultrafiltration, and its pH and pCl were adjusted to 5.6 and 1.5, respectively. The emulsion was sensitized by addition of red spectral sensitizing dye SS-19 followed by the addition of gold sulfide and heat digestion, after which APMT was added to the emulsion melt.

Dye-Forming Coupler Dispersions

One of the dye-forming coupler dispersions shown in Table XXV was introduced as a disperse phase in a sample of one of the blue, green and red sensitized emulsions.

TABLE XXV
| Dispersion No. | Disperse Phase Composition |
|---|---|
| 34A | C-5, 61.3%; S-1, 33.7%; S-5, 5.0% |
| 34B | C-55, 41.0%, S-2, 29.5%, S-4, 29.5% |
| 34C | C-6, 86.2%; S-1, 6.9%, S-6, 6.9% |
| 34D | C-20, 49.1%; ST-1, 20.9%; ST-3, 4.9%; S-1, 25.1% |
| 34E | C-56, 50%; S-4, 50% |
| 34F | C-57, 30%; ST-5, 35%; ST-4, 5%; S-2, 30% |
| 34G | C-14, 33.3%; ST-2, 16.7%; S-1, 50.0% |
| 34H | C-13, 33.3%; ST-2, 16.7%; S-1, 50.0% |
| 34I | C-58, 25.0%; ST-2, 12.5%; S-4, 62.5% |
| 34J | C-15, 66.7%; S-2, 33.3% |
| 34K | C-25, 66.7%; S-1, 16.7%; S-5, 16.7% |
| 34L | C-26, 50%; ST-6, 22%; S-1, 22% |
| 34M | C-57, 30%; ST-2, 40%; S-2, 30% |
| 34N | C-57, 30%; ST-1, 40%; S-2, 30% |
| 34O | C-57, 30%; ST-5, 40%; S-2, 30% |
| 34P | C-57, 30%; ST-2, 20%; ST-7, 20%; S-2, 30% |
| 34Q | C-57, 30%; ST-2, 20%; ST-5, 20%; S-2, 30% |
| 34R | C-57, 30%; ST-2, 30%; ST-8, 10%; S-2, 30% |
| 34S | C-57, 30%; ST-2, 35%; ST-4, 5%; S-2, 30% |
| 34T | C-57, 30%; ST-5, 35%; ST-4, 5%; S-4, 30% |
Dye-Forming Couplers
C-5
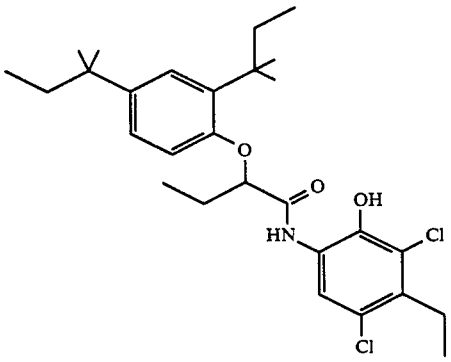
C-6
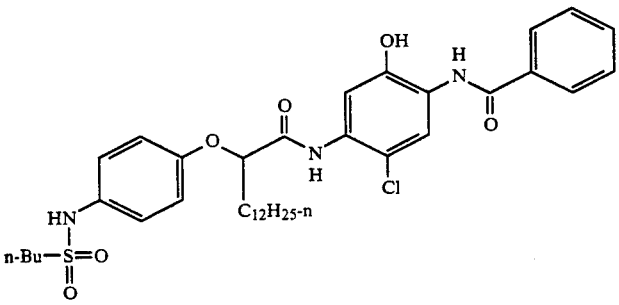
C-13
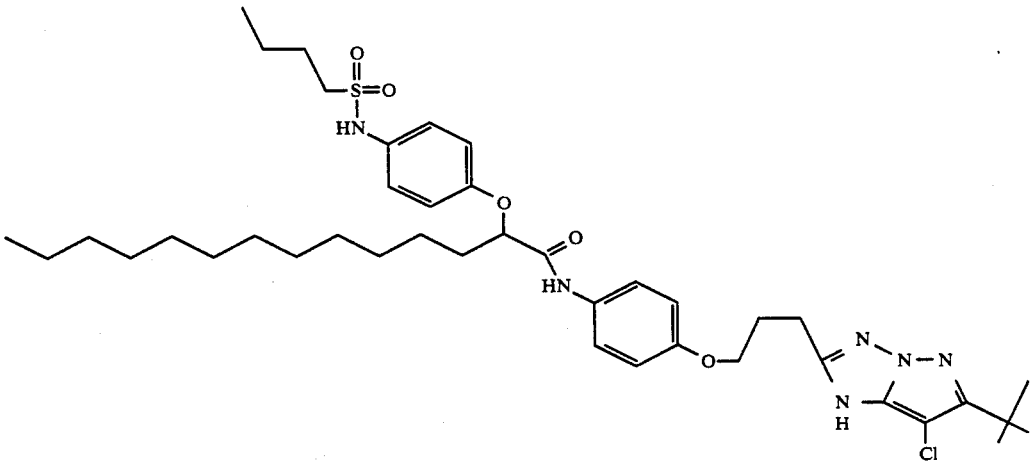

TABLE XXV-continued
C-14
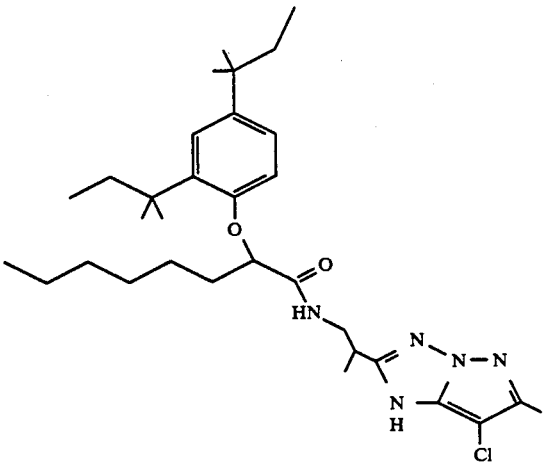
C-15
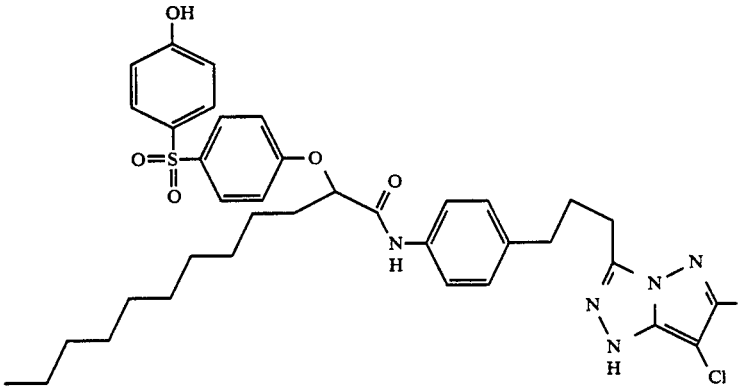
C-20
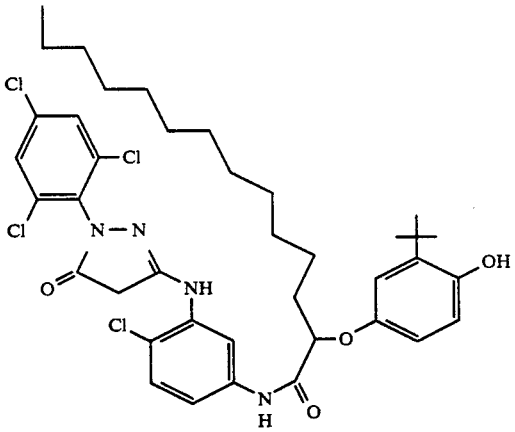
C-25
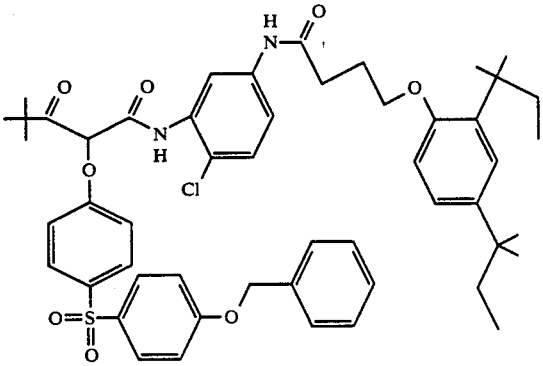

TABLE XXV-continued
C-26
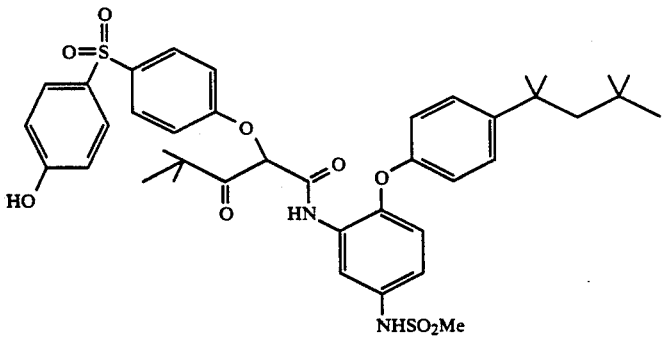
C-55
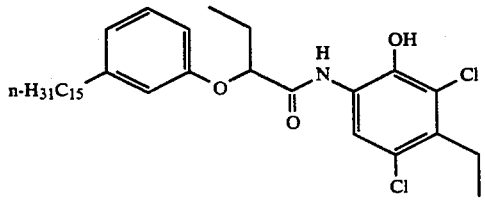
C-56
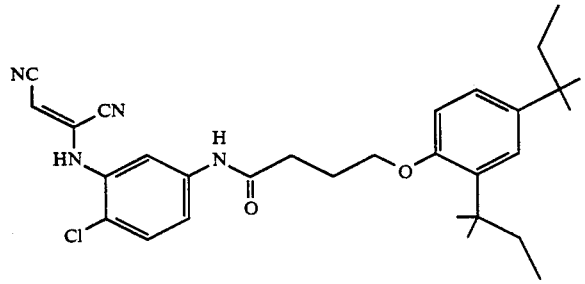
C-57
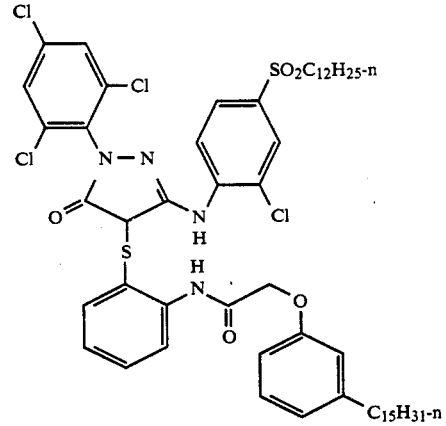
C-58
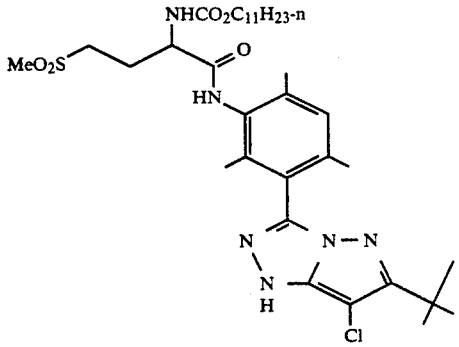

TABLE XXV-continued
Stabilizers
ST-1
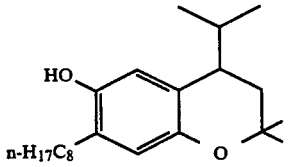
ST-2
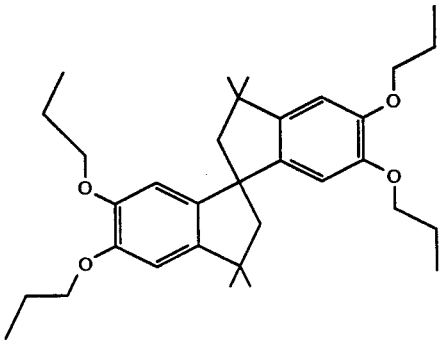
ST-3
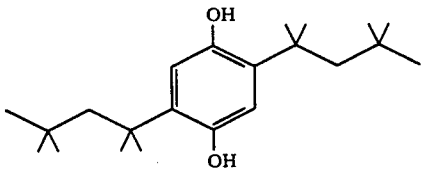
ST-4
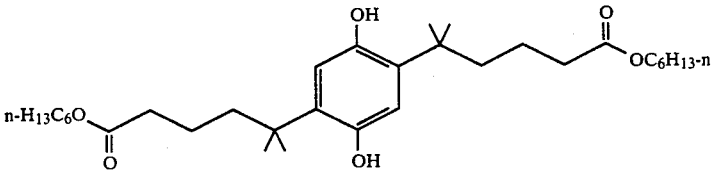
ST-5
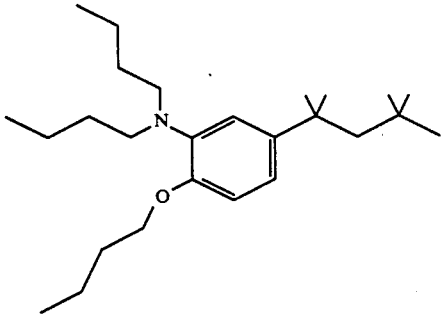
ST-6
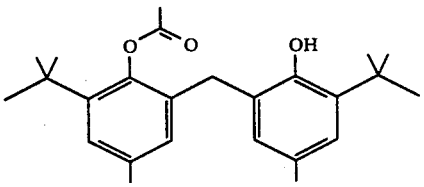

TABLE XXV-continued

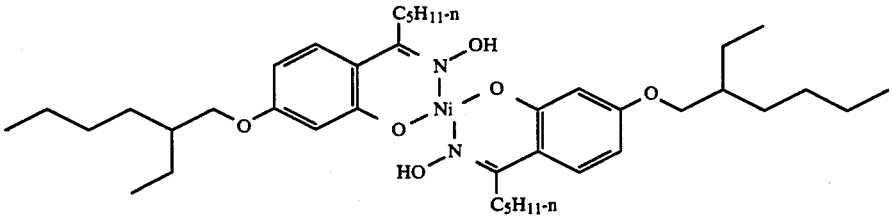

ST-7

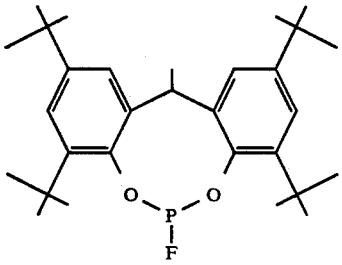

ST-8

Solvents

S-1: Dibutyl phthalate
S-2: Tritolyl phosphate
S-3: N,N-Diethyldodecanamide
S-4: Tris(2-ethylhexyl)phosphate
S-5: 2-(2-Butoxyethoxy)ethyl acetate
S-6: 2,5-Di-t-pentylphenol Photographic Elements 34/1-34/12

The photographic elements were prepared by coating the following layers in the order listed on a resin-coated paper support:

| | |
|---|---|
| 1st Layer | |
| Gelatin | 3.23 g/m$^2$ |
| 2nd Layer | |
| Gelatin | 1.61 g/m$^2$ |
| Coupler Dispersion | (See TABLE XXIV) |
| Emulsion | (See TABLE XXIV) |
| 3rd Layer | |
| Gelatin | 1.40 g/m$^2$ |
| Bis(vinylsulfonylmethyl) ether | 0.14 g/m$^2$ |

TABLE XXVI

| Example | Dispersion | Emulsion | Coupler Laydown (mol/m$^2$) | Silver Laydown (g/m$^2$) |
|---|---|---|---|---|
| 34/1 | 34A | R-SensEm | $8.6 \times 10^{-4}$ | 0.194 |
| 34/2 | 34B | R-SensEm | $8.6 \times 10^{-4}$ | 0.194 |
| 34/3 | 34C | R-SensEm | $8.6 \times 10^{-4}$ | 0.194 |
| 34/4 | 34D | G-SensEm | $5.6 \times 10^{-4}$ | 0.285 |
| 34/5 | 34E | G-SensEm | $4.3 \times 10^{-4}$ | 0.285 |
| 34/6 | 34F | G-SensEm | $3.2 \times 10^{-4}$ | 0.172 |
| 34/7 | 34G | G-SensEm | $4.3 \times 10^{-4}$ | 0.172 |
| 34/8 | 34H | G-SensEm | $4.3 \times 10^{-4}$ | 0.172 |
| 34/9 | 34I | G-SensEm | $4.3 \times 10^{-4}$ | 0.172 |
| 34/10 | 34J | G-SensEm | $4.3 \times 10^{-4}$ | 0.172 |
| 34/11 | 34K | B-SensEm | $1.2 \times 10^{-4}$ | 0.280 |
| 34/12 | 34L | B-SensEm | $7.0 \times 10^{-4}$ | 0.280 |

Photographic Elements 34/13-34/22

The photographic elements were prepared by coating the following layers in the order listed on a resin-coated paper support:

| | |
|---|---|
| 1st Layer | |
| Gelatin | 3.23 g/m$^2$ |
| 2nd Layer | |
| Gelatin | 1.61 g/m$^2$ |
| Coupler Dispersion | (See TABLE XXV) |
| Emulsion | (See TABLE XXV) |
| 3rd Layer | |
| Gelatin | 1.33 g/m$^2$ |
| 2-(2H-benzotriazol-2-yl)-4,6-bis(1,1-dimethylpropyl)phenol | 0.73 g/m$^2$ |
| Tinuvin TM 326 (Ciba-Geigy) | 0.13 g/m$^2$ |
| 4th Layer | |
| Gelatin | 1.40 g/m$^2$ |
| Bis(vinylsulfonylmethyl) ether | 0.14 g/m$^2$ |

TABLE XXVII

| Example | Dispersion | Emulsion | Coupler Laydown (mol/m$^2$) | Silver Laydown (g/m$^2$) |
|---|---|---|---|---|
| 34/13 | 34D | G-SensEm | $5.6 \times 10^{-4}$ | 0.285 |
| 34/14 | 34M | G-SensEm | $3.2 \times 10^{-4}$ | 0.172 |
| 34/15 | 34N | G-SensEm | $3.2 \times 10^{-4}$ | 0.172 |
| 34/16 | 34O | G-SensEm | $3.2 \times 10^{-4}$ | 0.172 |
| 34/17 | 34P | G-SensEm | $3.2 \times 10^{-4}$ | 0.172 |
| 34/18 | 34Q | G-SensEm | $3.2 \times 10^{-4}$ | 0.172 |
| 34/19 | 34R | G-SensEm | $3.2 \times 10^{-4}$ | 0.172 |
| 34/20 | 34S | G-SensEm | $3.2 \times 10^{-4}$ | 0.172 |
| 34/21 | 34F | G-SensEm | $3.2 \times 10^{-4}$ | 0.172 |
| 34/22 | 34T | G-SensEm | $3.2 \times 10^{-4}$ | 0.172 |

Exposure and Processing

The photographic elements were given stepwise exposures and processed as follows at 35° C.:

Developer: 45 seconds
Bleach-Fix: 45 seconds
Wash (running water): 1 minute, 30 seconds The developer and bleach-fix were of the following compositions:

| | |
|---|---|
| Developer | |
| Water | 700.00 mL |
| Triethanolamine | 12.41 g |
| Blankophor REU TM (Mobay Corp.) | 2.30 g |
| Lithium polystyrene sulfonate (30%) | 0.30 g |
| N,N-Diethylhydroxylamine (85%) | 5.40 g |

-continued

| | |
|---|---|
| Lithium sulfate | 2.70 g |
| N-{2-[(4-amino-3-methylphenyl)ethylamino]ethyl}methanesulfonamide, sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.4 ± 0.05 | |
| Bleach-Fix | |
| Water | 700.00 mL |
| Solution of ammonium thiosulfate (56.4%) + Ammoniumsulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylene diaminetetraacetic acid (3.5%) | 110.40 g |
| Water to make | 1.00 L |
| pH @ 26.7° C. adjusted to 6.7 | |

Photographic Results

Cyan, magenta, or yellow dyes were formed upon processing. The following photographic characteristics were determined: D-max (the maximum density to light of the color complementary to the dye color); D-min (the minimum density); and Speed (the relative log exposure required to yield a density of 1.0). These values for each example are tabulated in Table XXVIII.

TABLE XXVIII

| Example No. | Dispersion | D-max | D-min | Speed |
|---|---|---|---|---|
| 34/1 | 34A | 2.42 | 0.15 | 209 |
| 34/2 | 34B | 2.49 | 0.15 | 211 |
| 34/3 | 34C | 2.30 | 0.14 | 177 |
| 34/4 | 34D | 2.38 | 0.26 | 244 |
| 34/5 | 34E | 2.30 | 0.42 | 256 |
| 34/6 | 34F | 2.50 | 0.27 | 248 |
| 34/7 | 34G | 2.51 | 0.32 | 260 |
| 34/8 | 34H | 2.74 | 0.23 | 239 |
| 34/9 | 34I | 2.40 | 0.18 | 237 |
| 34/10 | 34J | 2.42 | 0.31 | 263 |
| 34/11 | 34K | 2.20 | 0.05 | 229 |
| 34/12 | 34L | 2.62 | 0.07 | 234 |
| 34/13 | 34D | 2.24 | 0.26 | 243 |
| 34/14 | 34M | 2.46 | 0.30 | 252 |
| 34/15 | 34N | 1.36 | 0.29 | 214 |
| 34/16 | 34O | 2.44 | 0.30 | 250 |
| 34/17 | 34P | 2.45 | 0.32 | 254 |
| 34/18 | 34Q | 2.45 | 0.27 | 255 |
| 34/19 | 34R | 2.48 | 0.29 | 255 |
| 34/20 | 34S | 2.24 | 0.24 | 242 |
| 34/21 | 34F | 2.13 | 0.21 | 240 |
| 34/22 | 34T | 2.15 | 0.21 | 241 |

Table XXVIII demonstrates the usefulness of the high chloride {100} tabular grain emulsions with a variety of couplers in dispersions commonly used for color paper reflection print materials.

EXAMPLES 35-37

These examples demonstrate the reduced high intensity reciprocity failure (HIRF) of the high chloride {100} tabular grain emulsions of the invention as compared to high chloride cubic grain emulsions.

EXAMPLE 35

A comparison cubic grain high chloride emulsion, hereinafter referred to as Emulsion 35/C, was precipitated by equimolar addition of silver nitrate and sodium chloride into a well stirred reactor containing gelatin peptizer and thioether ripener. The resulting emulsion contained cubic grains with a mean edge length of 0.74 μm.

A silver iodochloride (0.05 mole percent iodide) {100} tabular grain emulsion according to the invention was prepared in which greater than 50 percent of total grain projected area was accounted for by tabular grains having {100} major faces. The mean grain ECD was 1.55 μm and mean grain thickness was 0.155 μm. The emulsion was washed by ultrafiltration, and its pH and pCl were adjusted to 5.6 and 1.6, respectively. This emulsion is hereafter designated Emulsion 35/T.

Each of the emulsions was divided into separate aliquots for spectral and chemical sensitization. Portions of Emulsion 35/C were optimally sensitized by the addition of gold sulfide and increased in temperature to 60° C. during which time APMT, potassium bromide and one of the blue spectral sensitizing dyes SS-1, SS-50 or SS-51 were added. These emulsion portions are hereinafter referred to as 35/C1, 35/C2 and 35/C3, respectively. Portions of Emulsion 35/T were optimally sensitized by the addition of SS-1, SS-50 or SS-51 followed by the addition of gold sulfide and heat digestion, after which APMT was added to the melt. These emulsion portions are hereinafter referred to as 35/T1, 35/T2 and 35/T3, respectively.

All of the emulsions were coated on resin coated paper support at 1.8 mg/dm$^2$ silver and 7.5 mg/dm$^2$ gelatin along with a yellow dye-forming coupler to form a blue recording layer unit. Both green and red recording layer units were also coated to form a multicolor pack.

Samples of the multicolor pack were subjected to equal exposures of $10^{-1}$ and $10^{-5}$ second using an optical reciprocity sensitometer. The exposed samples were processed in a Kodak RA-4 TM color print developer. Photographic speed was taken at minimum density plus a density of 0.35.

The results are summarized in Table XXIX.

TABLE XXIX

| | Relative Speed | | | |
|---|---|---|---|---|
| Part | at $10^{-1}$s | at $10^{-5}$s | Delta | Dmin |
| 35/C1 | 98 | 47 | 51 | 0.08 |
| 35/C2 | 85 | 0 | 85 | 0.10 |
| 35/C3 | 89 | 14 | 75 | 0.09 |
| 35/T1 | 111 | 97 | 14 | 0.11 |
| 35/T2 | 116 | 86 | 30 | 0.11 |
| 35/T3 | 120 | 95 | 25 | 0.10 |

From Table XXIX the higher speed and reduced HIRF of the samples of Emulsion 35/T are apparent.

EXAMPLE 36

A comparison cubic grain high chloride emulsion, hereinafter referred to as Emulsion 36/C, was precipitated by equimolar addition of silver nitrate and sodium chloride into a well stirred reactor containing low methionine gelatin peptizer. The resulting emulsion contained cubic grains with a mean edge length of 0.42 μm.

A silver iodochloride (0.05 mole percent iodide) {100} tabular grain emulsion according to the invention was prepared in which greater than 50 percent of total grain projected area was accounted for by tabular grains having {100} major faces. The mean grain ECD was 1.38 μm and mean grain thickness was 0.148 μm. The emulsion was washed by ultrafiltration, and its pH and pCl were adjusted to 5.6 and 1.6, respectively. This emulsion is hereafter designated Emulsion 36/T.

Portions of each of Emulsions 36/C and 36/T were sensitized by the addition of gold sulfide and spectral sensitizing dye SS-21 and heat digestion, followed by the addition of APMT and potassium bromide. The sensitized portions of the emulsions were coated, exposed and processed as described above in Example 35, except that the sensitized emulsion portions were mixed with a magenta dye-forming coupler and coated as the green recording layer unit of a multicolor pack. The results are summarized in Table XXX.

TABLE XXX

| Part | Relative Speed at $10^{-1}$s | Relative Speed at $10^{-5}$s | Delta | Dmin |
|---|---|---|---|---|
| 36/C | 91 | 68 | 23 | 0.19 |
| 36/T | 132 | 125 | 7 | 0.14 |

From Table XXX the higher speed and reduced HIRF of the samples of Emulsion 36/T are apparent.

EXAMPLE 37

A comparison cubic grain high chloride emulsion, hereinafter referred to as Emulsion 37/C, was precipitated by equimolar addition of silver nitrate and sodium chloride into a well stirred reactor containing gelatin peptizer and thioether ripener. The resulting emulsion contained cubic grains with a mean edge length of 0.40 μm.

A silver iodochloride (0.05 mole percent iodide) {100} tabular grain emulsion according to the invention was prepared in which greater than 50 percent of total grain projected area was accounted for by tabular grains having {100} major faces. The mean grain ECD was 1.61 μm and mean grain thickness was 0.15 μm. The emulsion was washed by ultrafiltration, and its pH and pCl were adjusted to 5.6 and 1.6, respectively. This emulsion is hereafter designated Emulsion 37/T.

A portion of Emulsion 37/C was optimally chemically and spectrally sensitized by the addition of gold sulfide and heat digestion followed by the addition of AMPT, potassium bromide and red spectral sensitizing dye SS-19. A portion of Emulsion 37/T was optimally chemically and spectrally sensitized similarly as Emulsion 37/C.

The sensitized portions of the emulsions were coated, exposed and processed as described above in Example 35, except that the sensitized emulsion portions were mixed with a cyan dye-forming coupler and coated as the red recording layer unit of a multicolor pack. The results are summarized in Table XXXI.

TABLE XXXI

| Part | Relative Speed at $10^{-1}$s | Relative Speed at $10^{-5}$s | Delta | Dmin |
|---|---|---|---|---|
| 37/C | 32 | 5 | 27 | 0.11 |
| 37/T | 74 | 67 | 7 | 0.17 |

From Table XXIX the higher speed and reduced HIRF of the samples of Emulsion 37/T are apparent.

EXAMPLES A-M (COMPARATIVE)

These Examples are presented for purposes of comparison.

Emulsions A-K (Comparative)

These examples demonstrate repeated attempts to form {100} tabular grain emulsions following the teachings of Bogg U.S. Pat. No. 4,063,951. Since the only Example provided by Bogg was directed to a silver iodobromide emulsion, the first emulsion preparations also used iodide and bromide salts. In subsequent preparation attempts chloride and iodochloride emulsion preparations were attempted.

Emulsion A

A 2000 mL solution containing 5.0% by weight bone gelatin and 0.2 mL of tributylphosphate antifoamant was provided in a reaction vessel at 65° C., stirred with a highly pitched, 7.6 cm diameter, three-blade marine propeller at 250 rpm. The initial pH was 5.74. While the solution was stirred, a 4.7M silver nitrate solution and a 4.465M ammonium bromide and 0.235M ammonium iodide solution were added simultaneously at 21.2 mL/min for 22.2 minutes with the pAg controlled at 6.0. The temperature was then reduced to 45° C. linearly over 10 minutes. After the temperature was reduced, 147 mL of an 11.8M ammonium hydroxide solution were rapidly added and the mixture was held for 10 minutes. The pBr was 3.25 after the ammonia was added.

The resulting emulsion contained relatively polydisperse cubic grains with rounded corners. Out of 672 grains observed on a scanning electron microscope (SEM) at a magnification of 20,000×, 21 grains (3%) showed a slight rectangular shape with a ratio of adjacent edge lengths of less than 1.3 and typically 1.1. SEM observations of grains tilted so that the thickness could be observed showed that the few grains present that appeared rectangular exhibited aspect ratios of less than 2.

Emulsion B

The precipitation process was the same as that used for Emulsion A, except that mixing was improved by increasing the rpm of the marine propeller to 600 and the latitude of pAg variation during the preparation more restricted with the pAg being centered at 7.7. The pBr after the ammonium hydroxide was added was 2.7.

The resulting emulsion contained polydisperse spherical grains of about 0.5 μm in ECD, showing {111} (i.e., octahedral) crystal faces.

Emulsion C

The precipitation process was the same as that used for Emulsion A, except that the marine propeller was replaced by a high rpm mixing device operating at 5000 rpm. The range of pAg variance restricted to the range of 5.7 to 6.5 and was centered at a pAg of 6.1. The pBr after the addition of the ammonium hydroxide was 2.7.

The resulting emulsion contained polydisperse spherical grains with an average ECD of about 0.5 μm, showing {111} faces.

Emulsion D

The precipitation process was the same as that used for Emulsion B, except that immediately after the addition of the ammonium hydroxide, 18.1 mL of 4.7M silver nitrate was added to reduce excess halide and increase the pBr to 3.5 during the 10 minute ripening period.

A sample of the emulsion taken before the temperature was reduced to 45° C. showed a relatively monodisperse population of cubes with an edge length of about 0.2 μm, similar to that described by Bogg.

After the 10 minute ripening period the emulsion appeared essentially similar to Emulsion A, being composed of almost entirely cubic grains with a small percentage of the grains showing a rectangular shape and an aspect ratio less than 2.

Emulsion E

The precipitation process was the same as that used for Emulsion D, except that 39.5 mL of 4.7M silver nitrate were added immediately after the addition of the ammonium hydroxide to further reduce the excess halide and raise the pBr to 3.95 during the 10 minute ripening period.

The resulting emulsion appeared similar to Emulsion D.

Emulsion F

The precipitation process was the same as that used for Emulsion D, except that 115 mL of 4.7M silver nitrate were added immediately after the addition of the ammonium hydroxide to raise the pBr to 5.0 during the 10 minute ripening period.

The resulting emulsion again appeared similar to Emulsion D.

Emulsion G

The precipitation process was the same as that used for Emulsion D, except that 142 mL of 4.7M silver nitrate were added immediately after the addition of the ammonium hydroxide to raise the pBr to 6.1 during the 10 minute ripening period.

The resulting emulsion again appeared similar to Emulsion D.

Emulsion H

The precipitation process was the same as that used for Emulsion F, except that the iodide content in the salt solution was reduced by a factor of 10 by using a solution composed of 4.6765M ammonium bromide and 0.0235M ammonium iodide. The amount of 4.7M silver nitrate added after the ammonium hydroxide addition was increased slightly to 124 mL and the pBr was 5.4.

The resulting emulsion again appeared similar to Emulsions D through G.

Emulsion I

The precipitation process was the same as that used for Emulsion H, except that the amount of silver nitrate added after the ammonium hydroxide dump was 9 mL to adjust the pBr to 3.25 during the 10 minute ripening period.

The resulting emulsion again looked about identical to Emulsions D through H.

Emulsions A and D through H most closely resembled the grain shapes disclosed by Bogg U.S. Pat. No. 4,063,951, but with two differences: (1) the percentage of rectangular grains was much lower in the Emulsions above and (2) the average grain diameter was about 0.3 μm. It was not apparent how a silver iodobromide emulsion could be prepared having the grain population disclosed by Bogg using a precipitation procedure of the type taught by Bogg.

The following two emulsions show the results obtained when ammonium bromide was replaced by ammonium chloride.

EXAMPLE J

The precipitation process was the same as that used for Emulsion A, except that the ammonium bromide and ammonium iodide solutions were replaced with an equimolar amount of ammonium chloride. The pCl during the ripening period was 1.5. No iodide was added.

The resulting emulsion was composed of a wide variety of polymorphic, very low aspect ratio grains showing a variety of crystal faces including {111} faces. A very small number of the grains were square or rectangular, but exhibited aspect ratios of less than 2. The corners of every grain had been modified and showed both {111} and {110} crystal faces. The mean grain ECD was much larger than that of the previous emulsions at about 10 μm.

Emulsion K

This emulsion was prepared identically to Example J, except that ammonium iodide was added to the salt solution such that the composition was 4.465M ammonium chloride and 0.265M ammonium iodide. The pCl during the 10 minute ripening period was 1.6.

The resulting emulsion appeared almost identical to the bromide Emulsions A and D through H, except that most of the emulsion grains had modified corners exhibiting {111} or {110} crystallographic faces. The mean grain ECD was also less than 0.5 μm, as was observed in the bromide examples. This silver iodochloroiodide emulsion also contained a low percentage of grains that were slightly rectangular, but the rectangular grains exhibited an aspect ratio of less than 2. As in Emulsion J, most of the corners of the grains were modified and showed {111} faces.

Based on these investigations it was concluded that a tabular grain emulsion satisfying the requirements of this invention could not be prepared by following the teachings of Bogg U.S. Pat. No. 4,063,951.

Emulsion L (Comparative)

This emulsion was prepared to provide a silver chloride (100) cubic grain emulsion with a mean grain volume matching that of the emulsion of Example 3, to thereby allow the photographic response of the emulsions to be easily compared.

A 5.0 L solution containing 8.0% by weight of low methionine gelatin, 0.026M sodium chloride and 1.0 ml of ethylene oxide/propylene oxide block copolymer antifoamant provided in a stirred reaction vessel at 65° C. While the solution was vigorously stirred, a 4.0M silver nitrate solution containing 0.08 mg of mercuric chloride per mole of silver nitrate and a 4.0 M sodium chloride solution were simultaneously added at a rate of 18 mL/min each for 1 minute with the pCl controlled at 1.6. Over the next 20 minutes, the flow rates of the silver nitrate and salt solution were increased from 18 to 80 mL/min, then the flow rates were held constant at 80 mL/min for 65 minutes with the pCl controlled at 1.6. The emulsion was then washed and concentrated by ultrafiltration. Low methionine gelatin in the amount of 560 g was added, and pCl was adjusted to 1.6 with a sodium chloride solution. The resulting cubic grain emulsion had a mean cubic grain edge length of 0.6 μm.

Emulsion M

This emulsion preparation demonstrates the inability of a ripening out procedure—specifically the procedure referred to in the 1963 Torino Symposium, cited above--to produce a tabular grain emulsion satisfying the requirements of the invention.

To a reaction vessel containing 75 mL distilled water, 6.75 g deionized bone gelatin and 2.25 mL of 1.0M NaCl solution at 40° C. were simultaneously added with efficient stirring 15 mL of 1.0M $AgNO_3$ solution and 15 mL of 1.0M NaCl solution each at 15 mL per minute. The mixture was stirred at 40° C. for 4 minutes, then the temperature was increased to 77° C. over a period of 10 minutes and 7.2 mL of 1.0M NaCl solution were added. The mixture was stirred at 77° C. for 180 minutes and then cooled to 40° C.

The resulting grain mixture was examined by optical and electron microscopy. The emulsion contained a population of small cubes of approximately 0.2 μm edge length, large nontabular grains, and tabular grains with square or rectangular major faces. In terms of numbers of grains the small grains were overwhelmingly predominant. The tabular grains accounted for no more than 25 percent of the total grain projected area of the emulsion.

The mean thickness of the tabular grain population was determined from edge-on views obtained using an electron microscope. A total of 26 tabular grains were measured and found to have a mean thickness of 0.38 μm. Of the 26 tabular grains measured for thickness, only one had a thickness of less than 0.3 μm, the thickness of that one tabular grain being 0.25 μm.

EXAMPLES 38–42

These Examples have as their purpose to demonstrate and compare intermediate aspect ratio tabular grain emulsions satisfying the requirements of the invention.

EXAMPLE 38

A 6090 mL solution containing 3.52% by weight of low methionine gelatin, 0.0056M sodium chloride and $1.48\times10^{-4}$ potassium iodide was provided in a stirred reaction vessel at 40° C. While the solution was vigorously stirred, 90 mL of 2.0M silver nitrate and 90 mL of a 1.99M sodium chloride and 0.01M potassium iodide solution were added simultaneously at a rate of 180 mL/min each. The mixture was then held for 10 minutes with the temperature remaining at 40° C. Following the hold, a 1.0M silver nitrate solution and a 1.0M sodium chloride solution were added simultaneously at 12 mL/min for 40 minutes followed by a linear acceleration from 12 mL/min to 33.7 mL/min over 233.2 minutes, while maintaining the pCl at 2.25. The pCl was then adjusted to 1330 with sodium chloride then washed using ultrafiltration to a pCl of 2.0 then adjusted to a pCl of 1.65 with sodium chloride. The resulting emulsion was a tabular grain silver iodochloroide emulsion contained 0.03 mole percent iodide with a mean equivalent circular grain diameter of 1.51 μm and a mean thickness of 0.22 μm. Greater than 50 percent of total grain projected area was accounted for by {100} tabular grains exhibiting an average aspect ratio of 6.9.

EXAMPLE 39

A 1536 mL solution containing 3.52% by weight of low methionine (hydrogen peroxide treated) gelatin, 0.0056M sodium chloride, $2.34\times10^{-4}$M potassium iodide, and 0.3 mL of a polyethylene glycol antifoamant was provided in a stirred reaction vessel at 40° C. While the solution was vigorously stirred, 30 mL of 2.0M silver nitrate and 30 mL of a 2.0M sodium chloride solution were added simultaneously at a rate of 60 mL/min each. The mixture was then held for 10 seconds. Following the hold, a 0.5M silver nitrate solution and a 0.5M sodium chloride solution were added simultaneously at 8 mL/min for 40 minutes with the pCl maintained at 2.35. The pCl was then adjusted to 1.65 with 1.0M sodium chloride. The 0.5M silver nitrate and the 0.5M sodium chloride were then each added at a linearly increasing the flow rate, commencing at 8 mL/min and increasing at a rate of 0.0615 mL/min while maintaining pCl at 1.65. After 90 minutes microscopic observation of the emulsion showed an equivalent circular diameter of 0.9 μm with a mean grain thickness of 0.17 μm. Greater than 50 percent of total grain projected area was accounted for by {100} tabular grains exhibiting an average aspect ratio of 5.3.

EXAMPLE 40

A 1.5 L solution containing 3.52% by weight of low methionine gelatin, 0.0056M sodium chloride and 0.2 mL of polyethylene glycol antifoamant provided in a stirred reaction vessel at 40° C. While the solution was vigorously stirred, 45 mL of a 0.01M potassium iodide solution were added, followed by 50 mL of 1.25M silver nitrate and 50 mL of a 1.25M sodium chloride solution, added simultaneously each at a rate of 100 mL/min. The mixture was then held for 10 seconds with the temperature remaining at 40° C. Following the hold, a 0.625M silver nitrate solution containing 0.08 mg mercuric chloride per mole of silver nitrate and a 0.625M sodium chloride solution were added simultaneously each at 10 mL/min for 30 minutes while the pCl was maintained at 2.35. The reaction vessel pCL was then adjusted to 1.25 by adding 2M sodium chloride over 1 minute. This was followed by a linearly accelerated simultaneous addition of 0.625M silver nitrate and 0.625M sodium chloride solutions, each at a rate of from 10 mL/min to 15 mL/min over 125 minutes, then at a constant flow rate for 30 minutes each a rate of 15 mL/min while maintaining the pCl at 1.25. Forty grams of phthalated gelatin were added, and the emulsion was washed and concentrated using procedures of Yutzy et al U.S. Pat. No. 2,614,918. The pCl after washing was 2.0. Twenty-one grams of low methionine gel were added, the pCl was adjusted to 1.65 with sodium chloride, and the pH was adjusted to 5.7. The resulting emulsion was a silver iodochloride {100} tabular grain emulsion containing 0.036 mole percent iodide. More than 90 percent of total grain projected area was accounted for by grains with rectangular {100} major faces and sharp unmodified corners. The emulsion had a mean ECD of 0.89 μm and a mean grain thickness of 0.34 μm.

EXAMPLE 41

This emulsion was precipitated and washed identically to the emulsion of Example 40, except the pCl during the accelerated and final growth segments was maintained at 1.65. Approximately 90 percent of total grain projected area was accounted for by square and rectangular grains with {100} major faces. The mean ECD of the emulsion grains was 1.08 μm, and their average thickness was 0.25 μm.

EXAMPLE 42

The example 40 emulsion and Emulsion L were similarly sensitized, coated and photographically evaluated.

To identify empirically a substantially optimum sensitization samples of each emulsion were sensitized by varying the concentrations added of spectral sensitizing dye, sulfur sensitizers and gold sensitizers as well as the elevated temperature hold (digestion) times following addition of sensitizers. The general sensitization procedure was as follows: An emulsion sample was melted at 40° C., with 1200 mg/mole of potassium bromide added to the samples. Green spectral sensitizing dye SS-21 was then added, followed by a 20 minute hold. This was followed by the addition of sodium thiosulfate pentahydrate, then potassium tetrachloroaurate. The temperature of the well stirred mixture was then raised to 60° C. over 12 minutes and held at 60° C. for 10 minutes. The emulsion was rapidly cooled to 40° C., 70 mg/mole of APMT was added, and the emulsion was chill set.

Each sample was coated on a support provided with an antihalation layer at 0.85 g/m$^2$ of silver with 1.08 g/m$^2$ of cyan dye-forming coupler C and 2.7 g/m$^2$ of gelatin. This layer was overcoated with 1.6 g/m$^2$ of gelatin, and the entire coating was hardened with bis(-vinylsulfonylmethyl)ether at 1.75% of the total coated gelatin. Coatings were exposed through a step wedge for 0.02 second with a 3000° K. tungsten source filtered with a Daylight V and a Kodak Wratten TM 9 filter. The coatings were processed in the Kodak Flexicolor TM C-41 process.

The photographic performance of the samples of Emulsion L and the emulsion of Example 40 having substantially matched acceptable minimum densities and the highest attainable sensitivity (i.e., substantially optimally sensitized samples) were as follows:

Emulsion L exhibited a minimum density of 0.23. It was assigned a relative sensitivity of 100. Its contrast normalized granularity was 0.018.

The Example 40 emulsion exhibited a minimum density of 0.22. Its relative sensitivity was 178. Its contrast normalized granularity was 0.019. A large sensitivity advantage was exhibited by the Example 40 emulsion. Although the Example 40 emulsion and Emulsion L exhibited a small difference in their granularities, the large sensitivity difference more than offset the granularity differences. From the data it is apparent the Example 40 emulsion would exhibit a large sensitivity advantage versus a cubic grain emulsion of matched granularity.

EXAMPLES 43–51

These Examples have as their purpose to demonstrate the effectiveness of selected stabilizers employed in the emulsions of the invention.

EXAMPLE 43—PREPARATION OF TABULAR SILVER IODOCHLORIDE EMULSION T-1

A tabular silver iodochloride emulsion was precipitated as follows:

A 4500 mL solution containing 3.5 percent by weight of low methionine gelatin, 0.0056 mol/L of sodium chloride and $3.4\times10^{-4}$ mol/L of potassium iodide was provided in a stirred reaction vessel. The contents of the reaction vessel were maintained at 40° C., and the pCl was 2.25.

While this solution was vigorously stirred, 90 ml of 2.0M silver nitrate solution and 90 mL of a 1.99M sodium chloride were added simultaneously at a rate of 180 mL/min each.

The mixture was then held for 3 minutes, the temperature remaining at 40° C. Following the hold, a 0.5M silver nitrate solution and a 0.5M sodium chloride solution were added simultaneously at 24 mL/min for 40 minutes, the pCl being maintained at 2.25. The 0.5M silver nitrate solution and the 0.5M sodium chloride solution were then added simultaneously with a ramped linearly increasing flow from 24 mL/min to 37.1 mL/min over 70 minutes, the pCl being maintained at 2.25. Finally, 0.75M silver nitrate solution and 0.75M sodium chloride solution were added at constant rate of 37.1 mL/min over 90 minutes, the pCl being maintained at 2.25. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.55 μm and an average thickness of 0.155 μm.

EXAMPLE 44—PREPARATION OF TABULAR SILVER IODOCHLORIDE EMULSION T-2

A tabular silver iodochloride emulsion was precipitated as described in Example 43, except that 20 molar ppm of $K_4Ru(Cl)_6$ was added during the precipitation.

The resulting emulsion contained 0.06 mole percent iodide, based on silver. More than 50 percent of the total grain projected area was provided by tabular grains having {100} major faces, with an average ECD of 1.42 μm and an average thickness of 0.146 μm.

EXAMPLE 45—PREPARATION OF TABULAR SILVER IODOCHLORIDE EMULSION T-3

A tabular silver iodochloride emulsion was precipitated as described in Example 43, then washed by ultrafiltration. Its final pH and pCl were adjusted to 5.6 and 1.8, respectively.

More than 50 percent of the total grain projected area of the resulting emulsion was provided by tabular grains having {100} major faces, with an average ECD of 1.38 μm and an average thickness of 0.148 μm. The emulsion contained 0.06 mole percent iodide, based on silver.

EXAMPLE 46—PREPARATION OF TABULAR SILVER IODOCHLORIDE EMULSION T-4

A tabular silver iodochloride emulsion was precipitated as described in Example 43, then washed by ultrafiltration. The final pH and pCl were adjusted to 5.6 and 1.8, respectively.

The resulting emulsion contained 0.06 mole percent iodide, based on silver. More than 50 percent of the total grain projected area was provided by tabular grains having {100} major faces, with an average ECD of 1.61 μm and an average thickness of 0.15 μm.

The sensitizing (SS) dyes and super-sensitizing (SU) compound shown below are employed in the Examples to follow:

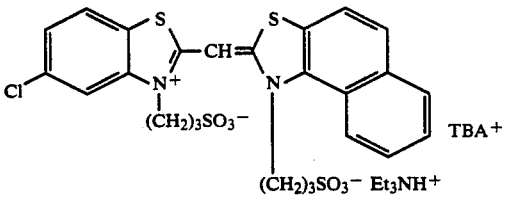

SS-52

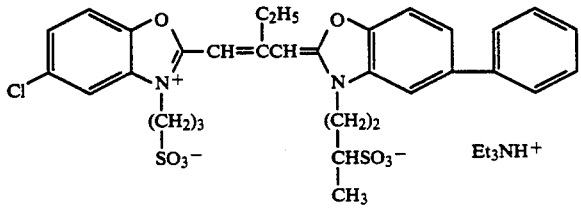

SS-53

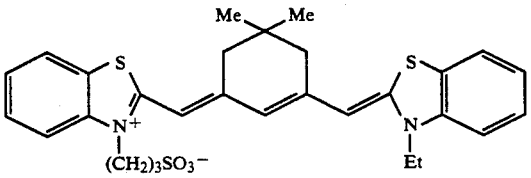

SS-54

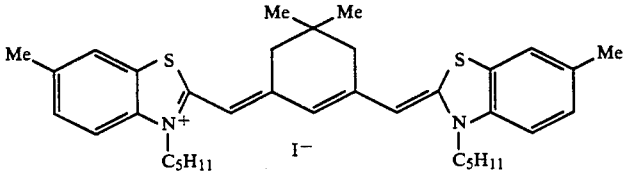

SS-55

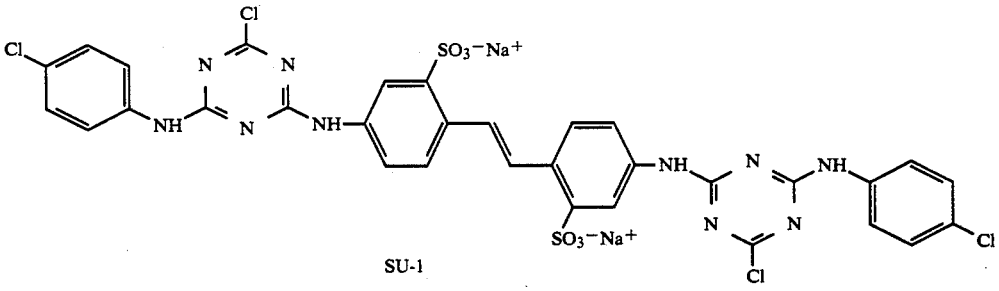

SU-1

EXAMPLE 47—PREPARATION, EXPOSURE, AND PROCESSING OF PHOTOGRAPHIC ELEMENTS CONTAINING GROUP A STABILIZER COMPOUNDS

The tabular silver chloride emulsion T-1 of Example 43 was blue-sensitized as follows: 624 mg/silver mole of sensitizing dye SS-52 was added to the emulsion. After holding for 20 minutes, 2.4 mg/silver mole of colloidal gold sulfide was added. The mixture was heated to 60° C., held at this temperature for 40 minutes, and then cooled to 40° C. At this point, a mercapto-substituted heterocyclic photographic stabilizer compound of Group A was added to the emulsion. These stabilizer compounds are shown in Table XXXII.

TABLE XXXII

| | R |
|---|---|
| A-1 | $CH_3CONH$ |
| A-2 | H |
| A-3 | $CH_3O$ |
| A-4 | $H_2NCONH$ |
| A-5 | $HOOCCH_2NHCONH$ |
| A-6 | $C_2H_5OOCCONH$ |

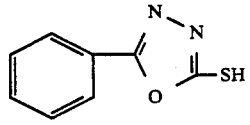

A-7

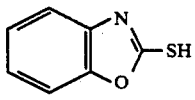

A-8

A dispersion of the yellow dye-forming Coupler Y in dibutyl phthalate (4:1 weight ratio) was added to each of the emulsions, which were then coated on a resin-coated paper support to form elements containing 0.34 g/m$^2$ of silver, 1.08 g/m$^2$ of coupler, and 1.51 g/m$^2$ of gelatin. A protective overcoat containing 1.076 g/m$^2$ of gelatin was applied, along with the hardener bis(vinylsulfonylmethyl) ether in an amount 1.8 weight percent of total gelatin.

The elements were given a 0.1 second exposure, using a 0–3 step tablet (0.15 increments) with a tungsten lamp having a color temperature of 3000° K., log lux 2.95. The elements were exposed through a combination of magenta and yellow filters, 0.3 ND (Neutral Density) filter, and UV filter, designed to simulate a color negative print exposure source. The processing consisted of a color development (45 sec, 35° C.), bleach-fix (45 sec, 35° C.) and stabilization or water wash (90 sec, 35° C.) followed by drying (60 sec, 60° C.). The following solutions were used:

| | |
|---|---|
| Developer | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonylaminoethyl)-2-methylphenylenediamine sesquisulfate monohydrate | 5.0 g |
| Stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total of 1 liter, pH adjusted to 7.2 | |

The sensitivity of the emulsion was measured at 1.0 density units above Dmin. Changes in sensitivity were measured on individual samples of each element that were subjected, prior to processing, to 1 day incubation at 60° C. (140° F.) and 1 week incubation at 48.9° C. (120° F.), relative to samples that were maintained at −17.8° C. (0° F.) Dmin increases, or fog, relative to the non-incubated samples were determined for the incubated samples of elements containing stabilizers and normalized with respect to the similarly determined fog values of the incubated control samples. The results of these measurements are collected in Table XXXIII.

TABLE XXXIII

| | | Keeping Conditions | | | |
|---|---|---|---|---|---|
| | Stabilizer | 1 day at 60° C. | | 1 week at 37.8° C. | |
| Element | (mmole/Ag mole) | Δ sensitivity | normalized fog | Δ sensitivity | normalized fog |
| 1 control | none | * | 100 | * | 100 |
| 2 | A-1 (0.29) | 29 | 33 | 36 | 41 |
| 3 | A-1 (0.48) | 22 | 25 | 25 | 35 |
| 4 | A-2 (0.29) | 34 | 36 | 41 | 44 |

TABLE XXXIII-continued

| | | Keeping Conditions | | | |
|---|---|---|---|---|---|
| | Stabilizer | 1 day at 60° C. | | 1 week at 37.8° C. | |
| Element | (mmole/Ag mole) | Δ sensitivity | normalized fog | Δ sensitivity | normalized fog |
| 5 | A-2 (0.48) | 32 | 39 | 39 | 44 |
| 6 | A-3 (0.29) | 31 | 33 | 37 | 40 |
| 7 | A-3 (0.48) | 26 | 25 | 29 | 34 |
| 8 | A-4 (0.29) | 28 | 25 | 33 | 35 |
| 9 | A-4 (0.48) | 20 | 21 | 25 | 29 |
| 10 | A-5 (0.29) | 42 | 49 | 54 | 53 |
| 11 | A-5 (0.38) | 34 | 39 | 43 | 48 |
| 12 | A-6 (0.29) | 29 | 36 | 35 | 42 |
| 13 | A-6 (0.48) | 23 | 29 | 28 | 35 |
| 14 | A-7 (0.19) | 65 | 25 | 70 | 37 |
| 15 | A-7 (0.38) | 46 | 9 | 45 | 15 |
| 16 | A-8 (0.29) | 59 | 54 | 88 | 63 |
| 17 | A-8 (0.48) | 43 | 40 | 52 | 50 |

* sensitivity could not be determined because of very high fog

The results in Table XXXIII illustrate the substantial decreased changes in sensitivity and fog under accelerated keeping conditions that were provided by stabilizer compounds of Group A incorporated in the elements.

EXAMPLE 48—PREPARATION, EXPOSURE, AND PROCESSING OF PHOTOGRAPHIC ELEMENTS CONTAINING GROUP B STABILIZER COMPOUNDS

Photographic elements were prepared, exposed, and processed as described in Example 47, except that quaternary aromatic chalcogenazolium salt photographic stabilizer compounds of Group B were included in the elements in place of the Group A compounds. Table XXXIV lists the Group B stabilizer compounds employed.

TABLE XXXIV

Group B Stabilizer Compounds

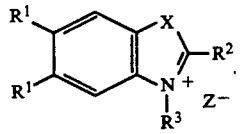

| | R1 | X | Z− | R2 | R3 |
|---|---|---|---|---|---|
| B-1 | H | Se | $BF_4^-$ | $CH_3$ | $C_2H_5$ |
| B-2 | H | S | $BF_4^-$ | H | $CH_2CH_2CONHSO_2CH_3$ |
| B-3 | H | S | $BF_4^-$ | H | $(CH_2)_{10}$-3-benzothiazolyl |
| B-4 | H | S | $BF_4^-$ | H | $CH_3$ |
| B-5 | H | S | $BF_4^-$ | H | $CH_2{=}CHCH_2$ |
| B-6 | $CH_3O$ | S | — | H | $CH_2CH_2CH_2SO_3^-$ |

Sensitivity changes and fog increases resulting from pre-processing incubation of the elements were determined as described in Example 47, except that the 1-week test was carried out at a temperature of 37.8° C. (100° F.) rather than 48.9° C. (120° F.). The results are shown in Table XXXV.

TABLE XXXV

| Element | Stabilizer (mmole/Ag mole) | Keeping Conditions: 1 day at 60° C. Δ sensitivity | 1 day at 60° C. normalized fog | 1 week at 37.8° C. Δ sensitivity | 1 week at 37.8° C. normalized fog |
|---|---|---|---|---|---|
| 1 control | none | 46 | 100 | 24 | 100 |
| 2 | B-1 (0.29) | 25 | 58 | 13 | 55 |
| 3 | B-1 (0.48) | 16 | 44 | 8 | 45 |
| 4 | B-2 (0.29) | 18 | 58 | 12 | 80 |
| 5 | B-2 (0.38) | 19 | 64 | 13 | 85 |
| 6 | B-3 (0.29) | 22 | 78 | 8 | 90 |
| 7 | B-3 (0.38) | 19 | 64 | 8 | 75 |
| 8 | B-4 (0.38) | 39 | 78 | 21 | 60 |
| 9 | B-5 (0.29) | 18 | 56 | 9 | 70 |
| 10 | B-5 (0.48) | 15 | 62 | 7 | 80 |
| 11 | B-6 (0.29) | 32 | 86 | 15 | 70 |

The results in Table XXXV show that the changes in sensitivity and fog that resulted from accelerated keeping conditions were substantially diminished by the inclusion of Group B stabilizer compounds in the elements.

EXAMPLE 49—PREPARATION, EXPOSURE, AND PROCESSING OF PHOTOGRAPHIC ELEMENTS CONTAINING GROUP C STABILIZER COMPOUNDS

Photographic elements were prepared, exposed, and processed as described in Example 47, except that photographic stabilizers of Group C, heterocyclic compounds which contain an ionizable or dissociable hydrogen attached to a ring nitrogen atom, were included in the elements in place of Group A compounds. The Group C stabilizer compounds employed are listed in Table XXXVI.

TABLE XXXVI

Group C Stabilizer Compounds

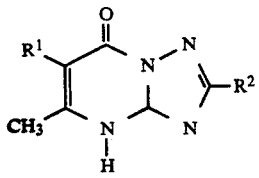

| | $R^1$ | $R^2$ |
|---|---|---|
| C-1 | H | H |
| C-2 | Br | H |
| C-3 | H | $SCH_3$ |
| C-4 | Br | $SC_8H_{17}$ |

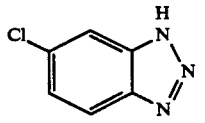

C-5

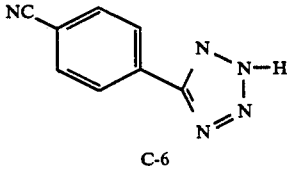

C-6

Changes in sensitivity and fog arising from pre-processing incubation of the elements were determined as described in Example 48. Table XXXVII contains the results of these measurements.

TABLE XXXVII

| Element | Stabilizer (mmole/Ag mole) | Keeping Conditions: 1 day at 60° C. Δ sensitivity | 1 day at 60° C. normalized fog | 1 week at 37.8° C. Δ sensitivity | 1 week at 37.8° C. normalized fog |
|---|---|---|---|---|---|
| 1 control | none | 50 | 100 | 25 | 100 |
| 2 | C-1 (3.8) | 23 | 46 | 16 | 50 |
| 3 | C-1 (15.2) | 17 | 46 | 12 | 67 |
| 4 | C-2 (3.8) | 19 | 25 | 6 | 21 |
| 5 | C-2 (15.2) | 19 | 40 | 7 | 50 |
| 6 | C-3 (0.38) | 21 | 46 | 16 | 46 |
| 7 | C-3 (3.8) | 19 | 73 | 12 | 96 |
| 8 | C-4 (0.38) | 20 | 48 | 10 | 63 |
| 9 | C-4 (3.8) | 16 | 50 | 14 | 54 |
| 10 | C-5 (0.38) | 31 | 35 | 16 | 33 |
| 11 | C-5 (3.8) | 23 | 46 | 9 | 42 |
| 12 | C-6 (0.38) | 29 | 58 | 19 | 63 |
| 13 | C-6 (3.8) | 26 | 58 | 14 | 63 |

As can be seen from the data in Table XXXVII, inclusion of stabilizer compounds of Group C in the elements generally led to substantial lessening of sensitivity and fog changes arising from accelerated keeping conditions.

EXAMPLE 50—PREPARATION, EXPOSURE AND PROCESSING OF PHOTOGRAPHIC ELEMENTS CONTAINING OTHER STABILIZER COMPOUNDS

Photographic elements were prepared, exposed, and processed as described in Example 47, except that other photographic stabilizers, identified in Tables XXXVIII and XXXIX below, were included in the elements in place of the Group A compounds.

Table XXXVIII contains the formulas of several dichalcogenide compounds that are representative photographic stabilizers of Group D.

TABLE XXXVIII

Group D Stabilizer Compounds

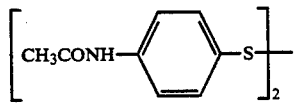

D-1

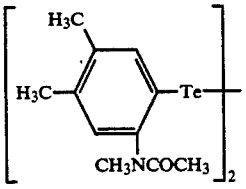

D-2

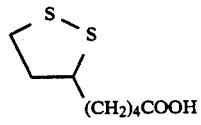

D-3

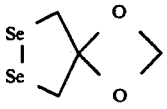

D-4

In addition to the compounds shown in Table XXXVIII, the following stabilizer compounds were included in individual photographic elements: mercuric chloride, benzoquinone, and a mixture of potassium benzenethiosulfonate and sodium p-toluenesulfinate.

Changes in sensitivity and fog resulting from preprocessing incubation of the elements were determined as described in Example 48. The results are given in Table XXXIX.

TABLE XXXIX

| Element | Stabilizer (mmole/Ag mole) | Keeping Conditions: 1 day at 60° C. Δ sensitivity | 1 day at 60° C. normalized fog | 1 week at 37.8° C. Δ sensitivity | 1 week at 37.8° C. normalized fog |
|---|---|---|---|---|---|
| 1 control | none | 68 | 100 | 21 | 100 |
| 2 | D-1 (0.06) | 6 | 20 | 8 | 30 |
| 3 | D-2 (0.06) | 6 | 22 | 5 | 35 |
| 4 | D-3 (0.06) | 27 | 58 | 7 | 60 |
| 5 | D-4 (0.005) | 18 | 17 | 9 | 25 |
| 6 | $HgCl_2$ (0.037) | −11 | 18 | −5 | 10 |
| 7 | benzoquinone (0.37) | 44 | 27 | 21 | 25 |
| 8 | potassium tolylthio-sulfonate (0.53) + sodium p-toluene-sulfinate (0.67) | 14 | 33 | −1 | 15 |

The results in Table XXXIX demonstrate the substantially diminished changes in sensitivity and fog that resulted from preprocessing incubation of elements containing the various stabilizer compounds. In several instances, the incubation conditions appeared to cause slight sensitivity increases.

EXAMPLE 51—PREPARATION, EXPOSURE, AND PROCESSING OF PHOTOGRAPHIC ELEMENTS CONTAINING 1-(3-Acetamidophenyl)-5-Mercaptotetrazole-REDUCING AGENT MIXTURES Photographic elements containing mixtures of 1-(3-acetamidophenyl)-5-mercaptotetrazole (stabilizer compound A-1 of Example 47) with various enolic reducing agents were prepared, exposed, and processed using the procedures described in Example 47. The enolic reducing agents employed were piperidinohexose reductone (PHR), catechol disulfonate (CDS), hydroquinone (HQ), and 4-hydroxymethyl-4-methyl-1-phenyl-3-pyrazolidinone (MOP). The amount of 1-(3-acetamidophenyl)-5-mercaptotetrazole included in each element was 0.38 mmole/Ag mole.

Dmin increases, or fog, were measured as described in Example 48 on samples of each element that were subjected, prior to processing, to 1 week incubation at 37.8° C. These fog density values were normalized with respect to the fog observed for the incubated control sample. The results are summarized in Table XL.

TABLE XL

| Element | Reducing agent (mmole/Ag mole) | Keeping Condition 1 week at 37.8° C. normalized fog |
|---|---|---|
| 1 | none | 100 |
| 2 | PHR (5.4) | 13 |
| 3 | CDS (33) | 13 |
| 4 | HQ (7) | 19 |
| 5 | MOP (3.6) | 31 |

The data in Table XL illustrate the substantial lessening of fog that resulted when enolic reducing agents typified by the compounds described above were included, along with stabilizer A-1, in photographic elements.

The invention has been described in detail with particular reference to preferred embodiments thereof, but it will be understood that variations and modifications can be effected within the spirit and scope of the invention.

What is claimed is:

1. A radiation sensitive emulsion comprised of a dispersing medium and silver halide grains, wherein at least 50 percent of total grain projected area is accounted for by tabular grains (1) bounded by {100} major faces having adjacent edge ratios of less than 10, (2) each having an aspect ratio of at least 2, and (3) internally at their nucleation site containing iodide and at least 50 mole percent chloride.

2. A radiation sensitive emulsion according to claim 1 wherein the tabular grains have an average aspect ratio of at least 5.

3. A radiation sensitive emulsion according to claim 1 wherein the tabular grains accounting for at least 50 percent of total grain projected area have adjacent major face edge ratios of less than 5.

4. A radiation sensitive emulsion according to claim 1 wherein at least the tabular grains contain at least 70 mole percent chloride.

5. A radiation sensitive emulsion according to claim 1 wherein the tabular grains contain a transition metal dopant.

6. A radiation sensitive emulsion according to claim 5 wherein the transition metal dopant is iridium.

7. A radiation sensitive emulsion according to claim 6 wherein iridium is incorporated in the emulsion in an amount sufficient to reduce low intensity reciprocity failure.

8. A radiation sensitive emulsion according to claim 7 wherein the emulsion contains from $1\times10^{-9}$ to $1\times10^{-6}$ mole per silver mole iridium.

9. A radiation sensitive emulsion according to claim 8 wherein the emulsion contains from $1\times10^{-8}$ to $1\times10^{-7}$ mole per silver mole iridium.

10. A radiation sensitive emulsion according to claim 1 wherein the emulsion is sensitized with at least one sensitizer chosen from the class consisting of sulfur, selenium and gold sensitizers.

11. A radiation sensitive emulsion according to claim 1 wherein the emulsion contains at least one spectral sensitizing dye.

12. A radiation sensitive emulsion comprised of a dispersing medium and silver halide grains which are at least in part tabular silver halide grains bounded by {100} major faces wherein, of the tabular grains bounded by {100} major faces a portion accounting for 50 percent of total grain projected area selected on the criteria of adjacent major face edge ratios of less than 10 and thicknesses of less than 0.3 μm and having higher aspect ratios than any remaining tabular grains satisfying these criteria (1) have an average aspect ratio of greater than 8 and (2) internally at their nucleation site contain iodide and at least 50 mole percent chloride.

13. A radiation sensitive emulsion according to claim 12 wherein the selected portion of the tabular grains have an average aspect ratio of greater than 12.

14. A radiation sensitive emulsion according to claim 12 wherein the selected portion of the tabular grains have adjacent major face edge ratios of less than 2.

15. A radiation sensitive emulsion according to claim 12 wherein the selected portion of the tabular grains are thin tabular grains having thicknesses of less than 0.2 μm.

16. A radiation sensitive emulsion according to claim 12 wherein the selected portion of the tabular grains are ultrathin tabular grains having thicknesses of less than 0.06 μm.

17. A radiation sensitive emulsion according to claim 12 wherein at least the selected portion of the tabular grains contain at least 90 mole percent chloride.

18. A radiation sensitive emulsion according to claim 12 wherein at least the selected portion of the tabular grains are silver iodochloride grains.

19. A radiation sensitive emulsion according to claim 12 wherein the emulsion is gold sensitized and contains a benzothiazolium salt stabilizer.

20. A radiation sensitive emulsion according to claim 12 wherein the emulsion contains gold sulfide as a chemical sensitizer.

21. A radiation sensitive emulsion according to claim 1 or 12 wherein the tabular grains internally contain transition metal ion dopants and performance modifying ion dopants capable of forming coordination complex ligands with the transition metal ion dopants.

22. A radiation sensitive emulsion according to claim 21 wherein the performance modifying ion dopant is a cyano ion.

23. A radiation sensitive emulsion according to claim 22 wherein the cyano ion and the transition metal ion dopant together form a hexacoordination complex.

24. A radiation sensitive emulsion according to claim 23 wherein the transition metal ion dopant is a period 4 metal ion dopant.

25. A radiation sensitive emulsion according to claim 24 wherein the transition metal ion dopant is

26. A radiation sensitive emulsion according to claim 23 wherein the transition metal ion dopant is a period 5 or 6 metal ion dopant.

27. A radiation sensitive emulsion according to claim 26 wherein the transition metal ion is chosen from groups 8, 9 and 10.

28. A radiation sensitive emulsion according to claim 26 wherein the dopants are introduced in the form of a hexacoordination complex satisfying the formula:

$$[M(CN)_{6-y}L_y]^m$$

where

M is rhenium, ruthenium or osmium,

L is a bridging ligand, y is zero, 1 or 2, and m is −2, −3 or −4.

29. A radiation sensitive emulsion according to claim 21 wherein the performance modifying ion dopant is a nitrosyl or thionitrosyl dopant.

30. A radiation sensitive emulsion according to claim 29 wherein the grains are formed in the presence of a hexacoordination complex satisfying the formula:

$$[M'L_4(NY)L']^n$$

where

M' is a transition metal ion dopant,

L is a bridging ligand,

L' is L or (NY),

Y is oxygen or sulfur, and n is zero, −1, −2 or 31 3.

31. A radiation sensitive emulsion according to claim 30 wherein M' is chromium, rhenium, ruthenium, osmium or iridium and L and L' are one or a combination of halogen and cyano ligands or a combination of these ligands with up to two aquo ligands.

32. A radiation sensitive emulsion according to claim 1 or 12 wherein the tabular grains internally contain on average at least one pair of metal ions chosen from groups 8, 9 and 10 and periods 5 and 6 at adjacent cation sites in their crystal lattice.

33. A radiation sensitive emulsion according to claim 32 wherein on average the metal ions occupy at least five pairs of adjacent cation lattice sites within each of the tabular grains.

34. A radiation sensitive emulsion according to claim 33 wherein on average the metal ions occupy at least ten pairs of adjacent cation lattice sites within each of the tabular grains.

35. A radiation sensitive emulsion according to claim 32 wherein the metal ions are iridium ions.

36. A radiation sensitive emulsion according to claim 1 or 12 wherein the emulsion contains a photographic stabilizer that protects the emulsion against changes in sensitivity and fog upon aging, the stabilizer being chosen from one or a combination of the following:

(A) a mercapto heterocyclic nitrogen compound containing a mercapto group bonded to a carbon atom which is linked to an adjacent nitrogen atom in a heterocyclic ring system, (B) a quaternary aromatic chalcogenazolium salt wherein the chalcogen is sulfur, selenium or tellurium, (C) a triazole or tetrazole containing an ionizable hydrogen bonded to a nitrogen atom in a heterocyclic ring system, (D) a dichalcogenide compound comprising an —X—X— linkage between carbon atoms wherein each X is divalent sulfur, selenium or tellurium, (E) an organic compound containing a thiosulfonyl group having the formula $—SO_2SM$ where M is a proton or cation, (F) a mercuric salt, or (G) a quinone compound.

37. A radiation sensitive emulsion according to claim 36 wherein the photographic stabilizer is a mercapto heterocyclic nitrogen compound containing a mercapto group bonded to a carbon atom which is linked to an adjacent nitrogen atom in a heterocyclic ring.

38. A radiation sensitive emulsion according to claim 37 wherein the photographic stabilizer is a 5-mercaptotetrazole.

39. A radiation sensitive emulsion according to claim 38 wherein the photographic stabilizer is an aryl-5-mercaptotetrazole.

40. A radiation sensitive emulsion according to claim 39 wherein the photographic stabilizer is a phenyl-5-mercaptotetrazole.

41. A radiation sensitive emulsion according to claim 40 wherein the photographic stabilizer is 1-(3-acetamidophenyl)-5-mercaptotetrazole.

42. A radiation sensitive emulsion according to claim 40 wherein the photographic stabilizer is 1-(3-ureidophenyl)-5-mercaptotetrazole.

43. A radiation sensitive emulsion according to claim 36 wherein the photographic stabilizer is a quaternary aromatic chalcogenazolium salt wherein the chalcogen is sulfur, selenium or tellurium.

44. A radiation sensitive emulsion according to claim 43 wherein the photographic stabilizer is a benzothiazolium salt or a benzoselenazolium salt.

45. A radiation sensitive emulsion according to claim 36 wherein the photographic stabilizer is a triazole or a tetrazole containing an ionizable hydrogen bonded to a nitrogen atom in a heterocyclic ring system.

46. A radiation sensitive emulsion according to claim 45 wherein the photographic stabilizer is a benzotriazole or a tetraazaindene.

47. A radiation sensitive emulsion according to claim 36 wherein the stabilizer is a dichalcogenide compound comprising an —X—X— linkage between carbon atoms wherein each X is a divalent sulfur, selenium or tellurium.

48. A radiation sensitive emulsion according to claim 47 wherein each X is selenium.

49. A process of preparing silver halide emulsions in which tabular grains of less than 0.3 μm in thickness exhibiting {100} major faces with adjacent edge ratios of less than 10 account for at least 50 percent of total grain projected area and internally at their nucleation site contain iodide and at least 50 mole percent chloride, comprised of the steps of (1) introducing silver and halide salts and a dispersing medium into a continuous double jet reactor so that nucleation of the tabular grains occurs in the presence of iodide with chloride accounting for at least 50 mole percent of the halide present in the dispersing medium and the pCl of the dispersing medium being maintained in the range of from 0.5 to 3.5 and (2) following nucleation completing grain growth in a reaction vessel which receives emulsion from the continuous double jet reactor under conditions that maintain the {100} major faces of the tabular grains.

50. A process according to claim 49 wherein bromide ion is present in the dispersing medium following grain nucleation.

51. A process according to claim 49 wherein grain nucleation is undertaken in the presence of halide ions consisting essentially of chloride and iodide ions with the pCl of the dispersing medium being in the range of from 1.0 to 3.0 and a gelatino peptizer being present having a methionine content of less than 30 micromoles per gram of peptizer.

52. A process according to claim 51 wherein grain nucleation is undertaken in the presence of halide ions consisting essentially of chloride and iodide ions with the pCl of the dispersing medium being in the range of from 1.5 to 2.5 and a gelatino peptizer being present having a methionine content of less than micromoles per gram of peptizer.

53. A process according to claim 49 wherein silver and halide salt solutions are introduced into the dispersing medium during grain nucleation and growth.

54. A process according to claim 53 wherein the addition of the silver and halide salt solutions is suspended after grain nucleation to allow Ostwald ripening of grain nuclei and then resumed.

55. A process according to claim 54 wherein chloride and iodide salt solutions are introduced into the dispersing medium during grain nucleation.

56. A process according to claim 55 wherein bromide salt solution is introduced into the dispersing medium after salt solution introduction is resumed after the addition of the silver and halide salt solutions has been suspended to allow Ostwald ripening of grain nuclei.

57. A process according to claim 49 wherein grain growth is continued until said portion of the tabular grains have an average tabularity of greater than 25.

58. A process according to claim 49 wherein a silver halide ripening agent is introduced into the dispersing medium in the growth reaction vessel.

59. A process according to claim 58 wherein the ripening agent is a thioether.

60. A process according to claim 59 wherein the thioether is a crown thioether.

61. A process according to claim 58 wherein the ripening agent is a thiocyanate.

62. A process according to claim 58 wherein the ripening agent is methionine.

63. A process according to claim 58 wherein the ripening agent contains a primary or secondary amino moiety.

64. A process according to claim 63 wherein the ripening agent is an imidazole ripening agent.

65. A process according to claim 63 wherein the ripening agent is a glycine.

66. A process according to claim 49 wherein bromide ion in a concentration of from 0.5 to 15 mole percent is present in the reaction vessel during grain growth.

67. A process according to claim 66 wherein bromide ion in a concentration of from 1 to 10 mole percent is present in the reaction vessel during grain growth.

68. A process according to claim 49 wherein iodide ion in a concentration of from 0.001 to less than 1 mole percent is present in the reaction vessel during grain growth.

69. A process according to claim 49 wherein precipitation occurs in a pH range of from 2.0 to 8.0.

70. A process according to claim 69 wherein precipitation occurs at a pH of less than 7.0.

71. A process according to claim 70 wherein precipitation occurs in a pH range of from 2.0 to 5.0.

72. A process according to claim 49 wherein precipitation occurs in the presence of a mild oxidizing agent chosen from the class consisting of a mercuric salt, an alkali tetrahaloaurate and an elemental sulfur releasing compound.

73. A process of preparing a radiation sensitive emulsion containing a dispersing medium and silver halide grains, wherein at least 50 percent of total grain projected area is accounted for by tabular grains (1) bounded by {100}major faces having adjacent edge ratios of less than 10, (2) each having an aspect ratio of at least 2, (3) containing on average at least one pair of metal ions chosen from groups 8, 9 and 10, periods 5 and 6, at adjacent cation sites in their crystal lattice, and (4) internally at their nucleation site containing iodide and at least 50 mole percent chloride are prepared by the steps comprised of (a) introducing silver and halide salts into a dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5, (b) following nucleation completing grain growth under conditions that maintain the {100} major faces of the tabular grains, and (c) during at least one of steps (a) and (b) introducing into the dispersing medium oligomers of group 8, 9 or 10, period 5 or 6, metal, wherein each oligomer contains at least two metal ions and on average at least two metal ions are incorporated in each grain in adjacent cation sites.

74. A process according to claim 73 wherein bromide ion is present in the dispersing medium following grain nucleation.

75. A process according to claim 73 wherein grain nucleation is undertaken in the presence of halide ions consisting essentially of chloride and iodide ions with the pCl of the dispersing medium being in the range of from 1.0 to 3.0 and a gelatino peptizer being present having a methionine content of less than 30 micromoles per gram of peptizer.

76. A process according to claim 75 wherein grain nucleation is undertaken in the presence of halide ions consisting essentially of chloride and iodide ions with the pCl of the dispersing medium being in the range of from 1.5 to 2.5 and a gelatino peptizer being present having a methionine content of less than 12 micromoles per gram of peptizer.

77. A process according to claim 73 wherein said oligomers each provide from 2 to 20 of the group 8, 9 or 10 metal ions.

78. A process according to claim 77 wherein said oligomers each provide from 6 to 10 of the group 8, 9 or 10 metal ions.

79. A process according to claim 73 wherein the oligomers are introduced into the face centered cubic crystal lattice structure as anionic hexacoordination complexes consisting essentially of the group 8, 9 or 10 metal ions and bridging ligands.

80. A process according to claim 79 wherein the bridging ligands are halide ions.

81. A process according to claim 79 wherein the anionic hexacoordination complexes are selected from among those satisfying the formulae:

$M_2L_{10}$ $M_6L_{24}$ $M_8L_{32}$ and $M_{10}L_{38}$ where

M represents a group 8, 9 or 10, period 5 or 6, element and

L represents a bridging ligand.

82. A process according to claim 81 wherein L is chosen from among halide ligands.

83. A process according to claim 81 wherein M is iridium.

84. A process according to claim 73 wherein at least five group 8, 9 or 10 metal ions are introduced per grain.

85. A process according to claim 84 wherein at least ten group 8, 9 or 10 metal ions are introduced per grain.

* * * * *